US011406236B2

(12) United States Patent
Tanaka et al.

(10) Patent No.: US 11,406,236 B2
(45) Date of Patent: Aug. 9, 2022

(54) ELECTRIC VACUUM CLEANING APPARATUS

(71) Applicant: TOSHIBA LIFESTYLE PRODUCTS & SERVICES CORPORATION, Kawasaki (JP)

(72) Inventors: Masatoshi Tanaka, Seto (JP); Satoshi Goto, Mizuho (JP); Yukio Machida, Owariasahi (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 309 days.

(21) Appl. No.: 16/624,014

(22) PCT Filed: Jun. 22, 2018

(86) PCT No.: PCT/JP2018/023754
§ 371 (c)(1),
(2) Date: Dec. 18, 2019

(87) PCT Pub. No.: WO2018/235932
PCT Pub. Date: Dec. 27, 2018

(65) Prior Publication Data

US 2020/0107685 A1 Apr. 9, 2020

(30) Foreign Application Priority Data

Jun. 23, 2017 (JP) ..... JP2017-123258

(51) Int. Cl.
*A47L 9/10* (2006.01)
*A47L 9/28* (2006.01)

(52) U.S. Cl.
CPC ..... *A47L 9/108* (2013.01); *A47L 9/104* (2013.01); *A47L 9/2873* (2013.01); *A47L 9/2884* (2013.01)

(58) Field of Classification Search
CPC ..... A47L 9/104; A47L 9/106; A47L 9/108; A47L 9/122; A47L 9/20; A47L 9/2873; A47L 9/2884
See application file for complete search history.

(56) References Cited

U.S. PATENT DOCUMENTS

2007/0157416 A1* 7/2007 Lee ..... A47L 5/362 15/319
2007/0226949 A1* 10/2007 Hahm ..... A47L 9/106 15/340.1

(Continued)

FOREIGN PATENT DOCUMENTS

CA 2954157 A1 * 1/2016 ..... A47L 9/28
CN 200980633 Y 11/2007

(Continued)

OTHER PUBLICATIONS

JP-2017104335-A—English Machine Translation (Year: 2017).*
International Search Report dated Aug. 21, 2018 in PCT/JP2018/023754 filed on Jun. 22, 2018, 1 page.

*Primary Examiner* — Marc Carlson
(74) *Attorney, Agent, or Firm* — Oblon, McClelland, Maier & Neustadt, L.L.P.

(57) ABSTRACT

An electric vacuum cleaning apparatus includes a station and an electric vacuum cleaner connectable/disconnectable from the station. The electric vacuum cleaner includes: a coarse-dust collecting chamber that accumulates coarse dust separated with a first separator; a filter chamber that accumulates fine dust separated with a filter; a coarse-dust waste-outlet that discharges the coarse dust from the coarse-dust collecting chamber; a fine-dust waste-outlet adjacent to the coarse-dust waste-outlet and discharges the fine dust from the filter chamber; and a waste-outlet lid that opens/closes both the coarse-dust waste-outlet and fine-dust waste-outlet together. The station includes: a secondary dust con- (Continued)

tainer accumulating coarse dust to be discharged from a primary dust container through the coarse-dust waste-outlet port and fine dust to be discharged from the primary dust container through the fine-dust waste-outlet; and a secondary electromotive blower that applies negative pressure to the primary dust container to transfer the coarse and fine dust.

17 Claims, 29 Drawing Sheets

(56) References Cited

U.S. PATENT DOCUMENTS

| | | | | |
|---|---|---|---|---|
| 2008/0201895 | A1* | 8/2008 | Kim | A47L 9/106 15/319 |
| 2009/0049640 | A1* | 2/2009 | Lee | A47L 9/20 15/319 |
| 2009/0133212 | A1* | 5/2009 | Morishita | A47L 9/20 15/347 |
| 2009/0249577 | A1* | 10/2009 | Ni | A47L 9/1658 15/326 |
| 2013/0305481 | A1* | 11/2013 | Jung | A47L 11/33 15/301 |
| 2013/0305483 | A1* | 11/2013 | Dyson | A47L 9/1616 15/353 |
| 2016/0278596 | A1* | 9/2016 | Janzen | A47L 11/4041 |
| 2017/0196430 | A1* | 7/2017 | Machida | A47L 9/106 |
| 2018/0199776 | A1* | 7/2018 | Sato | A47L 9/1633 |
| 2020/0100640 | A1* | 4/2020 | Marutani | A47L 9/2852 |

FOREIGN PATENT DOCUMENTS

| | | | | | |
|---|---|---|---|---|---|
| CN | 101466296 | A | | 6/2009 | |
| DE | 102010000607 | A1 | * | 9/2011 | A47L 5/225 |
| EP | 1961358 | A2 | * | 8/2008 | A47L 9/106 |
| EP | 2407074 | A2 | * | 1/2012 | A47L 9/28 |
| EP | 2 798 992 | A1 | | 11/2014 | |
| JP | 2004-283327 | A | | 10/2004 | |
| JP | 2005-237732 | A | | 9/2005 | |
| JP | 2008-79922 | A | | 4/2008 | |
| JP | 2016-182190 | A | | 10/2016 | |
| JP | 2016182190 | A | * | 10/2016 | |
| JP | 2017-104335 | A | | 6/2017 | |
| JP | 2017104335 | A | * | 6/2017 | |
| KR | 10-2014-0065484 | A | | 5/2014 | |
| WO | WO-2013100131 | A1 | * | 7/2013 | A47L 9/327 |
| WO | WO-2017047291 | A | * | 3/2017 | A47L 9/2884 |
| WO | WO-2018100773 | A1 | * | 6/2018 | A47L 9/2873 |

* cited by examiner

ELECTRIC VACUUM CLEANING APPARATUS

CROSS-REFERENCE TO RELATED APPLICATION

This application claims the benefit of priority of No. PCT/JP2018/023754, filed on Jun. 22, 2018, and the PCT application is based upon and claims the benefit of priority from Japanese Patent Application No. 2017-123258 filed on Jun. 23, 2017, the entire contents of each of which are incorporated herein by reference.

FIELD

Embodiments according to the present invention relate to an electric vacuum cleaning apparatus.

BACKGROUND

A known electric vacuum cleaning apparatus includes an electric vacuum cleaner and a charging station. A cleaner body of the electric vacuum cleaner includes a primary dust container for collecting dust. The charging station includes a secondary dust container for collecting dust. The electric vacuum cleaning apparatus empties the primary dust container by discharging the dust collected in the primary dust container of the electric vacuum cleaner to the secondary dust container of the charging station.

The electric vacuum cleaner includes: a push button provided on the cleaner body; and a switching valve that closes an air passage connecting the primary dust container to an electric blower and opens an air passage connecting the secondary dust container to the electric blower, when the push button is pushed down. Additionally, the electric vacuum cleaner includes a first waste valve provided on the bottom of the primary dust container and a second waste valve provided on the top of the secondary dust container. When the push button is pushed down, the first waste valve opens. And then, the first waste valve, which is opened with the push button, opens the second waste valve by pushing the second waste valve.

When dust is discharged from the cleaner body to the charging station, a user places the cleaner body on the charging station and pushes down the push button provided on the cleaner body. Subsequently, the air passage connecting the primary dust container to the electric blower is closed, and the air passage connecting the secondary dust container to the electric blower is opened. At the same time, the first waste valve and the second waste valve are opened and thereby the primary dust container is spatially connected to the secondary dust container. Afterward, when the user operates the cleaner body so as to start up the electric blower, the air flow to be sucked in from the suction port of the cleaner body transfers the dust collected in the primary dust container to the secondary dust container.

PRIOR ART DOCUMENT

Patent Document

[Patent Document 1] JP 2004-283327 A

SUMMARY

Problems to be Solved by Invention

A known electric vacuum cleaner separates dust with a plurality of separation stages. This type of electric vacuum cleaner stepwisely separates dust having a relatively large mass and dust having a smaller mass with individual separators.

When the discharge of dust is separated in the plurality of separation stages respectively, the structure of the electric vacuum cleaner is complicated, and the number of parts of the electric vacuum cleaner is increased, which increases the cost of the electric vacuum cleaner.

Accordingly, it is an object of the present invention to provide an electric vacuum cleaning apparatus that can discharge dust from a plurality of separation stages all.

Means for Solving Problem

To achieve the above object, an electric vacuum cleaning apparatus includes: a station; and an electric vacuum cleaner that is connectable to and disconnectable from the station. The electric vacuum cleaner includes: a first separator that separates coarse dust from dust-containing air to be sucked into the electric vacuum cleaner; a coarse-dust collecting chamber that accumulates the coarse dust separated with the first separator; a second separator that separates fine dust from air passing through the first separator; a fine-dust collecting chamber that accumulates the fine dust separated with the second separator; a coarse-dust waste-outlet that discharges the coarse dust to flow out from the coarse-dust collecting chamber; a fine-dust waste-outlet that is disposed adjacent to the coarse-dust waste-outlet, and discharges the fine dust to flow out from the fine-dust collecting chamber; and a waste-outlet lid that opens and closes both of the coarse-dust waste-outlet and the fine-dust waste-outlet together. The station includes: a secondary dust container that accumulates the coarse dust to be discharged from the primary dust container through the coarse-dust waste-outlet and the fine dust to be discharged from the primary dust container through the fine-dust waste-outlet; and an electric blower that applies negative pressure to the primary dust container through the secondary dust container, and transfers the coarse dust and the fine dust from the primary dust container to the secondary dust container.

It may be desired that the fine-dust collecting chamber is adjacent to the coarse-dust collecting chamber.

It may be desired that the coarse-dust waste-outlet and the fine-dust waste-outlet are opened downward under when the electric vacuum cleaner is connected to the station.

It may be desired that the second separator includes a filter that filters and separates the fine dust. The electric vacuum cleaner includes a suction port that directly introduces air from outside of an air passage including the primary dust container by negative pressure to be generated with the electric blower, and blows the air onto the filter.

It may be desired that an opening area of the fine-dust waste-outlet is smaller than an opening area of the coarse-dust waste-outlet.

DETAILED DESCRIPTION

Embodiments of an electric vacuum cleaner and an electric vacuum cleaning apparatus according to the present invention will be described by referring to FIG. 1 to FIG. 31. In each figure, the same reference signs are given to identical or equivalent components.

Figure 1:
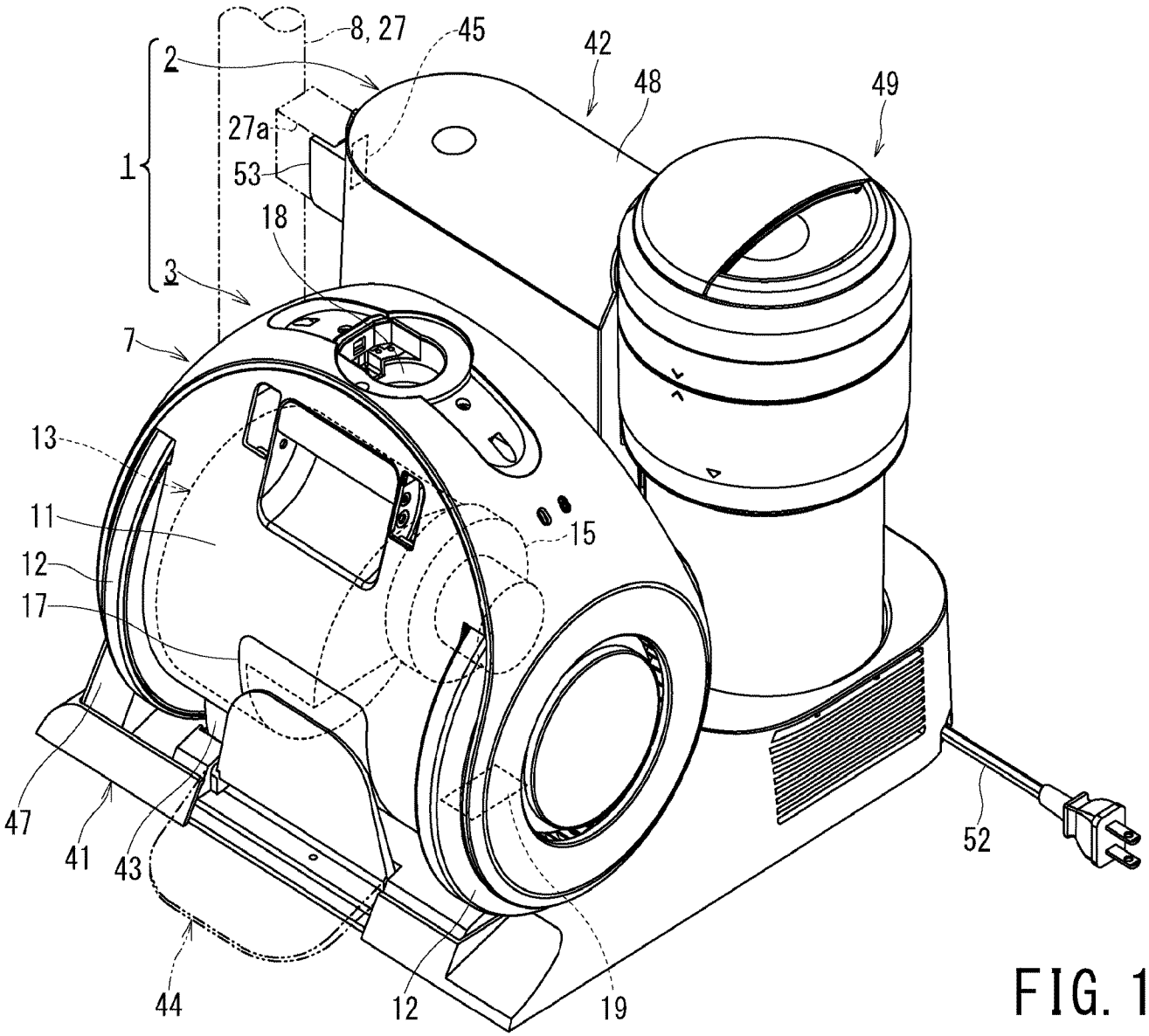
FIG. 1 is a perspective view illustrating an electric vacuum cleaning apparatus according to one embodiment of the present invention.
Figure 2:
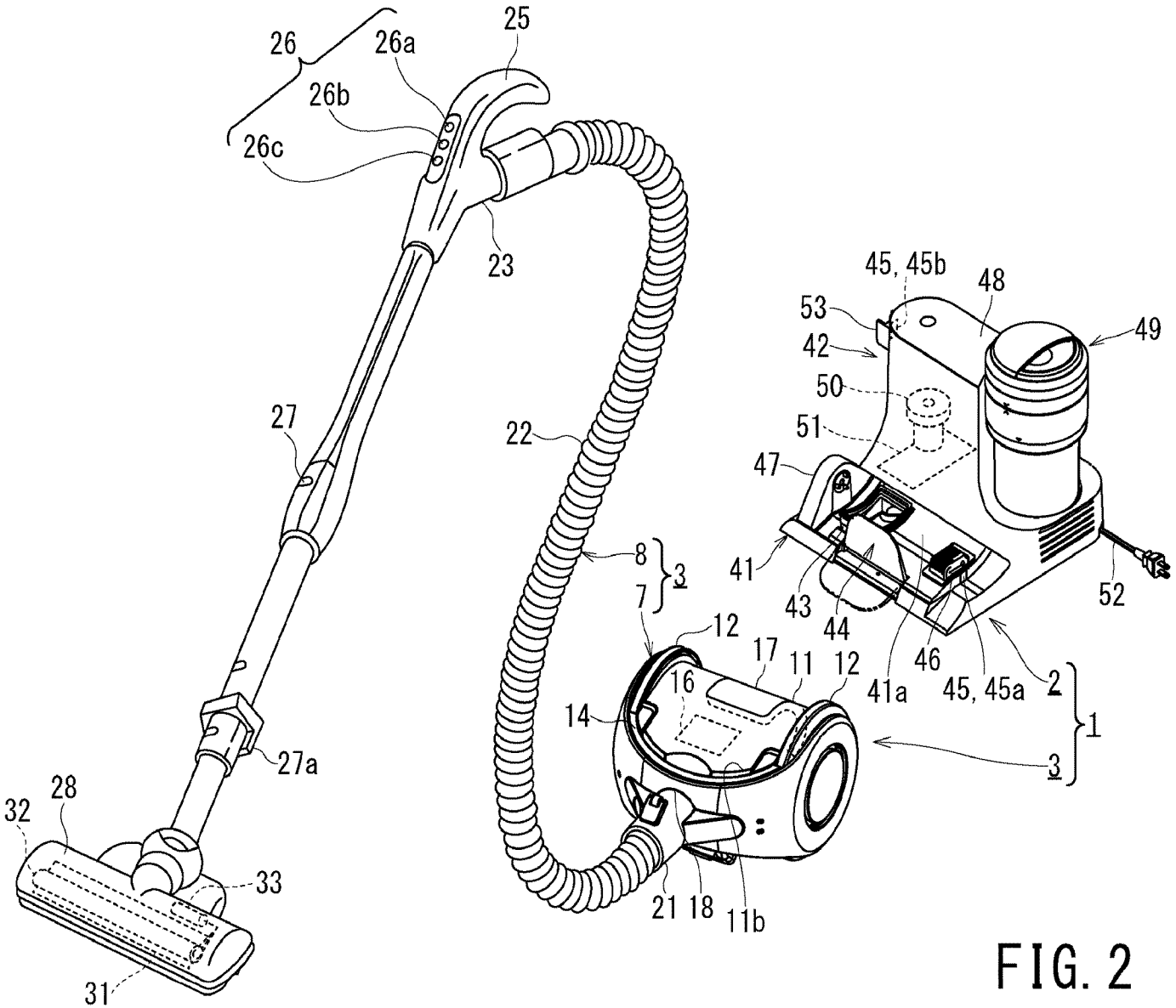
FIG. 2 is another perspective view illustrating the electric vacuum cleaning apparatus according to the embodiment of the present invention.

FIG. 1 and FIG. 2 are perspective views illustrating an electric vacuum cleaning apparatus according to one embodiment of the present invention.

As shown in FIG. 1 and FIG. 2, the electric vacuum cleaning apparatus 1 according to the present embodiment includes a stationary station 2 and an electric vacuum cleaner 3 that can be connected (coupled) to and disconnected (decoupled) from the station 2.

FIG. 1 shows a configuration in which the electric vacuum cleaner 3 is connected to the station 2. This configuration is called a storage configuration of the electric vacuum cleaning apparatus 1. FIG. 2 shows a configuration in which the electric vacuum cleaner 3 is disconnected from the station 2. FIG. 2 shows the configuration in which the electric vacuum cleaner 3 is used for cleaning.

The electric vacuum cleaner 3 is a so-called cordless type. Although the electric vacuum cleaner 3 is a so-called canister type, the electric vacuum cleaner 3 is not limited to this type but may be configured as an upright type, a stick type, or a handy type. The electric vacuum cleaner 3 being connectable to and disconnectable from the station 2 is attachable to the station 2 and can also be placed on the station 2. In terms of expression, storing the electric vacuum cleaner 3 in the station 2 includes: connecting the electric vacuum cleaner 3 to the station 2; attaching the electric vacuum cleaner 3 to the station 2; and placing the electric vacuum cleaner 3 on the station 2.

The station 2 has a function of charging the electric vacuum cleaner 3, a function of collecting the dust collected with the electric vacuum cleaner 3, and a function of accumulating the collected dust. The station 2 is placed at an arbitrary place in a room. The station 2 may be in the form of a stand on which the electric vacuum cleaner 3 in the storage configuration is simply placed. Additionally, the station 2 may have a recess for housing part of the cleaner body 7 or the entirety of the cleaner body 7. Further, the station 2 may be shaped to cover and hide the electric vacuum cleaner 3 in the storage configuration.

A user separates the cleaner body 7 (FIG. 1) of the electric vacuum cleaner 3 connected to station 2 from the station 2

(FIG. 2), and cleans the surface to be cleaned by running the electric vacuum cleaner 3 on the surface to be cleaned in the room or by moving with the electric vacuum cleaner 3 held in hand. Afterward, the user returns (connects) the cleaner body 7 to the station 2 and stores it (FIG. 1). When the cleaner body 7 is connected to the station 2, the station 2 charges the cleaner body 7 while collecting the dust accumulated by the electric vacuum cleaner 3 in a timely manner. That is, every time the cleaner body 7 is connected to the station 2 after using the electric vacuum cleaner 3 for cleaning, the electric vacuum cleaning apparatus 1 collects the dust collected with the electric vacuum cleaner 3 into the station 2 so as to empty the electric vacuum cleaner 3.

The frequency of collecting the dust from the electric vacuum cleaner 3 to the station 2 may not be each time the electric vacuum cleaner 3 connecting to the station 2. The dust-collection frequency may be every plural number of times the electric vacuum cleaner 3 connecting to the station 2 becomes plural. For example, the dust-collection frequency may be once a week on the premise that electric vacuum cleaner 3 is used once a day, i.e., the dust collection frequency may be every seven times of the use of the electric vacuum cleaner 3.

The electric vacuum cleaner 3 includes: the cleaner body 7 that can travel on the surface to be cleaned; and a tubular part 8 that is attachable to and detachable from the cleaner body 7. The tubular part 8 is fluidly connected to the cleaner body 7. The tubular part 8 is an air passage that is connected to the cleaner body 7 for sucking in dust.

The cleaner body 7 includes: a body housing 11; a pair of wheels 12 provided on the respective right and left sides of the body housing 11; a primary dust container 13 detachably attached to the body housing 11; a body handle 14; a primary electric blower 15 accommodated in the body housing 11; a cleaner controller 16 mainly for controlling the primary electric blower 15, and a rechargeable battery 17 for storing power to be supplied to the primary electric blower 15.

The cleaner body 7 drives the primary electric blower 15 by the power stored in the rechargeable battery 17. The cleaner body 7 applies negative pressure to be generated with the primary electric blower 15 to the tubular part 8. The electric vacuum cleaner 3 sucks in dust-containing air from the surface to be cleaned through the tubular part 8. The electric vacuum cleaner 3 separates dust from the inhaled dust-containing air. The electric vacuum cleaner 3 collects and accumulates the dust after separation, and exhausts the clean air from which the dust has been removed.

In the front of the body housing 11, a connection port 18 as a suction port of the cleaner body 7 is provided. The connection port 18 is a coupling joint to which the tubular part 8 can be attached, and from which the tubular part 8 can be detached. The connection port 18 fluidly connects the tubular part 8 to the primary dust container 13. The connection port 18 opens toward the front of the body housing 11.

The cleaner body 7 according to the present embodiment is used in a position in which the front of the body housing 11 is directed in the traveling direction, i.e., in a position in which the connection port 18 is directed in the traveling direction. This position is called a use position of the cleaner body 7. The vacuum cleaner main body 7 in the use position may be lifted around the wheel 12 by being pulled with the tubular part 8 held by the user's hand.

The cleaner body 7 according to the present embodiment is placed on (connected to) the station 2 in a position in which the front of the body housing 11 is directed upward, i.e., in a position in which the connection port 18 is directed upward. The position in which the connection port 18 is directed upward is referred to as a storage position of the cleaner body 7. The cleaner body 7 in the storage position is putted down to be placed on the station 2. The state of the cleaner body 7 placed on the station 2 is called a storage state of the cleaner body 7.

The wheels 12 support the cleaner body 7 such that the cleaner body 7 can travel.

The primary dust container 13 accumulates the dust to be sucked into the electric vacuum cleaner 3. The primary dust container 13 separates, collects, and accumulates the dust from the dust-containing air flowing into the cleaner body 7 while sending the clean air having been subjected to dust-removal to the primary electric blower 15.

The body handle 14 is used when a user carries the cleaner body 7. The body handle 14 is arched in the width direction of the body housing 11.

The primary electric blower 15 sucks in air from the primary dust container 13 so as to generate negative pressure (i.e., suction vacuum pressure).

The cleaner controller 16 includes a microprocessor (not shown) and a storage device (not shown) for storing, for example, parameters and various operation programs executed with the microprocessor. The storage device stores various settings (arguments) related to a plurality of preset operation modes. The operation modes are related to the output of the primary electric blower 15. Different input values (i.e., input values of the primary electric blower 15 and current values flowing to the primary electric blower 15) are set for each operation mode. Each operation mode is associated with an input received by the tubular part 8. The cleaner controller 16 alternatively selects an arbitrary operation mode corresponding to the input received by the tubular part 8 from the preset operation modes, and reads out the selected operation mode from the storage device so as to drive the primary electric blower 15 on the basis of the settings of the operation mode having been read out.

The rechargeable battery 17 supplies power to the primary electric blower 15 and the cleaner controller 16. The rechargeable battery 17 is electrically connected to a pair of charging electrodes 19 provided on the cleaner body 17.

The tubular part 8 sucks in dust-containing air from the surface to be cleaned by the negative pressure that acts from the cleaner body 7, and leads the dust-containing air to the cleaner body 7. The tubular part 8 is provided with: a connecting tube 21 detachably connected as a joint to the cleaner body 7; a dust collecting hose 22 fluidly connected to the connecting tube 21; a hand operation tube 23 fluidly connected to the dust collecting hose 22; a grip 25 protruding from the hand operation tube 23; an input unit 26 provided on the grip 25; an extension tube 27 detachably connected to the hand operation tube 23; and a cleaning head 28 detachably connected to the extension tube 27.

The connecting tube 21 is fluidly connected to the primary dust container 13 through the connection port 18.

The dust collecting hose 22 is a long, flexible, and substantially cylindrical hose. One end (i.e., the rear end in this case) of the dust collecting hose 22 is fluidly connected to the connecting tube 21. The dust collecting hose 22 is fluidly connected to the primary dust container 13 through the connecting tube 21.

The hand operation tube 23 relays the dust collecting hose 22 and the extension tube 27. One end (i.e., the rear end in this case) of the hand operation tube 23 is fluidly connected to the other end (i.e., the front end in this case) of the dust collecting hose 22. The hand operation tube 23 is fluidly connected to the primary dust container 13 through the dust collecting hose 22 and the connecting tube 21. In other words, the connecting tube 21 is a joint that connects the dust collection hose 22 to the cleaner body 7.

The grip 25 is a portion to be gripped by a user's hand for operating the electric vacuum cleaner 3. The grip 25 protrudes from the hand operation tube 23 in an appropriate shape that can be readily grasped by the user's hand.

The input unit 26 includes switches corresponding to the respective operation modes. For example, the input unit 26 includes: a stop switch 26*a* corresponding to the operation of stopping the primary electric blower 15; a start switch 26*b* corresponding to the operation of starting the primary electric blower 15; and a brush switch 26*c* corresponding to power supply to the cleaning head 28. The stop switch 26*a* and the start switch 26*b* are electrically connected to the cleaner controller 16. A user of the electric vacuum cleaner 3 can operate the input unit 26 to alternatively select one of the operation modes of the primary electric blower 15. The start switch 26*b* also functions as a selecting switch of the operation modes during operation of the primary electric blower 15. Each time the cleaner controller 16 receives an operation signal from the start switch 26*b*, the cleaner controller 16 switches the operation mode in order of strong→medium→weak→strong→medium→weak→ . . . . Instead of the start switch 26*b*, the input unit 26 may be individually provided with a strong-mode operation switch (not shown), a medium-mode operation switch (not shown), and a weak-mode operation switch (not shown).

The extension tube 27 has a telescopic structure in which a plurality of tubular bodies are overlaid, and can be expanded and contracted. A joint structure is provided at one end (i.e., the rear end in this case) of the extension tube 27, and this joint structure is attachable to and detachable from the other end (i.e., the front end in this case) of the hand operation tube 23. The extension tube 27 is fluidly connected to the primary dust container 13 through the hand operation tube 23, the dust collecting hose 22, and the connecting tube 21.

The extension tube 27 is provided with a holding projection 27*a*. The holding projection 27*a* is used for storing the tubular part 8. The holding projection 27*a* may be provided on the cleaning head 28.

The cleaning head 28 can run or slide on the surface to be cleaned such as a wooden floor and a carpet, and includes a suction port 31 on its bottom face opposed to the surface to be cleaned in a running state or a sliding state. In addition, the cleaning head 28 includes a rotatable brush 32 disposed at the suction port 31 and an electric motor 33 for driving the rotatable brush 32. A joint structure is provided on one end (i.e., the rear end in this case) of the cleaning head 28, and this joint structure is attachable to and detachable from the other end (i.e., the front end in this case) of the extension tube 27. The cleaning head 28 is fluidly connected to the primary dust container 13 through the extension tube 27, the hand operation tube 23, the dust collecting hose 22, and the connecting tube 21. That is, the cleaning head 28, the extension tube 27, the hand operation tube 23, the dust collecting hose 22, the connecting tube 21, and the primary dust container 13 is a suction-air passage from the suction port 31 to the primary electric blower 15. Each time the electric motor 33 receives the operation signal from the brush switch 26*c*, the electric motor 33 alternately repeats the operation start and the operation stop.

When the start switch 26*b* is operated, the electric vacuum cleaner 3 starts up the primary electric blower 15. For example, when the start switch 26*b* is operated when the primary electric blower 15 is stopped, first, the electric vacuum cleaner 3 starts the primary electric blower 15 in the strong operation mode. When the start switch 26*b* is operated again in the strong operation mode, the electric vacuum cleaner 3 switches the operation mode of the primary electric blower 15 to the medium operation mode. When the start switch 26*b* is operated three times, the electric vacuum cleaner 3 switches the operation mode of the primary electric blower 15 to the weak operation mode. In this manner, every time the start switch 26*b* is operated, the above-described mode switching is repeated. The strong operation mode, the medium operation mode, and the weak operation mode are predetermined operation modes. The input value to the primary electric blower 15 is the largest in the strong operation mode and is the smallest in the weak operation mode. The primary electric blower 15 having started up sucks in air from the primary dust container 13 so as to bring the inside of the primary dust container 13 into a negative pressure state.

The negative pressure inside the primary dust container 13 sequentially acts through the connection port 18, the connecting tube 21, the dust collecting hose 22, the hand operation tube 23, the extension tube 27, and the cleaning head 28 so as to act on the suction port 31. The electric vacuum cleaner 3 sucks in the dust on the surface to be cleaned together with the air by the negative pressure acting on the suction port 31. The primary dust container 13 separates, collects, and accumulates dust from the dust-containing air having been sucked in, and sends the air having been separated from the dust-containing air to the primary electric blower 15. The primary electric blower 15 discharges the air sucked from the primary dust container 13 to the outside of the cleaner body 7.

The station 2 is installed at an arbitrary place on the surface to be cleaned. The station 2 includes a platform 41 connectable to the cleaner body 7, and a dust collection part 42 integrally provided with the platform 41. In addition, the station 2 includes: a dust transfer tube 43 to be connected to the primary dust container 13 of the electric vacuum cleaner 3 in the storage configuration of the electric vacuum cleaning apparatus 1; and a speed reducer 44. This speed reducer 44 moves so that the cleaner body 7 can move forward when the cleaner body 7 in the storage position is laid down to the use position. The station 2 further includes a plurality of attaching detectors 45 configured to detect that the electric vacuum cleaner 3 is attached to the station 2.

The platform 41 is a place where the cleaner body 7 of the electric vacuum cleaner 3 is connected and disconnected, is a place where the cleaner body 7 is attached, and also is a place where the cleaner body 7 is placed on. The platform 41 has substantially the same width dimension as that of the dust collection part 42, and protrudes to the front of the dust collection part 42 so as to spread in a rectangular shape. The platform 41 has a shape and size that can accommodate the cleaner body 7 of the electric vacuum cleaner 3 in a plan view. The platform 41 has a placing face 41*a* that is brought into contact with the back face of the body housing 11 (i.e., the back face of the cleaner body 7 in the storage position with its front directed upward) so as to support the cleaner body 7. It is preferred that the shape of the placing face 41*a* conforms to the shape of the back face of the body housing 11.

The platform 41 has charging terminals 46 connectable to the cleaner body 7. When the electric vacuum cleaner 3 is connected to the station 2, the charging terminals 46 contact the corresponding charging electrodes 19 of the cleaner body 17 and is electrically connected to the charging electrodes 19.

The platform 41 has a bulge 47 that is disposed to be close to and along the side face of the cleaner body 7 in the storage configuration of the electric vacuum cleaning apparatus 1.

The dust collection part 42 is disposed behind the platform 41. The dust collection part 42 is a box formed in an appropriate shape such that the dust collection part 42 can be placed on the surface to be cleaned integrally with the platform 41. The dust collection part 42 extends upward above the platform 41. In other words, the dust collection part 42 is a protrusion that is provided side-by-side with the platform 41 as a storage place for the electric vacuum cleaner 3, and extends upward from the storage place. The dust collection part 42 has an appropriate shape that does not interfere with the cleaner body 7 connected to the platform 41.

The dust collection part 42 includes: a housing 48; a secondary dust container 49 for collecting the dust to be discharged from the primary dust container 13 through the dust transfer tube 43 and accumulates the collected dust; a secondary electric blower 50 accommodated in the dust collection part 42 and fluidly connected to the secondary dust container 49; a station controller 51 mainly for controlling the secondary electric blower 50; and a power cord 52 for leading power from a commercial AC power supply to the dust collection part 42.

In addition, the dust collection part 42 is provided with a hose attachment 53 to which the tubular part 8 of the electric vacuum cleaner 3 can be attached.

The top plate of the housing 48 and the platform 41 is an integral molding of resin.

The secondary dust container 49 accumulates the dust to be discharged from the electric vacuum cleaner 3. The secondary dust container 49 is fluidly connected to the dust transfer tube 43. The secondary dust container 49 separates, collects, and accumulates the dust from the dust-containing air flowing from dust transfer tube 43, and sends the clean air from which the dust has been removed to the secondary electric blower 50. The secondary dust container 49 is detachably mounted on the left side (i.e., right side as viewed from the front) of the dust collection part 42 and exposed to the appearance of the station 2.

The secondary electric blower 49 sucks in air from the secondary dust container 49 so as to generate negative pressure (i.e., suction vacuum pressure), and transfers the dust from the primary dust container 13 to the secondary dust container 49. In other words, the secondary electric blower 50 applies negative pressure to the primary dust container 13 through the secondary dust container 49 and transfers the dust from the primary dust container 13 to the secondary dust container 49. The secondary electric blower 50 is accommodated in the right side (i.e., left part as viewed from the front) of the dust collection part 42.

The station controller 51 includes a microprocessor (not shown), and a storage device (not shown) for storing, for example, parameters and various operation programs to be executed with the microprocessor. The station controller 51 executes drivability control of the secondary electric blower 50 and charge control of the rechargeable battery 17 of the electric vacuum cleaner 3.

The dust transfer tube 43 is connected to the primary dust container 13 in the storage configuration of the electric vacuum cleaning apparatus 1. The dust transfer tube 43 is an air passage for transferring the dust collected with the electric vacuum cleaner 3 to the secondary dust container 49. When the electric vacuum cleaner 3 is connected to the station 2, the dust transfer tube 43 is connected to the primary dust container 13 and fluidly connects the primary dust container 13 to the secondary dust container 49.

The dust transfer tube 43 is connected to the suction side of the secondary dust container 49. The negative pressure to be generated with the secondary electric blower 50 acts on the dust transfer tube 43 through the secondary dust container 49.

The dust transfer tube 43 includes an inlet connected to the primary dust container 13 of the electric vacuum cleaner 3 and an outlet connected to the secondary dust container 49. The dust transfer tube 43 extends rearward from the inlet disposed at the platform 41 so as to reach the inside of the dust collection part 42, and bends and extends upward inside the dust collection part 42 so as to reach the outlet disposed at the side of the secondary dust container 49.

The charging terminals 46 and the inlet of the dust transfer tube 43 are provided on the platform 41 side by side.

The hose attachment 53 is provided on the right lateral face (the left lateral face as viewed from the front) of the dust collection part 42. The hose attachment 53 has a shape that conforms to the holding projection 27*a* of the extension tube 27 and can be hooked or fitted so as to be connected to the holding projection 27*a*. The hose attachment 53 holds the extension tube 27 in an upright state via the holding projection 27*a*. The tubular part 8 is stored when the holding projection 27*a* is connected to the hose attachment 53.

The hose attachment 53 may be provided in the cleaner body 7 of the electric vacuum cleaner 3. In this case, the cleaner body 7 holds the extension tube 27 upright via the holding projection 27*a*. The tubular part 8 is stored when the holding projection 27*a* is connected to the hose attachment 53.

The plurality of attaching detectors 45 include, for example, a first attaching detector 45*a* provided on the platform 41 and a second attaching detector 45*b* provided on the hose attachment 53. The first attaching detector 45*a* detects that the cleaner body 7 is connected to (i.e., attached to) the station 2 or the cleaner body 7 is placed on the platform 41. The second attaching detector 45*b* detects that the tubular part 8 of the electric vacuum cleaner 3 is attached to the station 2. When the hose attachment 53 is provided on the cleaner body 7, the second attaching detector 45*b* detects that the tubular part 8 of the electric vacuum cleaner 3 is attached to the cleaner body 7. Each of the attaching detectors 45 is a so-called micro switch. That is, when the cleaner body 7 is connected to the station 2, the first attaching detector 45*a* is pushed into the cleaner body 7 to detect this. When the tubular part 8 of the electric vacuum cleaner 3 is attached to the station 2 or the cleaner body 7, the second attaching detector 45*b* is pushed into the tubular part 8 so as to detect this.

When the electric vacuum cleaner 3 is connected to (i.e., attached to or placed on) the station 2, the charging electrodes 19 of the electric vacuum cleaner 3 are electrically connected to the charging terminals 46 of the station 2 and the dust transfer tube 43 of the station 2 is connected to the primary dust container 13. And then, the station 2 starts charging the rechargeable battery 17 of the electric vacuum cleaner 3. Additionally, the station 2 starts the secondary electric blower 50 in a timely manner. The secondary electric blower 50 having been started up sucks in air from the secondary dust container 49 and brings the inside of the secondary dust container 49 into a negative pressure state.

The negative pressure in the secondary dust container 49 acts on the primary dust container 13 through the dust transfer tube 43. The station 2 sucks in the dust accumulated in the primary dust container 13 together with air by using the negative pressure acting on the primary dust container 13. The secondary dust container 49 separates, collects, and accumulates the dust from the sucked air, and sends the dust-separated air to the secondary electric blower 50. The secondary electric blower 50 discharges the clean air sucked from the secondary dust container 49 to the outside of the station 2.

The electric vacuum cleaning apparatus 1 may be configured such that it connects the primary electric blower 15 of the electric vacuum cleaner 3 to the secondary dust container 49 of the station 2 by mechanically switching the air passage connecting the primary electric blower 15 to the primary dust container 13 of the electric vacuum cleaner 3, and transfers the dust from the primary dust container 13 of the electric vacuum cleaner 3 to the secondary dust container 49 of the station 2 by operating the primary electric blower 15. In this case, the timing of switching the air passage connecting the primary electric blower 15 and the primary dust container 13 of the electric vacuum cleaner 3 to the air passage connecting the secondary dust container 49 of the station 2 to the primary electric blower 15 of the electric vacuum cleaner 3 is preferred to be immediately prior to operation of the primary electric blower 15 for transferring dust. Preferably, the timing of switching the air passage connecting the secondary dust container 49 of the station 2 to the primary electric blower 15 of the electric vacuum cleaner 3 to the air passage connecting the primary electric blower 15 and the primary dust container 13 of the electric vacuum cleaner 3 is immediately after the operation of the primary electric blower 15 for transferring dust.

Next, the cleaner body 7 of the electric vacuum cleaner 3 according to the present embodiment will be described in detail.

Figure 3:
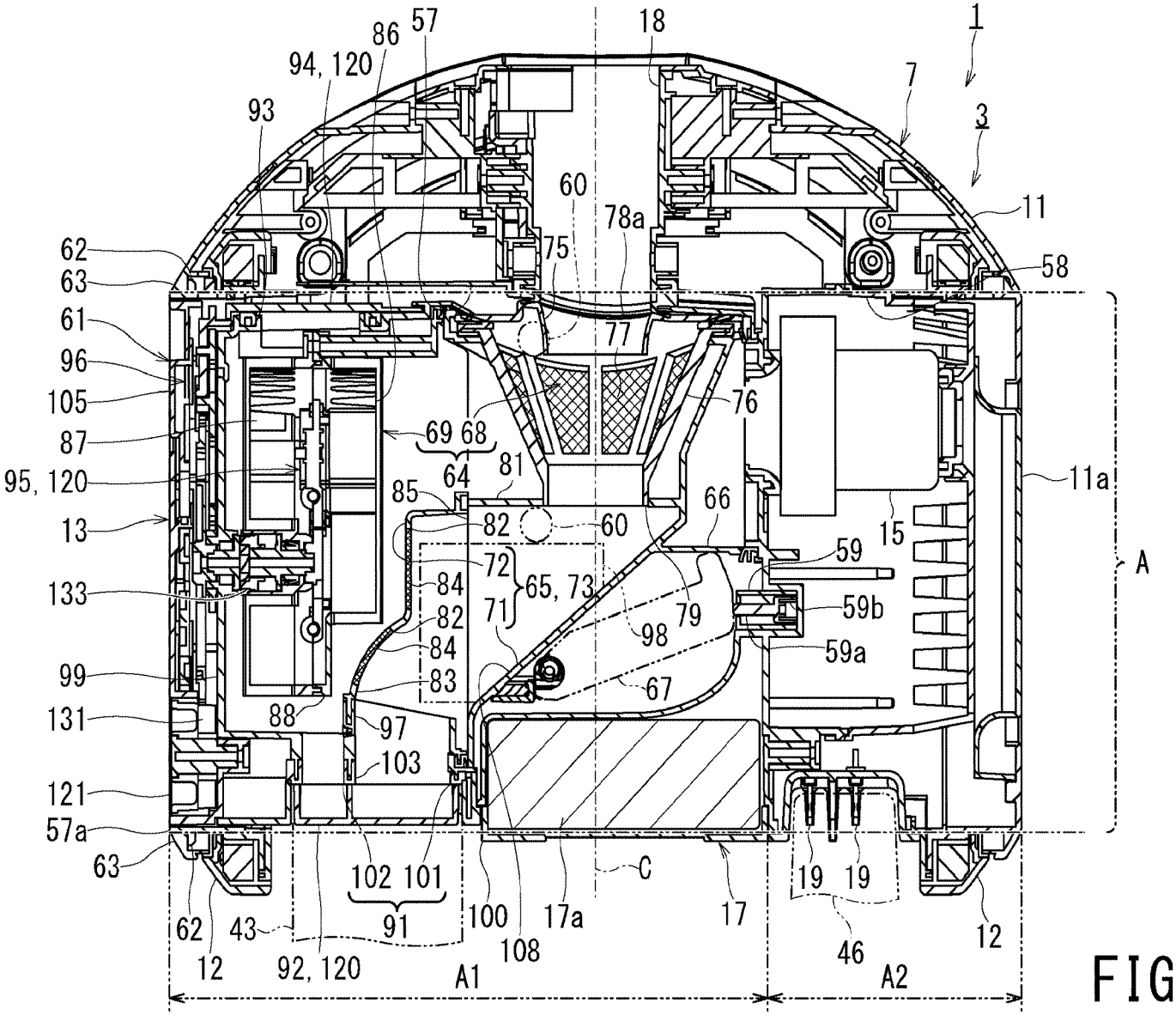
FIG. 3 is a cross-sectional plan view of a cleaner body of the electric vacuum cleaning apparatus according to the embodiment of the present invention.

FIG. 3 is a cross-sectional plan view of the cleaner body of the electric vacuum cleaning apparatus according to the embodiment of the present invention.

Figure 4:
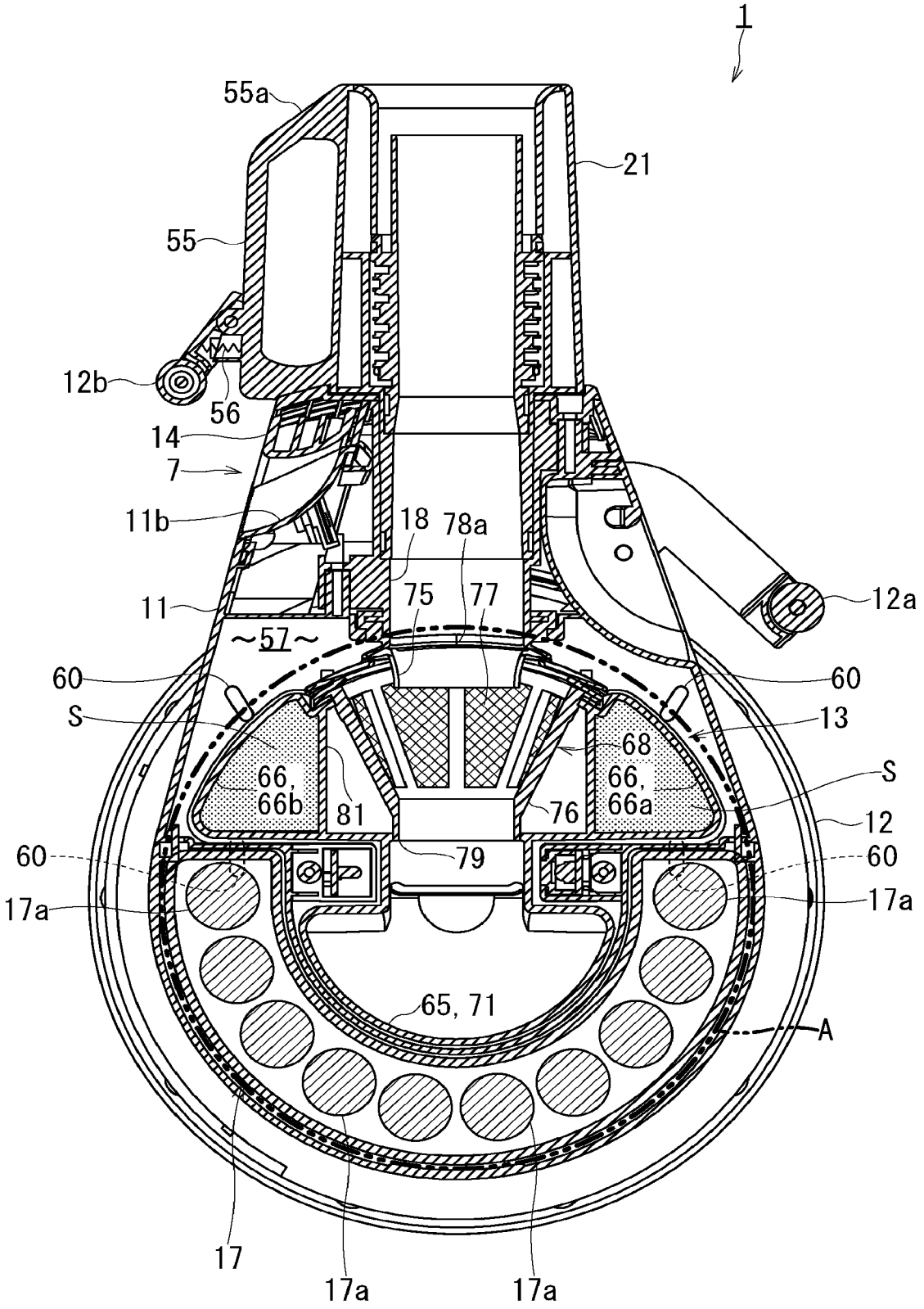
FIG. 4 is a longitudinal cross-sectional view of the cleaner body of the electric vacuum cleaning apparatus according to the embodiment of the present invention.

FIG. 4 is a longitudinal cross-sectional view of the cleaner body of the electric vacuum cleaning apparatus according to the embodiment of the present invention.

The plane cross-section of the cleaner body 7 shown in FIG. 3 corresponds to a cross-section of a plane that is substantially parallel to the front of the electric vacuum cleaning apparatus 1 in the storage configuration. FIG. 3 shows the state in which the connecting tube 21 of the tubular part 8 is detached from the cleaner body 7. FIG. 4 shows the state in which the connecting tube 21 is attached to the cleaner body 7.

As shown in FIG. 3 and FIG. 4, the cleaner body 7 of the electric vacuum cleaning apparatus 1 according to the embodiment of the present invention includes the body housing 11 composed of a cylindrical rear half laid in the width direction of the body housing 11, and a front half that bulges forward in an arc from the cylindrical rear half in a plan view of the cleaner body 7. The back face of the body housing 11 has an arc shape in a side view of the cleaner body 7.

The connection port 18 extends along a line (hereinafter referred to as the centerline C) that passes through the substantial center in the width direction of the body housing 11 and the substantial center in the height direction of the body housing 11, and the connection port 18 reaches the primary dust container 13. FIG. 3 and FIG. 4 are cross-sectional views passing through the centerline C.

The connecting tube 21 to be connected to the connection port 18 is provided with a handle 55. The handle 55 is disposed above the center of gravity of the cleaner body 7 in the storage position of the electric vacuum cleaner (FIG. 1). The handle 55 has an inclined portion 55*a* on the front side in the traveling direction of the electric vacuum cleaner 3. The forward in the traveling direction of the electric vacuum cleaner 3 corresponds to the upper side of the cleaner body 7 in the storage position and also corresponds to the front side of the cleaner body 7 in the use position. The handle 55 is disposed on the opposite side (back side) of the cleaner body 7 as viewed from the side of the body handle 14. In other words, the body handle 14 is disposed on the opposite side (obverse side) of the cleaner body 7 as viewed from the side of the handle 55.

The respective wheels 12 are disposed at the right and left ends of the cylindrical rear half of the body housing 11. In addition, the respective wheels 12 are concentrically arranged in the cylindrical rear half of the body housing 11. The diameter of each wheel 12 is larger than the vertical dimension of the body housing 11, i.e., larger than the height (corresponding to the diameter of the cylindrical rear half) of the body housing 11. In a side view of the cleaner body 7, i.e., when viewed in the rotation centerline direction of the wheels 12, the wheels 12 hide the back face of the body housing 11. Thus, even when the upper and lower sides (obverse and reverse) of the body housing 11 are inverted, the cleaner body 7 can cause the wheels 12 to be grounded onto the surface to be cleaned and can maintain this state. Similarly, even in the process of inverting the upper and lower sides of the body housing 11, the cleaner body 7 can cause the wheels 12 to be grounded onto the surface to be cleaned and can maintain this state. The body housing 11 can invert the upper and lower sides (i.e., obverse and reverse) of the body housing 11 around the rotation centerline of the wheels 12 without causing the back face to interfere with the surface to be cleaned. The cleaner body 7 is provided with an auxiliary wheel 12*a* for supporting the cleaner body 7 when the obverse of which faces upward, together with the wheels 12. The connecting tube 21 is provided with an auxiliary wheel 12*b* for supporting the cleaner body 7 when the reverse of which faces upward, together with the wheels 12.

The auxiliary wheel 12*b* is provided on the handle 55. Between the auxiliary wheel 12*b* and the handle 55, a suspension mechanism 56 for absorbing shock is provided.

The distinction between the upper and lower sides (i.e., obverse and reverse) of the cleaner body 7 is for the convenience of description. The electric vacuum cleaner 3 can be used for cleaning in the same manner regardless of whether the obverse is directed upward or the reverse is directed upward. Since the cleaner body 7 can invert the upper and lower sides (i.e., obverse and reverse) of the body housing 11 around the rotation centerline of the wheels 12, it is difficult for the cleaner body 7 to be substantially self-supporting in the storage position with its front directed upward.

Hereinafter, the use position in which the side provided with the handle 55 is directed toward the surface to be cleaned is defined as a first use position. The use position in which the other side as viewed from the handle 55 is directed toward the surface to be cleaned (i.e., the use position that the body handle 14 is directed toward the surface to be cleaned) is defined as a second use position. The pair of wheels 12 support the cleaner body 7 on the surface to be cleaned regardless of whether the cleaner body 7 is in the first use position or in the second use position. In other words, in whichever direction around the rotation centerline of the wheels 12 the cleaner body 7 is laid down, the pair of wheels 12 support the cleaner body 7 such that the cleaner body 7 can travel.

The rechargeable battery 17 is disposed on the opposite of the connection port 18 with the rotation centerline of the wheels 12 interposed between the rechargeable battery 17 and the connection port 18, i.e., the rechargeable battery 17 is disposed at the central portion of the rear end of the body housing 11. The rechargeable battery 17 is accommodated in the cylindrical rear half of the body housing 11. The rechargeable battery 17 is disposed so as to conform to the shape of the body housing 11. The rechargeable battery 17 includes cylindrical unit cells 17*a* that are arranged along the inner face of the cylindrical rear half.

The rechargeable battery 17 has an arc shape substantially centered on the rotation centerline of the pair of wheels 12. The center of the arc shape of the rechargeable battery 17 is located at the central portion in the direction orthogonal to the centerline C of the body housing 11 in a plane orthogonal to the rotation centerline of the pair of wheels 12 (i.e., located at the central portion of the dimension in the height direction of body housing 11), specifically, the center of the arc shape of the rechargeable battery 17 is located at the substantially half position of it.

The centerline of the cylindrical rear half of the body housing 11 and the rotation centerline of the wheels 12 are substantially on the same line. The inside of the cylindrical rear half of the body housing 11 centered on this line is defined as a region A. The wheels 12 are disposed so as to avoid the region A. That is, each wheel 12 has an annular shape that has an inner diameter larger than that of the region A. Further, the pair of wheels 12 are disposed such that the region A is interposed between both wheels 12.

The primary dust container 13 and the primary electric blower 15 are disposed in the region A and arranged in the width direction of the body housing 11. The primary dust container 13 is disposed in a region A1 that reaches one of the wheels 12 (for example, the right wheel 12 when the cleaner body 7 is connected to the station 2) from the central portion of the region A. The primary electric blower 15 is disposed in a region A2 that is biased to the other wheel 12 (for example, the left wheel 12 when the cleaner body 7 is connected to the station 2) in the region A.

The rechargeable battery 17 is also disposed in the region A.

The body housing 11 includes: a dust container chamber 57 for detachably accommodating the primary dust container 13; and an electric blower chamber 58 for accommodating the primary electric blower 15. The dust container chamber 57 occupies the region A1. The electric blower chamber 58 occupies the region A2.

The primary electric blower 15 is accommodated in the electric blower chamber 58. The suction port of the primary electric blower 15 is directed to the dust container chamber 57.

The dust container chamber 57 partitions a cylindrical dust-container disposition space that conforms to the shape of the primary dust container 13. That is, the wall surface of the body housing 11 partitioning the dust container chamber 57 is a wall surface surrounding the dust-container disposition space. The dust container chamber 57 is open toward the side of the body housing 11. In other words, the dust container chamber 57 is provided with a dust-container insertion and extraction port 57*a* disposed on the lateral face of the body housing 11. The opening diameter of the dust-container insertion and extraction port 57*a* is smaller than the inner diameter of each annular wheel 12. The dust-container insertion and extraction port 57*a* is disposed inside the annular wheels 12 in a side view of the cleaner body 7.

The dust container chamber 57 may have an appropriate opening for exposing the primary dust container 13. The dust container chamber 57 is not limited to the one that accommodates the entire primary dust container 13 but may be configured to accommodate part of the primary dust container 13. That is, the dust-container disposition space may communicate with the outside of the body housing 11 through an opening other than the dust-container insertion and extraction port 57*a*. It is not necessarily required that the dust-container insertion and extraction port 57 is connected to the end face of the primary dust container 13.

The primary dust container 13 has a cylindrical appearance with an outer diameter smaller than the inner diameter of each wheel 12. The primary dust container 13 can be accommodated in the dust container chamber 57 and can be inserted into and extracted from the dust container chamber 57. The primary dust container 13 is inserted into and extracted from the dust container chamber 57 through the dust-container insertion and extraction port 57*a*. That is, the primary dust container 13 is inserted and extracted in the width direction of the cleaner body 7. As a result, the primary dust container 13 is attached to and detached from the cleaner body 7.

The handle 55 extends in the front-rear direction of the cleaner body 7 and has a thickness and length whereby a user can grip the handle 55. The handle 55 extends substantially parallel to the centerline of the connection port 18 or the centerline C of the cleaner body 7.

The dust container chamber 57 is provided with: an extrusion force generator 59 that generates a force for pushing out the primary dust container 13 accommodated in the dust container chamber 57 to the outside of the dust container chamber 57; and auxiliary rollers 60 that guides movement of the primary dust container 13 accommodated in the dust container chamber 57.

The extrusion force generator 59 generates a force that pushes the primary dust container 13 disposed in the dust-container disposition space partitioned in the dust container chamber 57 out of the dust-container disposition space. The extrusion force generator 59 is a so-called push rod. The extrusion force generator 59 includes: a rod 59*a* in contact with the primary dust container 13; and a coil spring 59*b* that exerts a force on the rod portion 59*a* to push the primary dust container 13 out of the dust container chamber 57. The extrusion force generator 59 may be provided in the primary dust container 13.

The auxiliary rollers 60 are in contact with respective appropriate places on the outer face of the primary dust container 13 and assist in the movement of the primary dust container 13 to be inserted into and removed from the body housing 11. The auxiliary rollers 60 are provided so as to partially sandwich the primary dust container 13. The auxiliary rollers 60 may be provided in the primary dust container 13. In this case, the respective auxiliary rollers 60 are in contact with the appropriate places of the wall of the dust container chamber 57 and assist in the movement of the primary dust container 13 to be inserted into and removed from the body housing 11.

Figure 5:
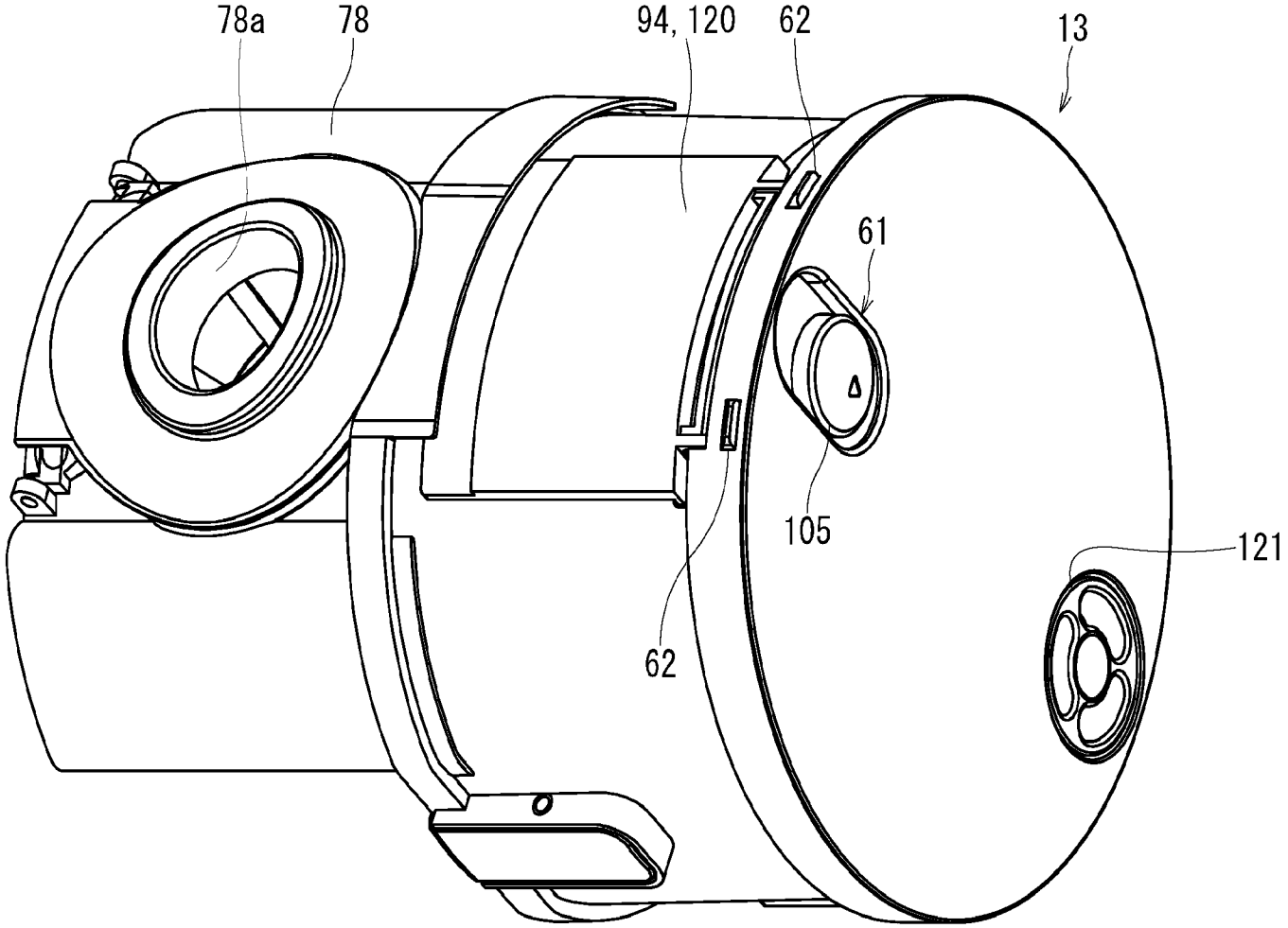
FIG. 5 is a perspective view of a primary dust container of the electric vacuum cleaner according to the embodiment of the present invention.
Figure 6:
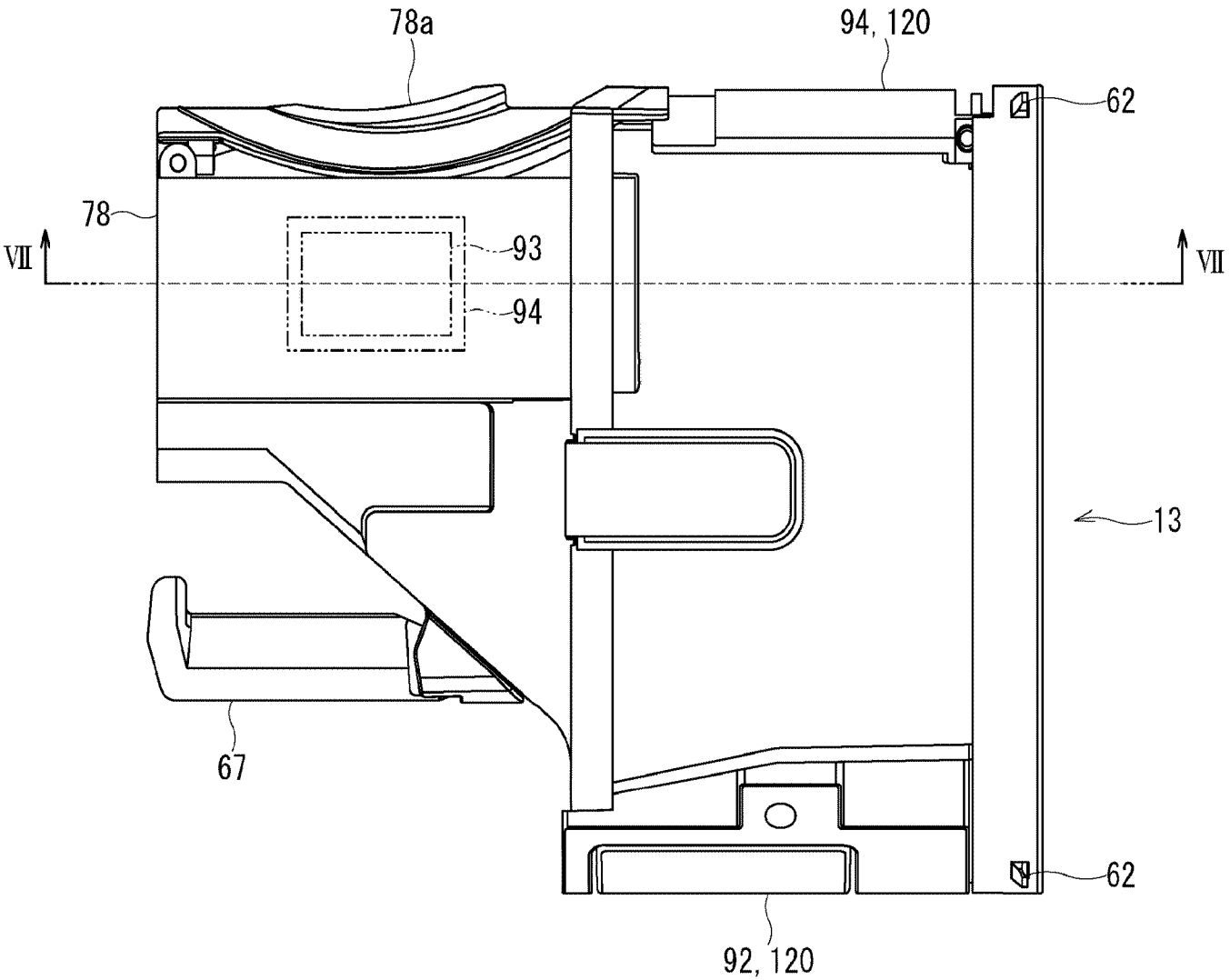
FIG. 6 is a side view of the primary dust container of the electric vacuum cleaner according to the embodiment of the present invention.

The auxiliary rollers 60 are rotatably mounted inside the body housing 11, i.e., inside the dust container chamber 57. The plurality of auxiliary rollers 60 include a plurality of pairs facing each other across the primary dust container 13 in the moving direction of the primary dust container 13, i.e., in the direction intersecting with the insertion and removal direction toward the dust container chamber 57. The primary dust container 13 is guided with the auxiliary rollers 60 and smoothly moved in and out of the cleaner body 7. In other words, the primary dust container 13 is smoothly inserted into and removed from the dust container chamber 57. The primary dust container 13 is roughly cylindrical (FIG. 5 and FIG. 6). The plurality of auxiliary rollers 60 include pairs, each of which consists of two auxiliary rollers 60 facing each other in the radial direction of the primary dust container 13. Thus, when the primary dust container 13 is removed from the cleaner body 7, the primary dust container 13 inclined with respect to the insertion and extraction direction and caught in the dust container chamber 57 can be prevented.

In detail, the primary dust container 13 has a portion made by partially notching the cylindrical shape. The auxiliary rollers 60 may be provided so as to sandwich the notch-shaped portion of the primary dust container 13. The auxiliary rollers 60 according to the present embodiment are provided at positions sandwiching the walls that partition the air passages 66*a* and 66*b*.

The electric vacuum cleaner 3 includes a container lock mechanism 61 for detachably fixing the primary dust container 13 accommodated in the dust container chamber 57. The container lock mechanism 61 includes: a plurality of claws 62 movable in a direction different from the moving direction of the primary dust container 13 that is pushed out by the extrusion force generator 59; and a plurality of claw-receivers 63 that interdigitate with the respective claws 62.

The claws 62 are provided in the primary dust container 13. The claw receivers 63 are provided in the body housing 11. Each of the claw receivers 63 is recessed. It may be configured such that the claws 62 are provided in the body housing 11 and the claw receivers 63 are provided in the primary dust container 13. In other words, it is sufficient that the claws 62 are provided in either one of the body housing 11 and the primary dust container 13, and the claw receivers 63 are provided in the other of the body housing 11 and the primary dust container 13.

Next, the primary dust container 13 will be described.

FIG. 5 is a perspective view of the primary dust container of the electric vacuum cleaner according to the embodiment of the present invention.

FIG. 6 is a side view of the primary dust container of the electric vacuum cleaner according to the embodiment of the present invention.

Figure 7:
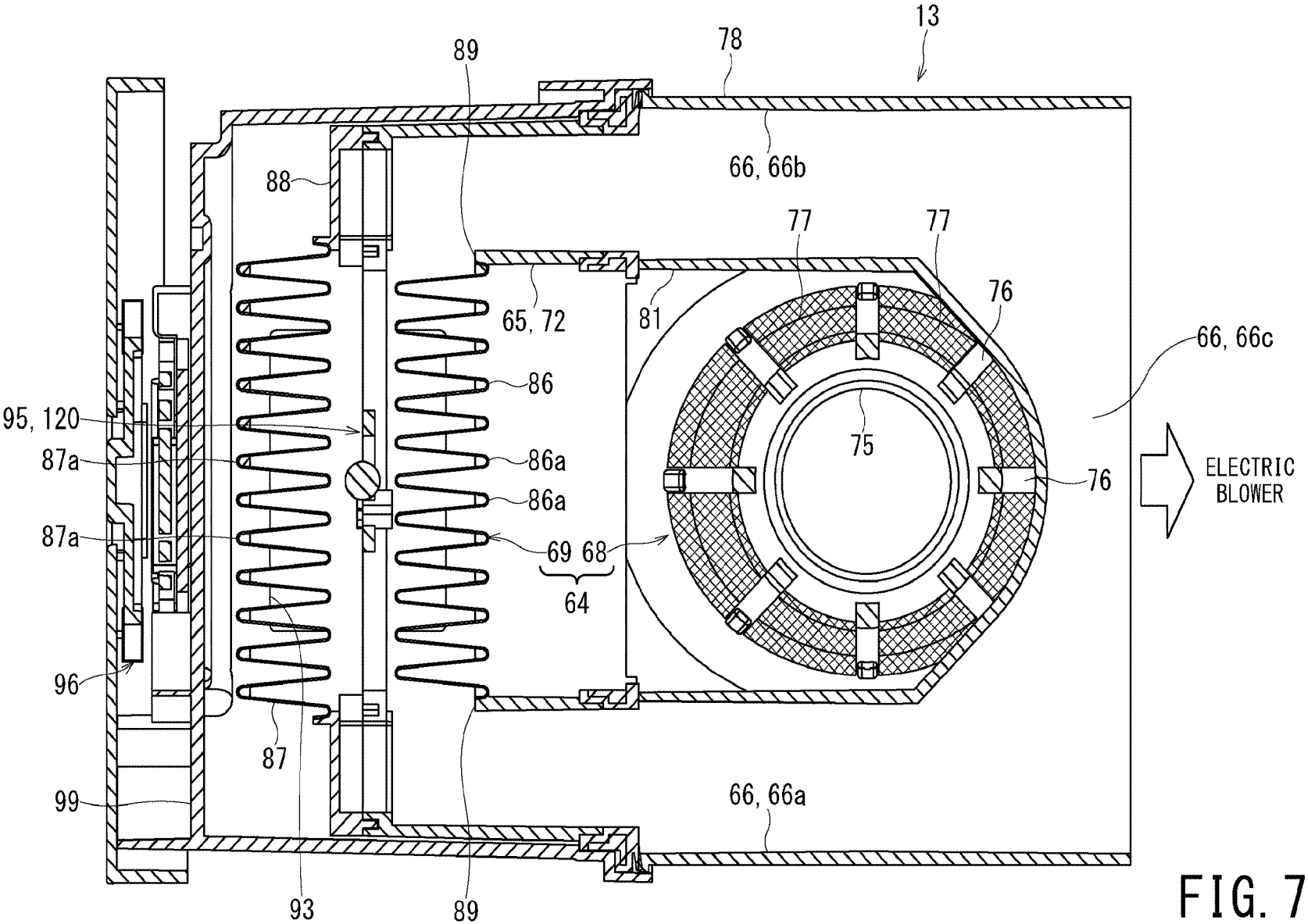
FIG. 7 is a cross-sectional view of the primary dust container of the electric vacuum cleaner according to the embodiment of the present invention.

FIG. 7 is a cross-sectional view of the primary dust container of the electric vacuum cleaner according to the embodiment of the present invention, taken along the line VII-VII of FIG. 6.

As shown in FIG. 5 to FIG. 7 in addition to FIG. 3 and FIG. 4, the primary dust container 13 of the electric vacuum cleaner 3 according to the present embodiment accumulates the dust to be sucked into the electric vacuum cleaner 3. The primary dust container 13 includes: a separation part 64 that separates the dust from dust-containing air to be sucked in by the negative pressure generated with the primary electric blower 15; a dust collection part 65 that accumulates the dust separated with the separation part 64; and at least one communication passage 66 that leads the air flowing out of the dust collection part 65 to the primary electric blower 15; and a leg 67.

The separation part 64 is connected to the connection port 18. The separation part 64 includes: a first separator 68 that separates relatively heavy dust from the dust-containing air by making the dust-containing air flow straight and using the difference between inertial force acting on the dust and inertial force acting on the air; and at least one filter 69 as a second separator that separates dust from the air, which contains relatively light dust after passing through the first separator 68.

The dust collection part 65 is provided side by side with the separation part 64 and the at least one communication passage 66. The dust collection part 65 includes a coarse-dust collecting chamber 71 for accumulating relatively heavy dust from the dust separated with the separation part 64, and a filter chamber 72 for accommodating the at least one filter 69.

The relatively heavy dust to be separated with the first separator 68 is called coarse dust. That is, the first separator 68 separates coarse dust from dust-containing air to be sucked into the electric vacuum cleaner 3. The coarse-dust collecting chamber 71 is the first dust collection chamber for accumulating coarse dust separated with the first separator 68. The relatively light dust to be separated with the at least one filter 69 is called fine dust. That is, the at least one filter 69 separates fine dust from the air that passes through the first separator 68. The filter chamber 72 is the second dust collection chamber that accumulates fine dust separated with the at least one filter 69. The coarse-dust collecting chamber 71 and the filter chamber 72 are collectively referred to as a dust collecting chamber 73.

The dust-containing air flowing from the connection port 18 to the primary dust container 13 is separated with the first separator 68 into coarse dust and the rest (i.e., air containing fine dust). The separated coarse dust is accumulated in the coarse-dust collecting chamber 71. The air containing fine dust separated with the first separator 68 flows into the filter chamber 72. The air flowing into the coarse-dust collecting chamber 71 also flows into the filter chamber 72. The air containing fine dust and having flowed into the filter chamber 72 is separated with the at least one filter 69 into fine dust and air. The separated fine dust is captured with the at least one filter 69 and accumulated in the filter chamber 72. The clean air having passed through the at least one filter 69 is sucked into the primary electric blower 15 through the at least one communication passage 66.

The first separator 68 includes: a nozzle 75 connected to the connection port 18; a primary filter frame 76 that includes the nozzle 75 inside and is in the shape of a truncated cone; and a first mesh filter 77.

The nozzle 75 extends from a suction port 78*a* of the container body 78, which corresponds to the outer shell of the primary dust container 13, into the inside of the container body 78.

The primary filter frame 76 is provided on the inner face of the container body 78. The primary filter frame 76 tapers and extends along the centerline of the connection port 18, i.e., substantially along the centerline C of the cleaner body 7, when the primary dust container 13 is attached to the body housing 11. The large-diameter bottom is in contact with the inner face of the container body 78, and the small-diameter bottom has a coarse-dust discharge port 79 connected to the coarse-dust collecting chamber 71 of the dust collection part 65. The diameter of the large-diameter bottom is larger than the opening diameter of the suction port 78*a*. The centerline of the coarse-dust discharge port 79 is substantially along the centerline of the suction port 78*a* and substantially along the centerline of the connection port 18. The coarse-dust discharge port 79 corresponds to the entrance of the dust collecting chamber 73.

The first mesh filter 77 is provided on the lateral face of the primary filter frame 76. The outside of the first mesh filter 77 is partitioned by a relay air-passage 81 connected to the filter chamber 72.

The pressure in the first separator 68 is decreased to negative pressure due to the flow of air to be sucked into the primary electric blower 15 through the first mesh filter 77 and the flow of air to be sucked into the primary electric blower 15 through the coarse-dust discharge port 79.

The coarse-dust collecting chamber 71 accumulates relatively heavy dust to be separated with the first separator 68. The coarse-dust collecting chamber 71 is part of the passage of the air to be sucked into the primary electric blower 15. The coarse-dust collecting chamber 71 is spatially connected to the coarse-dust discharge port 79 of the first separator 68. The coarse-dust collecting chamber 71 is also spatially connected to the filter chamber 72. The coarse-dust collecting chamber 71 is disposed on the centerline of the connection port 18, i.e., substantially on the centerline C of the cleaner body 7.

A partition wall 83 having a plurality of coarse-dust collecting chamber outlets 82 is provided between the coarse-dust collecting chamber 71 and the filter chamber 72 in which the at least one filter 69 is accommodated. The partition wall 83 is part of the wall of the dust collecting chamber 73. That is, the partition wall 83 partitions the coarse-dust collecting chamber 71 and the filter chamber 72. A second mesh filter 84 is provided on the coarse-dust collecting chamber outlets 82 of the partition wall 83. The coarse-dust collecting chamber 71 is an upstream-side air passage that leads dust-containing air to the second mesh filter 84.

The coarse-dust collecting chamber 71 is expanded in the direction away from the primary electric blower 15, i.e., in the direction approaching the at least one filter 69. That is, the coarse-dust collecting chamber 71 has an expanded portion 85 in the vicinity of the second mesh filter 84, and the cross-sectional area of the air passage of the expanded portion 85 is rapidly expanded. The partition wall 83 having the coarse-dust collecting chamber outlets 82 is disposed between the expanded portion 85 and the filter chamber 72.

The second mesh filter 84 filters and separates the dust from the air that is to be sucked into the coarse-dust collecting chamber 71 by negative pressure and contains coarse dust. The second mesh filter 84 prevents coarse dust from flowing out from the coarse-dust collecting chamber 71 into the filter chamber 72. The second mesh filter 84 compresses the dust accumulated in the coarse-dust collecting chamber 71 by the flow of air passing through it. The second mesh filter 84 has substantially the same mesh as the first mesh filter 77. When the fine dust flows into the coarse-dust collecting chamber 71 without being separated with the first separator 68, the fine dust passes through the second mesh filter 84 so as to flow into the filter chamber 72 or is captured with the coarse dust that is compressed like a filter inside the coarse-dust collecting chamber 71.

The at least one filter 69 filters and separates dust, particularly the fine dust having passed through the first separator 68, from the dust-containing air to be sucked in by the negative pressure generated with the primary electric blower 15. The at least one filter 69 includes a pair of filters 86 and 87 facing each other and a secondary filter frame 88 that maintains the shape of the pair of filters 86 and 87 so as to support the filters 86 and 87.

Downstream faces of the respective filters 86 and 87 face each other. Each of the filters 86 and 87 filters and separates the dust from the dust-containing air to be drawn into the primary dust container 13. The mesh of each of the filters 86 and 87 is finer than the first mesh filter 77 of the first separator 68 and the second mesh filter 84 of the coarse-dust collecting chamber 71. The filters 86 and 87 are, for example, non-woven fabrics. The dust to be captured with the filters 86 and 87 contains the dust that can pass through the first mesh filter 77 and the second mesh filter 84.

One of the filters 86 and 87 (filter 86) is directly exposed to the air flowing into the filter chamber 72, and the other of the filters 86 and 87 (filter 87) is exposed to the air that has run around one of the filters 86 and 87 (filter 86). That is, the filter 86 faces the relay air-passage 81 connecting the first separator 68 to the at least one filter 69, and faces the coarse-dust collecting chamber outlets 82 connecting the coarse-dust collecting chamber 71 to the filter chamber 72. The filter 87 is hidden with the filter 86 and disposed at the position where the filter 87 cannot be seen from the relay air-passage 81 and the coarse-dust collecting chamber outlets 82.

The pair of filters 86 and 87 are pleated filters having folds (ridge lines 86*a* and 87*a*) which are substantially the same as each other in size (spacing) and in depth.

The filter 86 facing the relay air-passage 81 and the coarse-dust collecting chamber outlets 82 may have a wider and shallower fold as compared with the filter 87. Since the filter 86 faces the relay air-passage 81 and the coarse-dust collecting chamber outlets 82, the fine dust (i.e., the dust passing through the first separator 68 and the dust flowing out of the coarse-dust collecting chamber 71) first blows on the filter 86. Then, the filter 86 captures the fine dust and causes clogging gradually. As the filter 86 is clogged, the fine dust blowing from the relay air-passage 81 and the coarse-dust collecting chamber outlets 82 to the filter 86 is circulated to the filter 87. Subsequently, clogging of the filter 87 also starts. That is, the filter 86 is more likely to be clogged than the filter 87. In other words, dust is more readily attached to the filter 86 as compared with the filter 87. Thus, the dust can be readily removed from the filter 86, to which dust is more likely to be attached, by making the fold of the filter 86 wider and shallower than the filter 87.

The filters 86 and 87 may have a film of polytetrafluoroethylene (PTFE, so-called Teflon (registered trademark)) on the upstream face so that the attached dust can be readily removed. Additionally, only the filter 86, which is more readily clogged than the filter 87, may have a polytetrafluoroethylene film on the upstream face.

The filters 86 and 87 have ridge lines (folds) 86*a* and 87*a* extending in the up-and-down direction (i.e., vertical direction) in the storage configuration of the electric vacuum cleaning apparatus 1. In other words, the ridge lines 86*a* and 87*a* of the filters 86 and 87 extend in the front-rear direction of the cleaner body 7. Each of the filters 86 and 87 is open at the end face intersecting the fold.

The open end face of each filters 86 and 87 may be a zigzag shape having mountains and valleys along the end face shape of each filters 86 and 87 or may be a surface in which a plate-shaped frame having ventilating holes (not shown) are interposed between adjacent mountain folds.

The secondary filter frame 88 supports the pair of filters 86 and 87 such that the pair of filters 86 and 87 face each other and are spaced apart. The space partitioned with the secondary filter frame 88 and the pair of filters 86 and 87 corresponds to the air passage on the downstream of the at least one filter 69. The inside space of this filter 69 communicates with the at least one communication passage 66. The secondary filter frame 88 has secondary filter outlets 89 that are located on both sides of the filter 86 and connected to the communication passage 66. The secondary filter outlets 89 cause the air having passed through the filters 86 and 87 to flow out to the at least one communication passage 66.

The filter chamber 72 is adjacent to the coarse-dust collecting chamber 71. The filter chamber 72 functions as a fine-dust collecting chamber that accumulates the fine dust to be captured on the at least one filter 69 by filtration separation. The fine dust passing through the first mesh filter 77 and the second mesh filter 84 is captured with the pair of finer mesh filters 86 and 87, and then is accumulated in the filter chamber 72. That is, the dust collecting chamber 73 (i.e., the coarse-dust collecting chamber 71 and the filter chamber 72) is disposed on the upstream of the filters 86 and 87.

The filter chamber 72 is part of the passage of the air to be sucked into the primary electric blower 15. The filter chamber 72 communicates with the relay air-passage 81. The filter chamber 72 also communicates with the coarse-dust collecting chamber 71.

The at least one communication passage 66 includes air passages 66*a* and 66*b* for leading the air flowing out of the separation part 64 and the dust collection part 65 to the primary electric blower 15. In other words, the at least one communication passage 66 branches into a plurality of passages so as to reach the primary electric blower 15. For example, the at least one communication passage 66 is divided into two air passages 66*a* and 66*b*. A plurality of, for example, two air passages 66*a* and 66*b* sandwich the suction port 78*a* for introducing air to the separation part 64. The cross-sectional area S of the air passage 66*a* is substantially equal to the cross-sectional area S of the air passage 66*b*. The two air passages 66*a* and 66*b* have a plane-symmetrical shape with respect to the plane including the rotation centerline of the fan of the primary electric blower 15. In other words, the air passages 66*a* and 66*b* are spaced apart from each other and are disposed so as to be closer to the respective edges of the at least one filter 69, the first mesh filter 77, and the second mesh filter 84 than the respective centers of the at least one filter 69, the first mesh filter 77, and the second mesh filter 84. The two air passages 66*a* and 66*b* gather and merge at the end of the communication passage 66 connected to the primary electric blower 15. In other words, the two air passages 66*a* and 66*b* are connected to the primary electric blower 15 through a collective air passage 66*c* of the at least one communication passage 66. The at least one communication passage 66 may be branched into three or more. In other words, the at least one communication passage 66 is a plurality of downstream air passages that lead the air passing through the first mesh filter 77, the second mesh filter 84, and the at least one filter 69 to the primary electric blower 15.

Among the dust-containing air flowing from the nozzle 75 to the first separator 68, the coarse dust of relatively large mass flows straight from the nozzle 75 to the coarse-dust discharge port 79 by inertia force and then is sent to the coarse-dust collecting chamber 71. The dust (coarse dust) flowing from the coarse-dust discharge port 79 into the coarse-dust collecting chamber 71 is accumulated in the coarse-dust collecting chamber 71. The air and dust of relatively small mass included in the dust-containing air flowing from the nozzle 75 to the first separator 68 expand radially from the nozzle 75, pass through the first mesh filter 77 provided on the lateral face of the primary filter frame 76, and flow into the filter chamber 72 through the relay air-passage 81. Along with the dust (coarse dust) flowing from the coarse-dust discharge port 79 into the coarse-dust collecting chamber 71, part of the air also flows into the coarse-dust collecting chamber 71. The air having flowed into the coarse-dust collecting chamber 71 passes through the second mesh filter 84 and flows into the filter chamber 72. The fine dust contained in the air flowing into the filter chamber 72 after passing through the first mesh filter 77 or the second mesh filter 84 is filtered and separated with the filter 69 so as to be captured on the surfaces of the pair of filters 86 and 87. The clean air passing through the filters 86 and 87 is drawn into the primary electric blower 15 through the communication passage 66. Subsequently, the clean air is temporarily divided into the plurality of air passages 66*a* and 66*b*, and then the clean air is gathered again and sucked into the primary electric blower 15.

The container body 78 partitions the dust collecting chamber 73, i.e., the coarse-dust collecting chamber 71 and the filter chamber 72. The communication passage 66 and the first separator 68 of the separation part 64 are disposed between the filter 69 and the primary electric blower 15 to be side by side with each other. In other words, the separation part 64, the communication passage 66, and the primary electric blower 15 are arranged in this order.

The pair of wheels 12 are disposed such that the primary electric blower 15, the separation part 64 (i.e., the first separator 68 and the filter 69), the dust collection part 65 (i.e., the coarse-dust collecting chamber 71 and the filter chamber 72), and the communication passage 66 is interposed between both wheels 12.

The first separator 68 is disposed at the central portion in the width direction of the body housing 11, the filter 69 is biased to one side (for example, the right side) of the body housing 11, and the primary electric blower 15 is biased to the other side (for example, the left side) of the body housing 11.

The primary dust container 13 includes: the container body 78 that partitions the dust collecting chamber 73 for accumulating the dust to be sucked into the electric vacuum cleaner 3 and is provided with a waste outlet 91 for discharging the dust accumulated in the dust collecting chamber 73; and a waste-outlet lid 92 that opens and closes the waste outlet 91.

The primary dust container 13 includes: a suction port 93 that introduces air directly from the outside of the air passage including the primary dust container 13 by the negative pressure to be generated with the secondary electric blower 50 of the station 2; and a suction-port lid 94 that opens and closes the suction port 93.

The primary dust container 13 further includes: a dust-removal mechanism 95 that removes the dust attached to the filter 69 (i.e., dust attached to the filters 86 and 87); and a power transmission mechanism 96 that interacts the dust-removal operation of the dust-removal mechanism 95 with the opening operation of the waste-outlet lid 92.

Furthermore, the primary dust container 13 includes a recess part 97 that is provided in the dust collecting chamber 73 and communicates with the waste outlet 91.

The primary dust container 13 may be provided with a dust compression mechanism 98 that compresses the dust accumulated in the primary dust container 13.

The container body 78 accommodates the separation part 64, i.e., the first separator 68 and the at least one filter 69. The container body 78 partitions the dust collecting chamber 73, i.e., the coarse-dust collecting chamber 71 and the filter chamber 72. Additionally, the container body 78 partitions a machine chamber 99 that accommodates the power transmission mechanism 96. The container body 78 is cylindrical as a whole. The container body 78 is attached to the region A1 such that the centerline of its cylindrical body is directed in the width direction of the body housing 11.

The waste outlet 91 and the suction port 93 are provided on the lateral face of the container body 78. The suction-port lid 94 and the waste-outlet lid 92 are opened and closed together. The waste outlet 91 is closed with the waste-outlet lid 92 except when the dust is transferred from the cleaner body 7 to the station 2. In other words, the waste-outlet lid 92 is opened only when the dust is transferred from the cleaner body 7 to the station 2, and the waste-outlet lid 92 closes the waste outlet 91 at other times. The suction port 93 is closed with the suction-port lid 94 except when the dust is transferred from the cleaner body 7 to the station 2. In other words, the suction-port lid 94 is opened only when the dust is transferred from the cleaner body 7 to the station 2, and the suction-port lid 94 closes the suction port 93 at other times.

The waste outlet 91 discharges the dust accumulated in the primary dust container 13 together with the air introduced from the suction port 93. The waste outlet 91 is disposed at the rear end of the body housing 11. The waste outlet 91 is disposed at the position where the station 2 and the cleaner body 7 are in contact with each other. That is, the waste outlet 91 is disposed on the back face of the body housing 11. The back face of the body housing 11 is located at the lower end of the body housing 11 in the storage configuration (FIG. 2) of the electric vacuum cleaning apparatus 1. The waste outlet 91 is disposed below the filter 69 in the storage configuration of the electric vacuum cleaning apparatus 1. In addition, the waste outlet 91 is opened downward of the filter 69 in the storage configuration of the electric vacuum cleaning apparatus 1.

A body-housing waste-outlet 100 larger than the waste outlet 91 is provided at the rear end of the body housing 11. The body-housing waste-outlet 100 allows the dust transfer tube 43 of the station 2 to pass through it in the storage configuration of the electric vacuum cleaning apparatus 1, and connects the inlet of the dust transfer tube 43 to the waste outlet 91.

The waste outlet 91 includes: a coarse-dust waste-outlet 101 that communicates with the coarse-dust collecting chamber 71; and a fine-dust waste-outlet 102 that communicates with the filter chamber 72. The coarse-dust waste-outlet 101 is the first waste port for discharging coarse dust from the coarse-dust collecting chamber 71. The fine-dust waste-outlet 102 is the second waste port for discharging fine dust from the filter chamber 72. The coarse-dust waste-outlet 101 and the fine-dust waste-outlet 102 are aligned in the width direction of the body housing 11, i.e., in the direction of the centerline of the container body 78. The coarse-dust waste-outlet 101 and the fine-dust waste-outlet 102 are open downward when the electric vacuum cleaner 3 is connected to station 2. The opening area of the fine-dust waste-outlet 102 is smaller than the opening area of the coarse-dust waste-outlet 101. In other words, the ratio of the opening area of the fine dust disposal port 102 to the opening area of the disposal port 91 is smaller than the ratio of the opening area of the coarse dust disposal port 101 to the opening area of the disposal port 91. The coarse-dust collecting chamber 71 and the filter chamber 72 share the partition wall 83 and are adjacent to each other.

The waste-outlet lid 92 and the suction-port lid 94 are part of the lateral face of the container body 78. The suction-port lid 94 is provided so as to be reciprocatable in the circumferential direction of the cylindrical container body 78. The waste-outlet lid 92 is supported by the container body 78 with a hinge mechanism (not shown). The waste-outlet lid 92 is an outward opening type that opens toward the outside of the primary dust container 13. The waste-outlet lid 92 opens and closes the coarse-dust waste-outlet 101 and the fine-dust waste-outlet 102 together. When the waste-outlet lid 92 is opened, both the coarse-dust waste-outlet 101 and the fine-dust waste-outlet 102 are connected to the dust transfer tube 43 together.

The opening width of the coarse-dust waste-outlet 101 is substantially equal to the opening width of the fine-dust waste-outlet 102 in the circumferential direction of the body housing 11 (i.e., in the direction intersecting the centerline direction of the container body 78), but is larger than the opening width of the fine-dust waste-outlet 102 in the width direction of the body housing 11 (i.e., in the centerline direction of the container body 78). Such an opening shape contributes to simplification of the shape of waste-outlet lid 92 that opens and closes the coarse-dust waste-outlet 101 and the fine-dust waste-outlet 102 together, and also contributes to simplification of the opening and closing mechanism of waste-outlet lid 92.

In addition, a packing 103 is appropriately provided in the waste outlet 91. The packing 103 is an integral molding. The packing 103 is sandwiched between the waste-outlet lid 92 and the container body 78, and seals both of the coarse-dust waste-outlet 101 and the fine-dust waste-outlet 102 together.

The recess part 97 is a concave portion defined by the container body 78, the partition wall 83, and the waste-outlet lid 92. In other words, each of the container body 78, the partition wall 83, and the waste-outlet lid 92 is part of the wall of the recess part 97. The recess part 97 accommodates the dust in the dust collecting chamber 73, specifically, the dust in the coarse-dust collecting chamber 71.

The suction port 93 is an inlet for introducing air into the filter chamber 72 from the outside of the cleaner body 7 or from the outside of the air passage that is inside the body housing 11 and is spatially connected to the primary electric blower 15. The suction port 93 is a suction inlet that generates an air flow when the dust is transferred from the cleaner body 7 to the station 2.

As viewed in the circumferential direction of the container body 78, the suction port 93 is disposed at the position farthest from the waste outlet 91, i.e., the position 180° away from the waste outlet 91. In detail, when the centerline of the container body 78 is used as a reference, the position of the suction port 93 is in line symmetry with the position of the waste outlet 91. That is, the suction port 93 is disposed above the filter 69 in the storage configuration (FIG. 1) of the electric vacuum cleaning apparatus 1. In other words, the filters 86 and 87 are disposed between the suction port 93 and the waste outlet 91.

In addition, the suction port 93 is disposed in the air passage on the upstream of the filters 86 and 87 (i.e., upstream of the flow to be generated with the primary electric blower 15).

The air introduced from the suction port 93 causes both of the fine dust filtered with the filters 86 and 87 and the coarse dust accumulated in the primary dust container 13 to flow out from the waste outlet 91 together. When the negative pressure acts on the filter chamber 72 from the dust transfer tube 43 through the fine-dust waste-outlet 102, the suction port 93 blows air on the filters 86 and 87. The air blown on the filters 86 and 87 blows off the dust captured on the respective surfaces of the filters 86 and 87 so as to lead the dust to the fine-dust waste-outlet 102 and discharges the fine dust (i.e., causes the fine dust to flow out) from the fine-dust waste-outlet 102. The filters 86 and 87 have the ridge lines 86*a* and 87*a* extending in the vertical direction at the time of dust removal, i.e., in the storage configuration of the electric vacuum cleaning apparatus 1, and the end face intersecting the fold is opened. Thus, the air blown on the filters 86 and 87 can readily flow along the fold, and the removed fine dust can be made to flow out smoothly from the end of the fold.

At this time, the negative pressure acts also on the coarse-dust collecting chamber 71 from the dust transfer tube 43 through the coarse-dust waste-outlet 101. Since the coarse-dust collecting chamber 71 directly communicates with the filter chamber 72 and indirectly communicates with the filter chamber 72 through the first separator 68, part of the air flowing in from the suction port 93 also flows into the coarse-dust collecting chamber 71. The air having flowed into the coarse-dust collecting chamber 71 causes the coarse dust accumulated in the coarse-dust collecting chamber 71 to flow out of (i.e., be discharged from) the coarse-dust waste-outlet 101.

The fine dust to be discharged from the primary dust container 13 through the fine-dust waste-outlet 102 and the coarse dust to be discharged from the primary dust container 13 through the coarse-dust waste-outlet 101 are transferred to the secondary dust container 49 through the dust transfer tube 43 of the station 2.

Although the suction port 93 according to the present embodiment is provided in the container body 78 of the primary dust container 13 and is disposed in the air passage on the upstream of the filters 86 and 87, the suction port 93 may be provided in the air passage on the downstream of the filters 86 and 87 (i.e., downstream of the flow to be generated with the primary electric blower 15) as shown by the suction port 93 and the suction-port lid 94 indicated by the dashed- and double dotted lines in FIG. 6. In this case, the suction port 93 communicates with the air passage, for example, communicates with the communication passage 66, from the filters 86 and 87 to the primary electric blower 15.

The container lock mechanism 61 is provided with an operation part 105 in the portion exposed to the outside of the cleaner body 7 when the primary dust container 13 is accommodated in the dust container chamber 57 of the cleaner body 7. The operation part 105 is an input unit for releasing the lock mechanism 61. The operation part 105 receives a force for separating (disconnecting) the claws 62 from the claw receivers 63.

The leg 67 is provided on the outer face of the dust guiding face 108 of the container body 78 extending from the coarse-dust discharge port 79 to the expanded portion 85 of the coarse-dust collecting chamber 71. The leg 67 swings between the storage position along the outer face of the dust guiding face 108 and the use position where the primary dust container 13 is made to stand alone without assistance. The leg 67 can also be used as a handle for the primary dust container 13.

The leg 67 receives the force to push the primary dust container 13, and this force is generated with the extrusion force generator 59 when the primary dust container 13 is accommodated in the dust container chamber 57. A torsion spring (not shown) is provided between the leg 67 and the primary dust container 13. The torsion spring generates a force to move the leg 67 to the use position when the primary dust container 13 is detached from the dust container chamber 57 and no external force acts on the leg 67.

In the process of accommodating the primary dust container 13 with the dust container chamber 57, the leg 67 is guided with the inner wall surface of the dust container chamber 57 to swing from the use position to the storage position. When the primary dust container 13 is accommodated in the dust container chamber 57, the rod 59*a* of the extrusion force generator 59 comes into contact with the tip of the leg 67 in the accommodation position and the extrusion force acts on the primary dust container 13.

When the container lock mechanism 61 is unlocked under the state where the primary dust container 13 is accommodated in the dust container chamber 57, the primary dust container 13 is pushed out of the dust container chamber 57 by the extrusion force of the extrusion force generator 59. And then, the leg 67 swings from the accommodation position to the use position while following the inner wall surface of the dust container chamber 57 by the spring force of the torsion spring. The leg 67 in the use position can support the primary dust container 13 removed from the cleaner body 7 in a self-supporting state (with the left end down as viewed in the direction in which numbers can be read in FIG. 6).

The rechargeable battery 17 surrounds the coarse-dust collecting chamber 71. That is, the unit cells 17*a* included in the rechargeable battery 17 are arranged along the inner face of the rear half of the cylindrical body housing 11 and surround the periphery of the coarse-dust collecting chamber 71.

The dust compression mechanism 98 is provided in the coarse-dust collecting chamber 71. The dust compression mechanism 98 compresses the coarse dust by, for example, sandwiching the coarse dust with any wall surface of the coarse-dust collecting chamber 71, and thereby reduces the volume of the coarse dust.

A description will now be given of the coarse dust collecting chamber 71 of the electric vacuum cleaner 3 according to the present embodiment.

Figure 8:
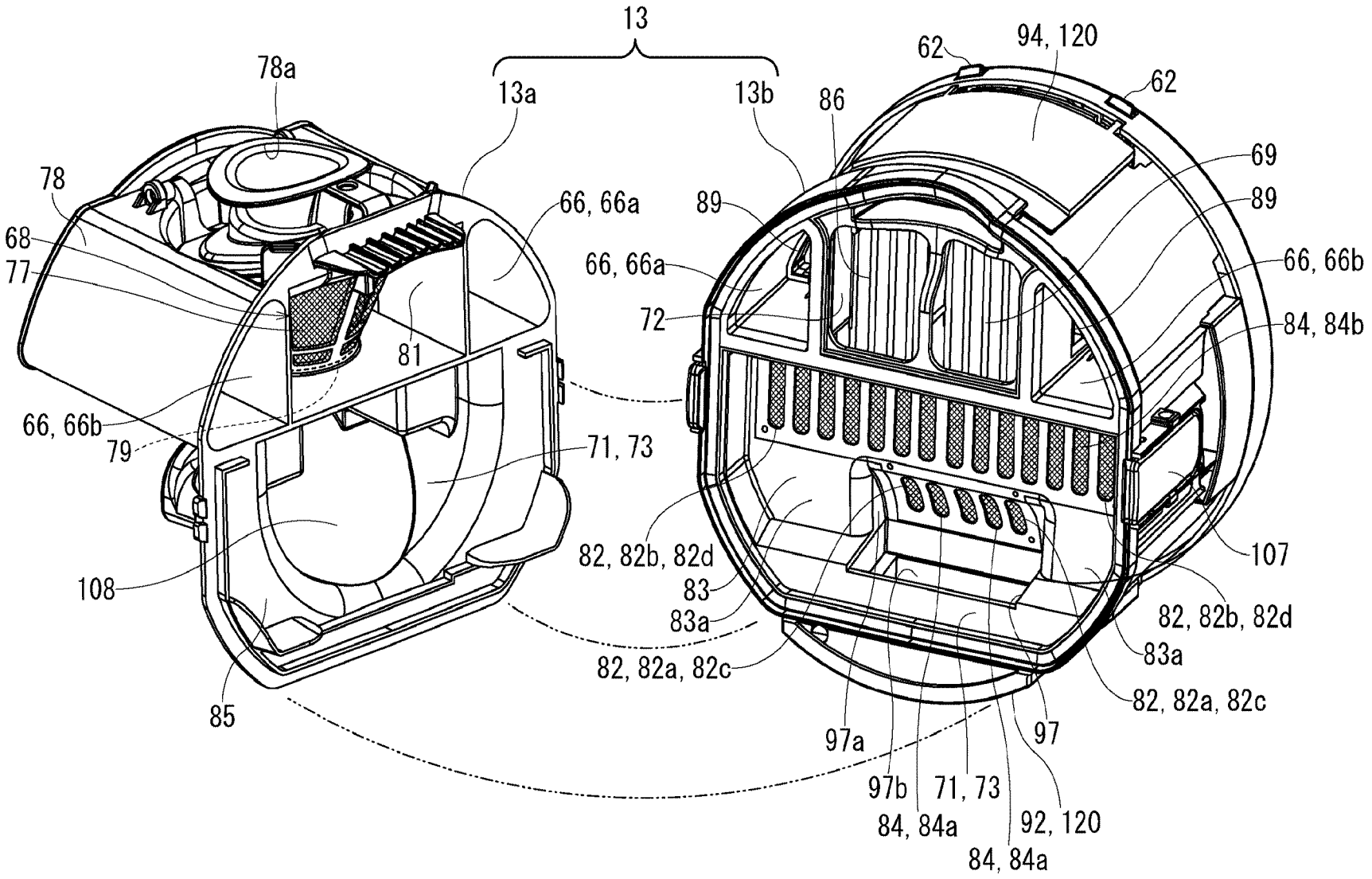
FIG. 8 is an exploded perspective view of the primary dust container of the electric vacuum cleaner according to the embodiment of the present invention.

FIG. 8 is an exploded perspective view of the primary dust container of the electric vacuum cleaner according to the embodiment of the present invention.

As shown in FIG. 8, the primary dust container 13 of the electric vacuum cleaner 3 according to the present embodiment includes: a first half 13*a* including the first separator 68; a second half 13*b* including the filter 69; and a lock mechanism 107 that fixes the first half 13*a* to the second half 13*b*.

As shown in FIG. 8 in addition to FIG. 3, the coarse-dust collecting chamber 71 of the electric vacuum cleaner 3 according to the embodiment of the present invention includes the dust guiding face 108 for leading dust from the coarse-dust discharge port 79 as the inlet of the dust collecting chamber 73 to the recess part 97.

The dust guiding face 108 is a slope that intersects the opening direction of the coarse-dust discharge port 79, i.e., intersects the centerline C of the cleaner body 7. The dust guiding face 108 extends substantially planarly from the coarse-dust discharge port 79 toward the recess part 97. The dust guiding face 108 is part of the air passage that leads the air flow from the coarse-dust discharge port 79 to the recess part 97. Most of the coarse dust sucked into the cleaner body 7 flows through the coarse-dust discharge port 79 and flows into the coarse-dust collecting chamber 71. The dust guiding face 108 obliquely leads the flow of the dust-containing air that flows into the coarse-dust collecting chamber 71 through the coarse-dust discharge port 79.

The recess part 97 includes: a first portion 97*a* provided on the partition wall 83 and recessed toward the filter 69; and a second portion 97*b* recessed radially outward of the primary dust container 13 from the coarse-dust collecting chamber 71 toward the waste-outlet lid 92. The first portion 97*a* is continuous with the second portion 97*b*. The wall surface of the first portion 97*a* forms a smoothly curved surface towards the second portion 97*b*. In other words, the partition wall 83 has a recessed portion that is recessed toward the downstream side of the air flow from coarse-dust collecting chamber 71 to the filter chamber 72, and this recessed portion is the first portion 97*a*. In addition, the inner wall of the coarse-dust collecting chamber 71 has a recessed portion that is recessed toward the waste outlet 91, and this recessed portion is the second portion 97*b*. The recess part 97 includes the first portion 97*a* and the second portion 97*b* that are recessed in different directions and are continuous with each other.

The coarse-dust collecting chamber outlets 82 includes: a lower-side coarse-dust collecting chamber outlet 82*a* provided on the wall of the recess part 97; and an upper-side coarse-dust collecting chamber outlet 82*b* that is provided on the wall of the dust collecting chamber 73 so as to be spaced apart from the recess part 97. The lower-side coarse-dust collecting chamber outlet 82*a* is the first dust-collection-chamber outlet for exclusively flowing out air from the recess part 97. The upper-side coarse-dust collecting chamber outlet 82*b* is the second dust-collection-chamber outlet for exclusively flowing out air from the coarse-dust collecting chamber 71 except the recess part 97. The lower-side coarse-dust collecting chamber outlet 82*a* is close to the dust guiding face 108 towards the recess part 97. The upper-side coarse-dust collecting chamber outlet 82*b* is spaced apart from the wall of the recess part 97 and is farther from the dust guiding face 108 than the lower-side coarse-dust collecting chamber outlet 82*a*. The recess part 97 is interposed between the upper-side coarse-dust collecting chamber outlet 82*b* and the dust guiding face 108.

The second mesh filter 84 includes: a lower-side second mesh filter 84*a* provided on the lower-side coarse-dust collecting chamber outlet 82*a*; and an upper-side second mesh filter 84*b* provided on the upper-side coarse-dust collecting chamber outlet 82*b*.

The lower-side coarse-dust collecting chamber outlet 82*a* is provided on one of the wall surfaces of the recess part 97. The lower-side coarse-dust collecting chamber outlet 82*a* includes a plurality of openings 82*c* aligned in the width direction of the wall surfaces of the recess part 97. The lower-side coarse-dust collecting chamber outlet 82*a* is provided on the first portion 97*a*, which is a portion recessed toward the filter chamber 72 among the partition wall 83 partitioning the coarse-dust collecting chamber 71 and the filter chamber 72. The openings 82*c* are aligned over the entire width of the wall surfaces of the recess part 97.

The upper-side coarse-dust collecting chamber outlet 82*b* includes a plurality of openings 82*d* aligned in the width direction of the partition wall 83. The upper-side coarse-dust collecting chamber outlet 82*b* is spaced apart from the dust guiding face 108 with the recess part 97 interposed between both. In the width direction of the partition wall 83, the openings 82*d* are provided on a wider range than the recess part 97. The openings 82*d* are provided over the entire width of the partition wall 83.

When viewed in the direction of the dust flow from the dust guiding face 108 to the recess part 97, the dust collecting chamber 73 has non-opening wall surfaces in both side portions 83*a* of the recess part 97. In other words, both side portions 83*a* of the recess part 97 are non-opening walls, are part of the walls of the dust collecting chamber 73, and are part of the partition wall 83 that is part of the walls of the dust collecting chamber 73.

The filter 69 filters and separates the fine dust from the air flowing out from the coarse-dust collecting chamber outlets 82 (i.e., the lower-side coarse-dust collecting chamber outlet 82*a* and the upper-side coarse-dust collecting chamber outlet 82*b*), and causes the filtered clean air to flow out to the communication passage 66.

The dust-containing air flowing from the coarse-dust discharge port 79 of the first separator 68 into the coarse-dust collecting chamber 71 flows straight from the coarse-dust discharge port 79 and then blows on the dust guiding face 108. The dust-containing air having reached the dust guiding face 108 changes its flowing direction so as to flow along the dust guiding face 108, and flows toward the recess part 97. The air having flowed into the coarse-dust collecting chamber 71 is sucked into the lower-side coarse-dust collecting chamber outlet 82*a* and is also sucked into the upper-side coarse-dust collecting chamber outlet 82*b*. The flow field inside the coarse-dust collecting chamber 71 (i.e., spreading and branching of air inside the coarse-dust collecting chamber 71) causes coarse dust with relatively large mass (or massive coarse dust) contained in the air to flow straight along the dust guiding face 108 by its inside force, and causes coarse dust with relatively small mass contained in the air to flow toward the upper-side coarse-dust collecting chamber outlet 82*b*. Thus, most of the massive coarse dust is accumulated in the recess part 97 that is disposed ahead of the dust guiding face 108, and most of the coarse dust with relatively small mass is captured with the upper-side second mesh filter 84*b*.

Next, the dust-removal mechanism 95 of the electric vacuum cleaner 3 according to the present embodiment will be described.

Figure 9:
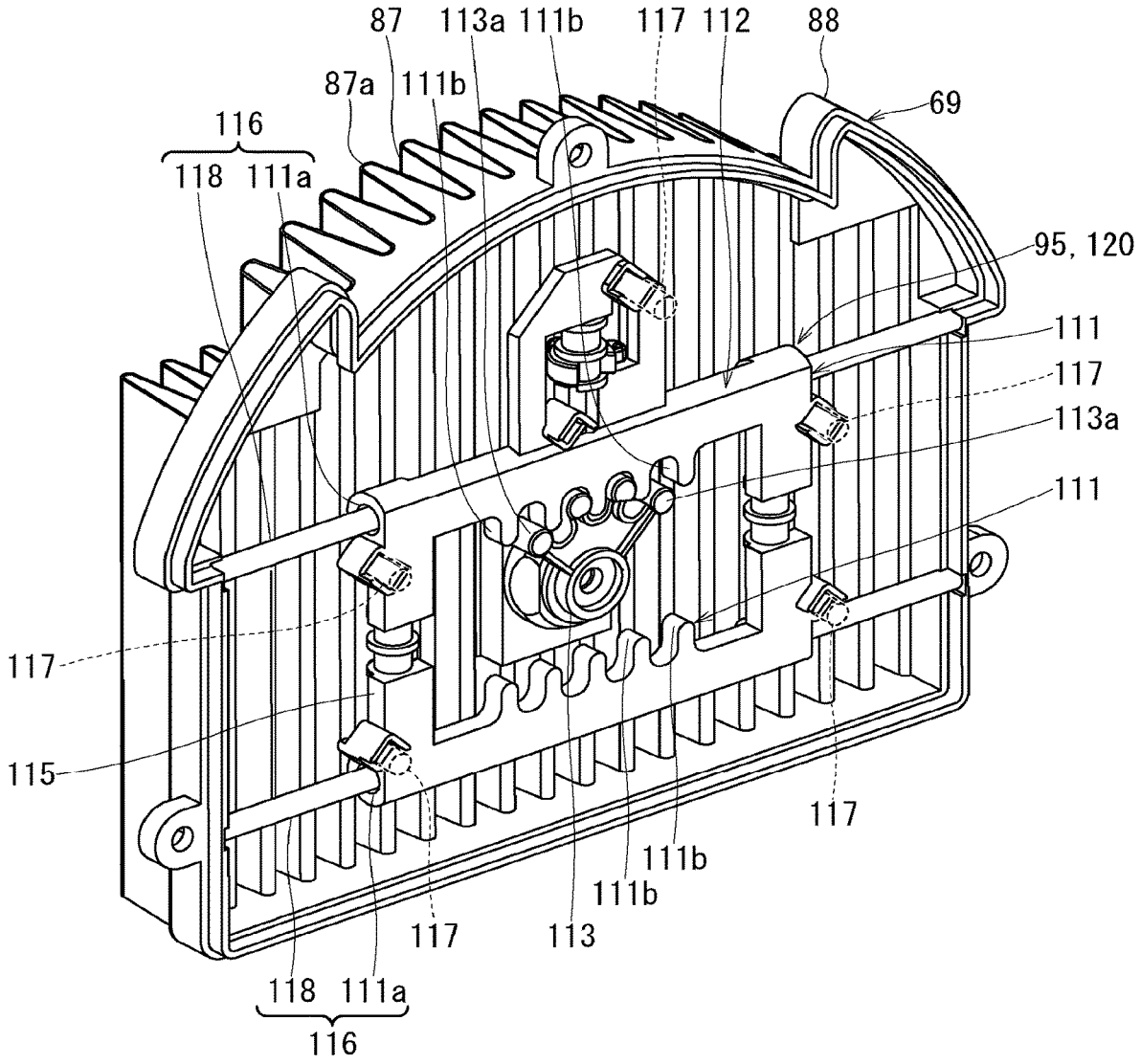
FIG. 9 is a perspective view of a dust-removal mechanism of the electric vacuum cleaner according to the embodiment of the present invention.

FIG. 9 is a perspective view of the dust-removal mechanism of the electric vacuum cleaner according to the embodiment of the present invention.

As shown in FIG. 9, the dust-removal mechanism 95 of the electric vacuum cleaner 3 according to the present embodiment is disposed between the pair of filters 86 and 87. In other words, the dust-removal mechanism 95 is disposed in the internal space of the filter 69. The dust-removal mechanism 95 removes the dust from the pair of filters 86 and 87 together.

The dust-removal mechanism 95 includes: a driven mechanism 112 including connected racks 111; and a gear 113 that sequentially meshes with the racks 111 so as to move the driven mechanism 112 along a predetermined track while rotating in one direction.

In addition to the racks 111, the driven mechanism 112 is provided with: a frame 115 that integrally connects the racks 111, a mechanism (for example, slider 116) that defines the moving direction of the racks 111; and dust removers 117 that contact the respective filters 86 and 87.

The racks 111 in the present embodiment are a pair of racks 111 arranged in parallel. The driven mechanism 112 reciprocates by alternately meshing the gear 113 with the pair of racks 111.

The frame 115 connects the respective ends of the pair of racks 111. The pair of racks 111 and the frame 115 draw a rectangle as a whole.

The slider 116 includes: holes 111*a* of the racks 111; and rod-shaped rails 118 that are inserted into the corresponding holes 111*a* and fixed to the secondary filter frame 88 of the filter 69. The slider 116 may be configured as a component that includes: elongated holes (not shown) provided in the frame 115 or the racks 111; and pin members (not shown) such as screws or rivets to be inserted into the elongated holes and fixed to the secondary filter frame 88, for example.

The gear 113 is disposed at the central portion of the filter 69. In other words, the gear 113 is sandwiched between the pair of filters 86 and 87 and disposed at the central portion of the projection plane of the filters 86 and 87.

The teeth 113*a* of the gear 113 are partially provided. In other words, the gear 113 is partially devoid of the teeth 113*a*. The teeth 113*a* of the gear 113 sequentially mesh with the racks 111 in the process of one rotation of the gear 113. The number of teeth 113*a* of the gear 113 is limited to a range in which two or more racks 111 do not simultaneously mesh with the gear 113.

More specifically, the number of teeth 111*b* of each rack 111 is one more than the number of the teeth 113*a* of the gear 113. That is, the number of grooves between the adjacent teeth 111*b* of each rack 111 is the same as the number of the teeth 113*a* of the gear 113. For example, the gear 113 has four teeth 113*a* and each rack 111 has five teeth 111*b*. The distance from the bottom of the groove of one of the pair of racks 111 to the bottom of the groove of the other of the pair of racks 111 is slightly larger than the outermost diameter of the gear 113. This difference (gap) facilitates engagement and disengagement between the teeth 113*a* of the gear 113 and the teeth 111*b* of the racks 111.

While the gear 113 partially devoid of the teeth 113*a* is being rotated half, the teeth 113*a* mesh with one of the racks 111 to move the driven mechanism 112 in the forward path. When the rotation of the gear 113 progresses (advances about 180°), the teeth 113*a* come out of the one rack 111 and mesh with the other rack 111 so as to move the driven mechanism 112 in the backward path. The gear 113 may be configured such that there is a period in which the teeth 113*a* are not temporarily engaged with any of the racks 111 between the forward path and the backward path of the driven mechanism 112.

The dust-removal mechanism 95 having three or more racks 111 may include: a gear 113 provided with teeth around its entire circumference; and a mechanism for defining the moving direction of the racks 111 other than the slider 116. The dust-removal mechanism 95 having three or more racks 111 may cause the gear 113 to make one or more rotations when causing the driven mechanism 112 to move along its track for one cycle.

Next, the power transmission mechanism 96 of the electric vacuum cleaner 3 according to the present embodiment will be described.

FIG. 10 to FIG. 13 are diagrams illustrating the power transmission mechanism of the electric vacuum cleaner according to the embodiment of the present invention.

Figure 10:
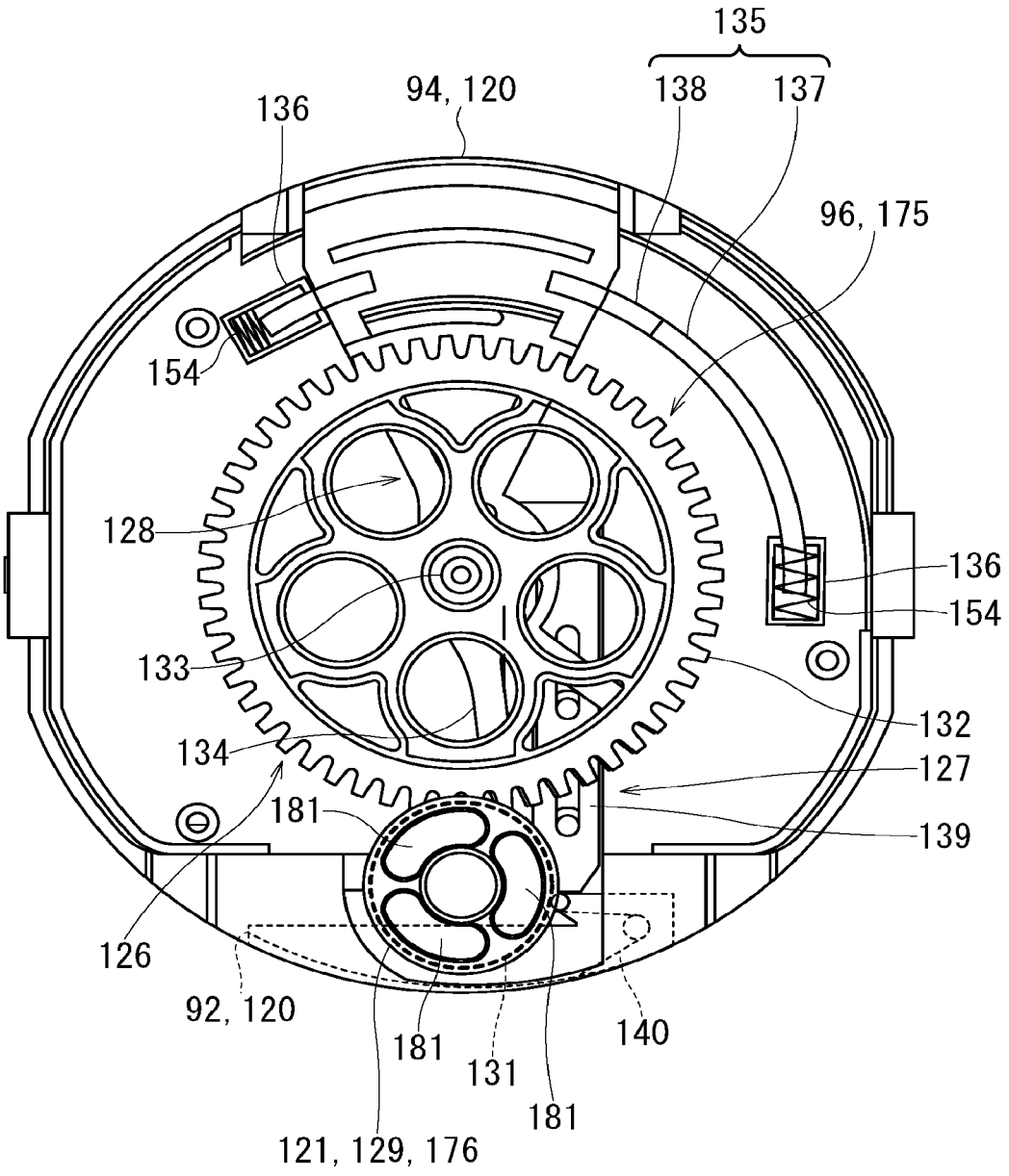
FIG. 10 is a diagram illustrating a power transmission mechanism of the electric vacuum cleaner according to the embodiment of the present invention.
Figure 11:
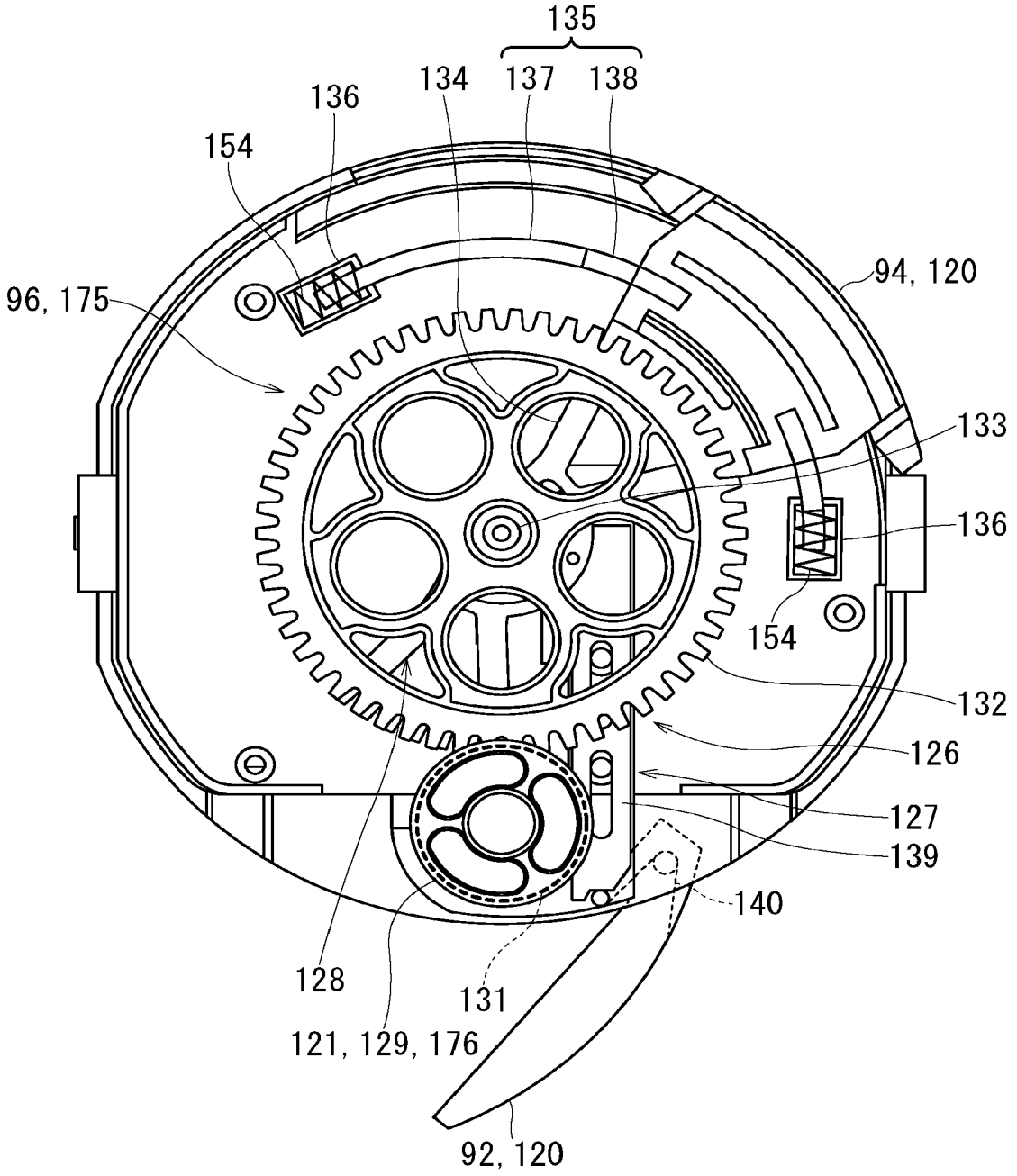
FIG. 11 is another diagram illustrating the power transmission mechanism of the electric vacuum cleaner according to the embodiment of the present invention.
Figure 12:
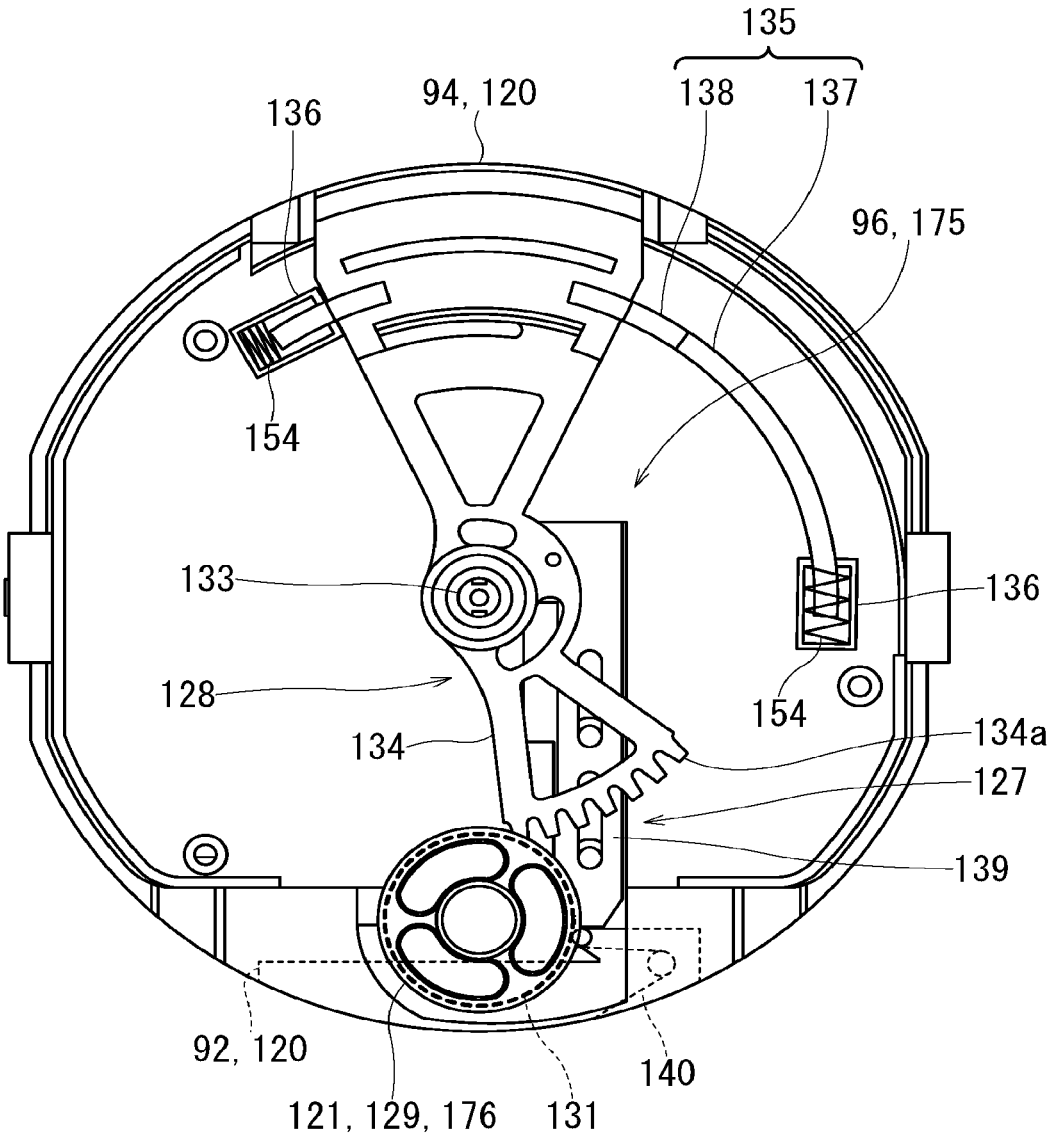
FIG. 12 is still another diagram illustrating the power transmission mechanism of the electric vacuum cleaner according to the embodiment of the present invention.
Figure 13:
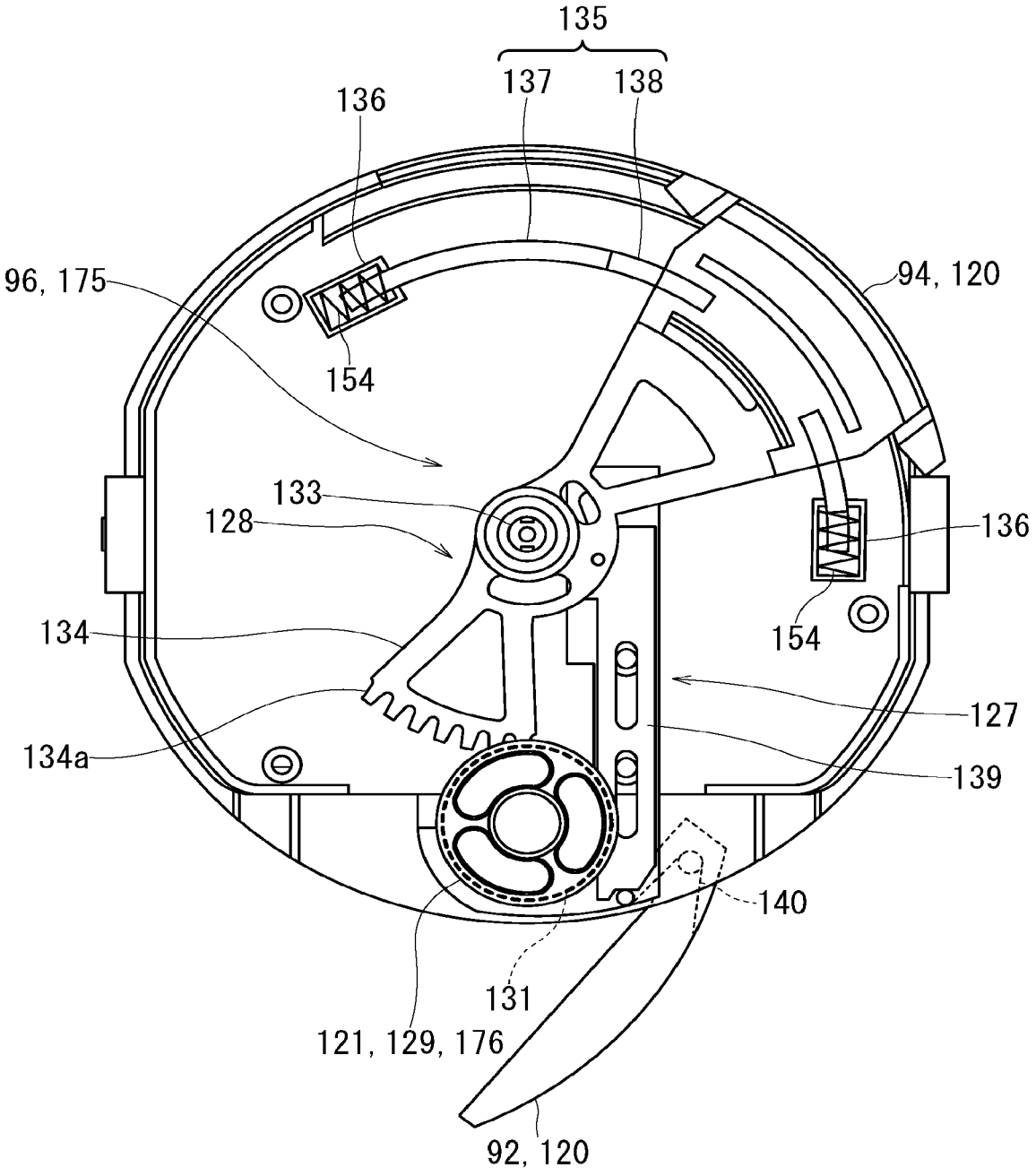
FIG. 13 is still another diagram illustrating the power transmission mechanism of the electric vacuum cleaner according to the embodiment of the present invention.

FIG. 10 and FIG. 12 show the state in which the waste-outlet lid 92 and the suction-port lid 94 are closed with the power transmission mechanism 96. FIG. 11 and FIG. 13 show the state in which the waste-outlet lid 92 and the suction-port lid 94 are opened with the power transmission mechanism 96. FIG. 12 and FIG. 13 show the power transmission mechanism 96 with the second gear 132 omitted.

As shown in FIG. 10 to FIG. 13 in addition to FIG. 3 and FIG. 5, the power transmission mechanism 96 of the electric vacuum cleaner 3 according to the present embodiment receives the driving force for the dust-removal mechanism 95, the waste-outlet lid 92, and the suction-port lid 94 from the station 2, and distributes and transmits the driving force to each of the dust-removal mechanism 95, the waste-outlet lid 92, and suction-port lid 94. The dust-removal mechanism 95, the waste-outlet lid 92, and the suction-port lid 94 that obtain the driving force from the station 2 via the power transmission mechanism 96 are collectively referred to as a driven mechanism 120. The driven mechanism 120 switches between one state in which the electric vacuum cleaner 3 can be used and another state in which dust can be transferred from the primary dust container 13 of the electric vacuum cleaner 3 to the secondary dust container 49 of the station 2 by using the driving force from the station 2.

The power transmission mechanism 96 includes: a driven part 121; a first transmission mechanism 126 for transmitting the driving force from the driven part 121 to the dust-removal mechanism 95; a second transmission mechanism 127 for transmitting the driving force from the driven part 121 to the waste-outlet lid 92; and a third transmission mechanism 128 for transmitting the driving force from the driven part 121 to the suction-port lid 94.

The power transmission mechanism 96 distributes the driving force received from the station 2 to the dust compression mechanism 98.

The driven part 121 is part of a shaft coupling 129 that transmits rotational driving force. The driven part 121 can be coupled to a driving part 122 of the station 2.

The first transmission mechanism 126 constantly transmits the driving force inputted to the driven part 121 to the gear 113 of the dust-removal mechanism 95. The first transmission mechanism 126 simply transmits the rotational driving force inputted to the driven part 121 so as to rotate the gear 113. In other words, the first transmission mechanism 126 rotates the gear 113 in the reverse direction when the driven part 121 rotates in the normal direction, and the first transmission mechanism 126 rotates the gear 113 in the normal direction when the driven part 121 rotates in the reverse direction.

The first transmission mechanism 126 includes: a first gear 131 rotationally integral with the driven part 121; and a second gear 132 engaged with the first gear 131 and having a large diameter. The second gear 132 is rotatably supported with a shaft 107*b* that penetrates the secondary filter frame 88 of the filter 69 and rotates integrally with the gear 113 of the dust-removal mechanism 95. That is, the second gear 132 rotates integrally with the gear 113 of the dust-removal mechanism 95. Since the second gear 132 is larger than the first gear 131, a motor (a drive source 149 of the station 2 described below) can drive the dust-removal mechanism 95, which operates while flipping or deforming the filters 86 and 87, with a smaller output.

The second transmission mechanism 127 opens and closes the waste-outlet lid 92 by the driving force inputted to the driven part 121. The third transmission mechanism 128 opens and closes the suction-port lid 94 by the driving force to be inputted to the driven part 121. Both of the suction-port lid 94 and the waste-outlet lid 92 are opened or closed together. In other words, when the second transmission mechanism 127 opens the waste-outlet lid 92, the third transmission mechanism 128 also opens the suction-port lid 94. In addition, when the second transmission mechanism 127 closes the waste-outlet lid 92, the third transmission mechanism 128 also closes the suction-port lid 94.

The third transmission mechanism 128 includes: the first gear 131 that is shared with the first transmission mechanism 126; a lever 134 that is provided with teeth 134*a* disposed in an arc and engaged with the first gear 131; a guide 135 that guides the swinging of the lever 134; and a pair of stoppers 136 that defines the swinging range of the lever 134.

The lever 134 has a center of oscillation that coincides with the rotation center of the second gear 132. That is, the lever 134 is supported together with the second gear 132 by the shaft that rotatably supports the second gear 132. The lever 134 is directly connected to the suction-port lid 94.

The guide 135 includes: a groove 137 provided in the container body 78; and a guide plate 138 disposed in the groove 137. The groove 137 extends in an arc according to the swinging track of the lever 134. The guide plate 138 is integrated into the lever 134.

The stoppers 136 regulate (limit) the swinging range of the lever 134 in accordance with the fully closed position and the fully opened position of the waste-outlet lid 92 and the suction-port lid 94.

The second transmission mechanism 127 includes: the first gear 131 that is shared among the first transmission mechanism 126 and the third transmission mechanism 128; the lever 123, the guide 135, and the stoppers 125 that are shared between the third transmission mechanism 128; a slider 139 that converts the swinging motion of the lever 134 into a reciprocating motion and transmits it to the waste-outlet lid 92; and a waste-lid closing spring 140 that generates spring force for fully closing the waste-outlet lid 92. The slider 139 overcomes the spring force of the waste-lid closing spring 140 so as to open the waste-outlet lid 92. In addition, the slider 139 closes the waste-outlet lid 92 by the spring force of the waste-lid closing spring 140.

The power transmission mechanism 96 transmits the driving force from the station 2 to the dust-removal mechanism 95 for an appropriate period. After the waste-outlet lid 92 and the suction-port lid 94 are fully opened or fully closed, the power transmission mechanism 96 cuts off (i.e., interrupt) the power transmission from the station 2 to the waste-outlet lid 92 and the suction-port lid 94 even in an appropriate period during which the dust-removal mechanism 95 is in operation.

That is, the second transmission mechanism 127 cuts off the transmission of the driving force from the driven part 121 to the waste-outlet lid 92 when the waste-outlet lid 92 is fully opened or fully closed. Additionally, the third transmission mechanism 128 cuts off the transmission of the driving force from the driven part 121 to the suction-port lid 94 when the suction-port lid 94 is fully opened or fully closed.

Specifically, the second transmission mechanism 127 and the third transmission mechanism 128 release the engagement between the teeth 134*a* of the lever 134 and the first gear 131 when the waste-outlet lid 92 and the suction-port lid 94 are fully opened or fully closed. That is, the arrangement range of the teeth 134*a* arranged in an arc is limited in such a manner that the teeth 134*a* are disengaged from the first gear 131 when the waste-outlet lid 92 and the suction-port lid 94 are fully opened or fully closed.

When the waste-outlet lid 92 is fully closed or fully opened, the teeth 134*a* of the lever 134 cannot resist the waste-outlet lid 92 that is prevented from moving, and the teeth 134*a* is disengaged from the first gear 131 so as to interrupt the transmission of the driving force (torque). When the suction-port lid 94 is fully closed or fully opened, the teeth 134*a* of the lever 134 is disengaged from the first gear 131 so as to interrupt the transmission of the driving force (torque).

The power transmission mechanism 96 includes a drive source, for example, a return spring 154 for promoting smooth engagement between the teeth 134*a* of the lever 134 and the first gear 131 when the engagement between both is restored. When the waste-outlet lid 92 and the suction-port lid 94 are fully opened or fully closed, the return spring 154 is compressed to store energy. Subsequently, when opening or closing of the waste-outlet lid 92 and the suction-port lid 94 is started, the return spring 154 pushes back the lever 134 by consuming the energy so as to assist in the return of the engagement between the teeth 134*a* of the lever 134 and the first gear 131.

It is preferred that the waste-outlet lid 92 and the suction-port lid 94 maintain the fully open state in an appropriate period during which the dust-removal mechanism 95 operates and removes the dust from the filters 86 and 87. If the dust-removal mechanism 95 is caused to reciprocate by switching between the normal rotation and the reverse rotation of the motor (i.e., the drive source 169 of the station 2 described below), the waste-outlet lid 92 and the suction-port lid 94 are opened and closed every time the normal rotation and the reverse rotation of the motor are switched, and this is not desirable. For this reason, the dust-removal mechanism 95 according to the present embodiment is configured to be able to reciprocate the driven mechanism 112 with the gear 113 rotating in one direction as shown in FIG. 9.

Next, the container lock mechanism 61 of the electric vacuum cleaner 3 according to the embodiment of the present invention will be described.

Figure 14:
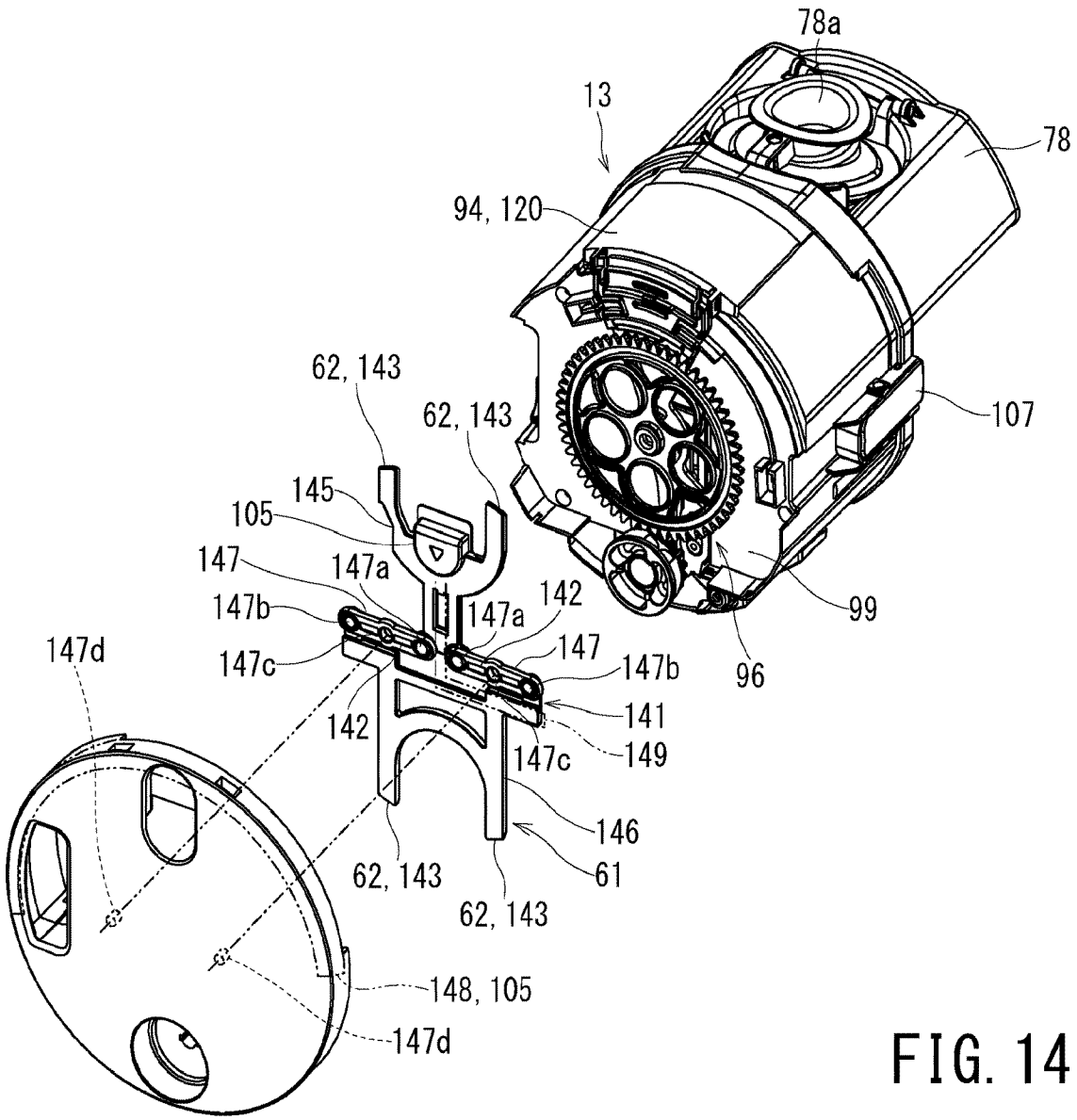
FIG. 14 is an exploded perspective view of a container lock mechanism of the electric vacuum cleaner according to the embodiment of the present invention.

FIG. 14 is an exploded perspective view of the container lock mechanism of the electric vacuum cleaner according to the embodiment of the present invention.

As shown in FIG. 14 in addition to FIG. 3, the container lock mechanism 61 of the electric vacuum cleaner 3 according to the present embodiment includes: the claws 62; the claw receivers 63 (FIG. 3); the operation part 105 that can be operated; a unhooking-force transmission mechanism 141 that unhooks the claws 62 from the claw receivers 63 substantially simultaneously when the operation part 105 is operated; and elastic members 142 that generates a force that cause the claws 62 to be pushed out and hooked to the claw receivers 63.

The plurality of claws 62 include a plurality of pairs 143 that move in the opposite directions when being hooked to the claw receivers 63 and when being unhooked from the claw receivers 63. It is preferred that the respective pairs 143 of the claws 62 are equally spaced with reference to the place where the extrusion force acts from the extrusion force generator 59. The pairs 143 may share an arbitrary claw 62 of claws 62. For example, three claws 62 may form two pairs 143 such that one claw 62 belongs to each of two pairs 143.

The operation part 105 is integrated into any one of the claws 62.

The unhooking-force transmission mechanism 141 transmits the force for unhooking the claws 62 from the claw receivers 63 from the operation part 105 to the claws 62 substantially simultaneously. The unhooking-force transmission mechanism 141 includes: a pair of sliders 145 and 146, each of which separately has claws 62 forming a pair 143; and links 147 that link the pair of sliders 145 and 146 and transmit the motion of one slider 145 to the other slider 146.

The pair of sliders 145 and 146 reciprocate substantially on the same line.

The links 147 comprises one pair of links 147, and the links 147 reverse the motion of one slider 145 so as to transmits the motion to the other slider 146. Each link 147 includes: a first joint 147*a* to be coupled to one slider 145; a second joint 147*b* to be coupled to the other slider 146; and a pin hole 147*c* provided at the central portion of the link 147. The pin hole 147*c* is interdigitated with a pin 147*d* provided in the primary dust container 13. Each link 147 swings around its pin 147*d*. The pin 147*d* is provided on the wall defining the machine chamber 99.

The claws 62 and the unhooking-force transmission mechanism 141 move on substantially the same plane.

The elastic members 142 are, for example, coil springs. When the claws 62 are unhooked from the claw receivers 63, the elastic members 142 store energy by displacement of one or both of the pair of sliders 145 and 146. When the operation force to be applied to the operation part 105 is lost or when the force generated with the elastic members 142 overcome the operation force, the elastic members 142 move one or both of the pair of sliders 145 and 146 in the direction in which the claws 62 are hooked to the claw receivers 63.

The claws 62, the operation part 105, the unhooking-force transmission mechanism 141, and the elastic members 142 are provided with the primary dust container 13, and the claw receivers 63 are provided on the body housing 11 (FIG. 3). It may be configured such that the claws 62, the operation part 105, the unhooking-force transmission mechanism 141, and the elastic members 142 are provided with the body housing 11 and the claw receivers 63 are provided on the primary dust container 13. In other words, it is satisfactory that the claws 62, the operation part 105, the unhooking-force transmission mechanism 141, and the elastic members 142 are provided with one of the body housing 11 and the primary dust container 13, and the claw receivers 63 are provided on the other of the body housing 11 and primary dust container 13.

The operation part 105 may serve as a container handle 148 provided on the primary dust container 13. In this case, the operation part 105 uses the force, which acts so as to extract the primary dust container 13 from the dust container chamber 57 when the container handle 148 is pulled, as the force to unhook the claws 62 from the claw receiver 63. The operation part 105, i.e., the container handle 148 transmits the action to be caused from a storage position to a use position to one of the pair of sliders 145 and 146 via the link mechanism 149, and uses it as the force to unhook the claws 62 from the claw receivers 63.

When the primary dust container 13 is accommodated in the dust container chamber 57 of the body housing 11, the claws 62 fix the primary dust container 13 to the body housing 11 by being hooked to the claw receiver 63 and thereby overcoming the force to push out the primary dust container 13 from the dust container chamber 57.

When the force to unhook the claws 62 from the claw receivers 63 acts on the operation part 105, the container lock mechanism 61 unhooks the claws 62 from the claw receivers 63 substantially simultaneously via the unhooking-force transmission mechanism 141. Thereby, the force that fixes the primary dust container to the body housing 11 against the extrusion force for pushing out the primary dust container 13 from the dust container chamber 57 is lost. As a result, the primary dust container 13 is lifted (or pops up) from the dust container chamber 57 of the body housing 11 and becomes detachable.

A description will now be given of the wheels 12 and the body handle 14 of the cleaner body 7 according to the embodiment of the present invention.

Figure 15:
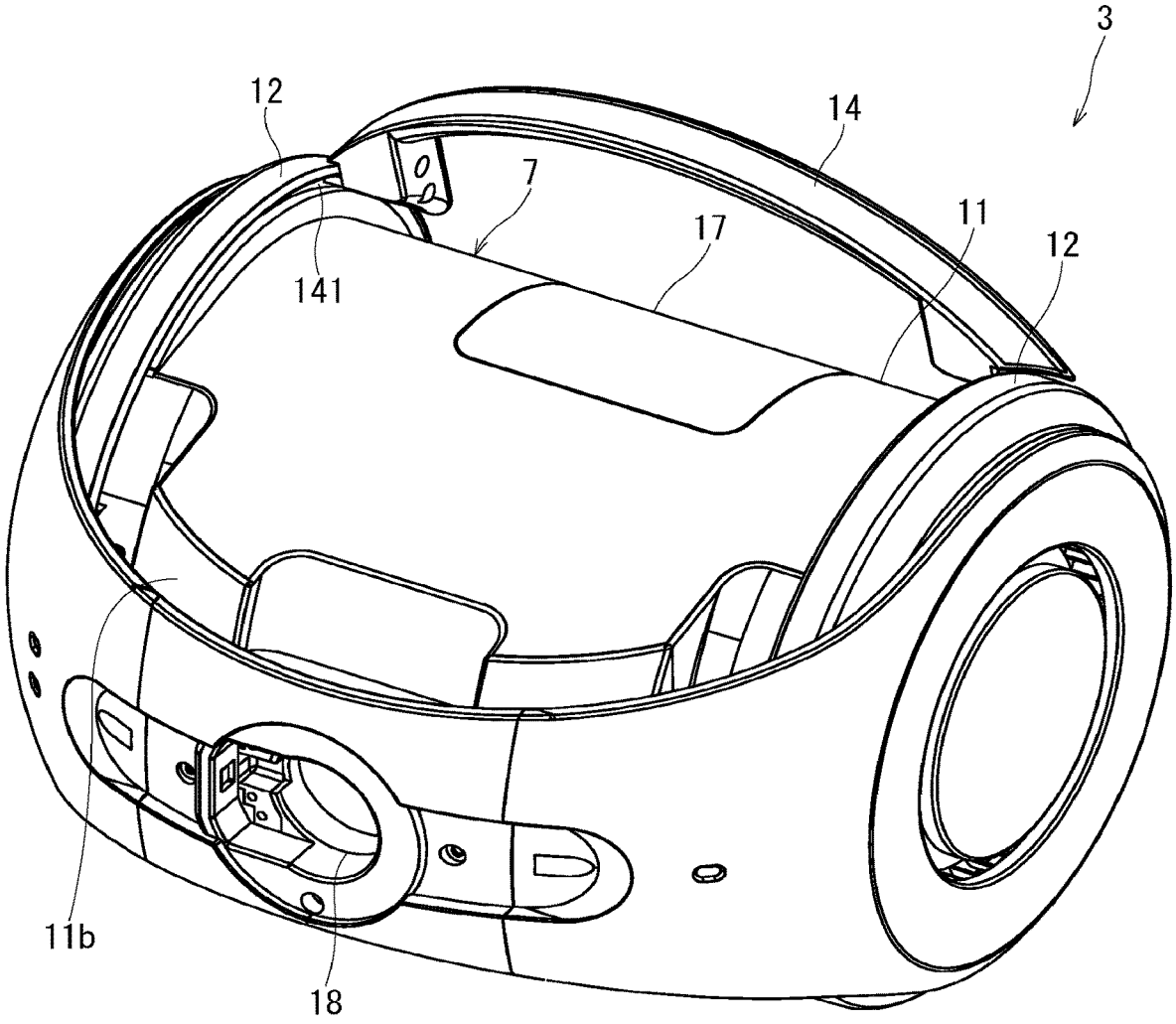
FIG. 15 is a perspective view illustrating when a body handle of the electric vacuum cleaner according to the embodiment of the present invention is pulled out.

FIG. 15 is a perspective view illustrating the state where the body handle of the electric vacuum cleaner according to the embodiment of the present invention is pulled out.

Figure 16:
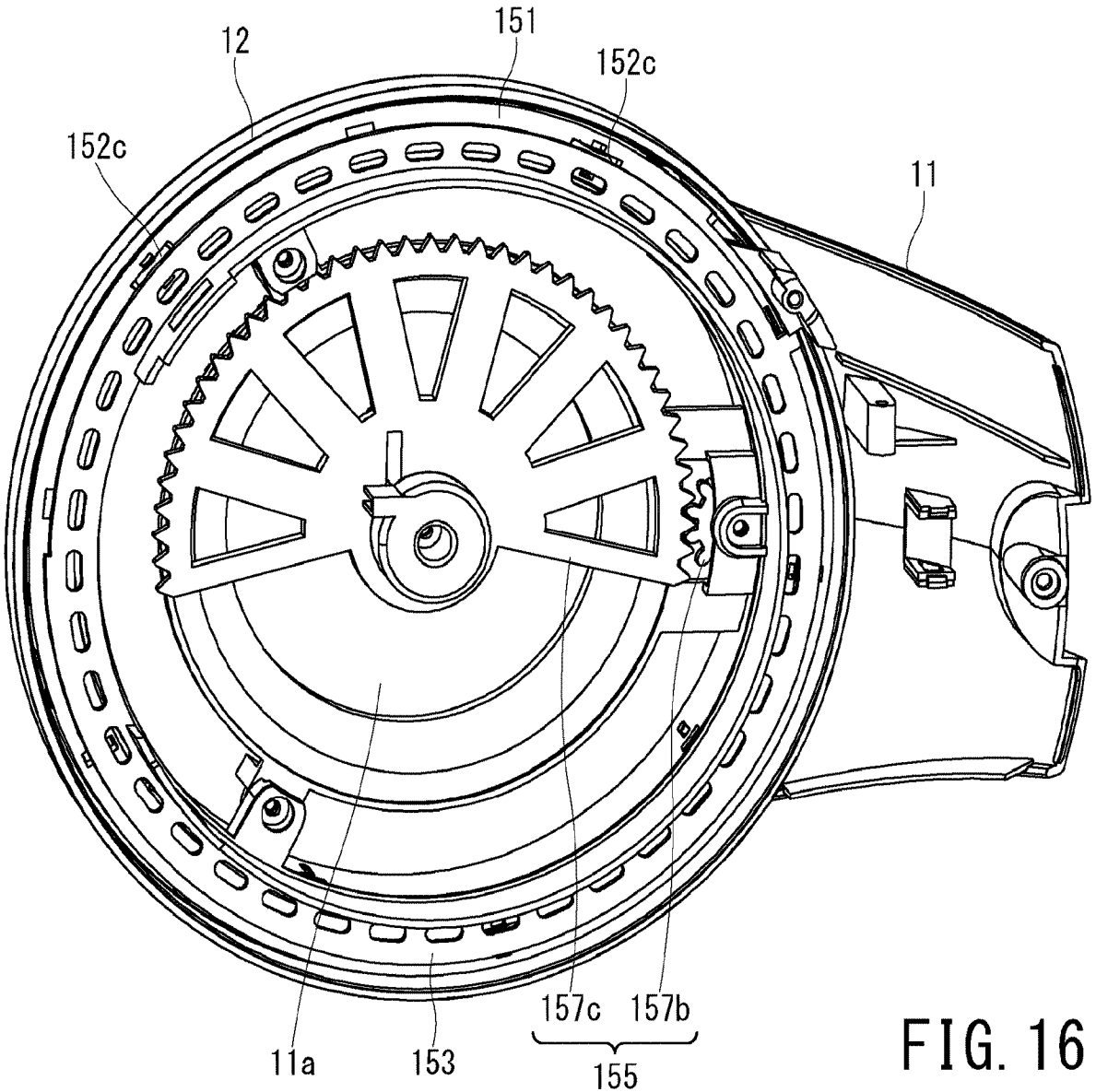
FIG. 16 is a perspective view of internal structure of a wheel and the body handle of the electric vacuum cleaner according to the embodiment of the present invention.

FIG. 16 is a perspective view of internal structure of the wheel and the body handle of the electric vacuum cleaner according to the embodiment of the present invention.

Figure 17:
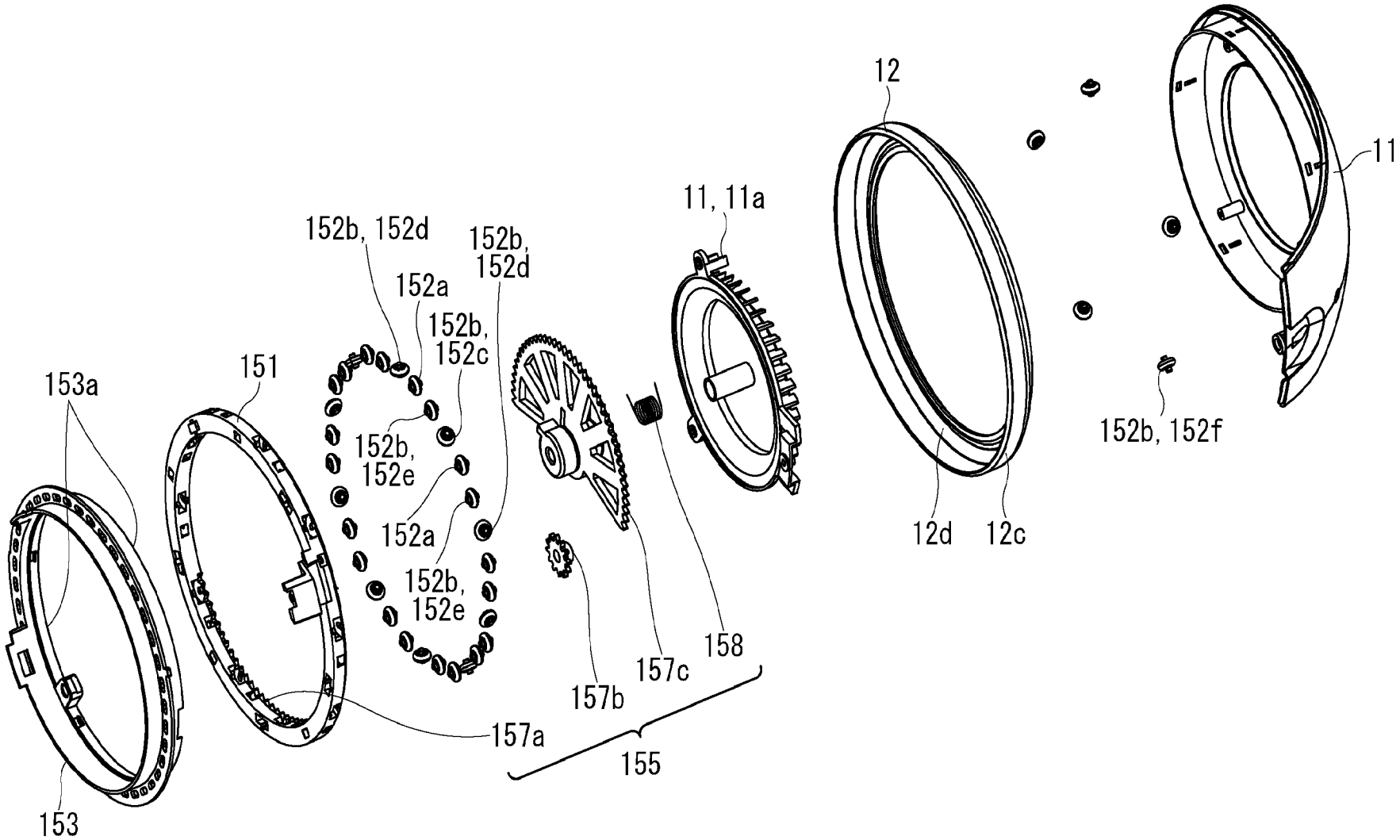
FIG. 17 is an exploded perspective view of the body handle and the wheel of the electric vacuum cleaner according to the embodiment of the present invention.

FIG. 17 is an exploded perspective view of the body handle and the wheel of the electric vacuum cleaner according to the embodiment of the present invention.

FIG. 18 to FIG. 21 are cross-sectional views of the body handle and the wheel of the electric vacuum cleaner according to the embodiment of the present invention.

As shown in FIG. 15 to FIG. 21, the electric vacuum cleaner 3 according to the present embodiment includes: the body housing 11; the wheels 12 for supporting the body housing 11; the body handle 14 provided on the body housing 11; and a pair of bases 151 integral with the body handle 14.

Each wheel 12 includes: an annular grounding wall 12*c* to be grounded on the surface to be cleaned; and a side wall 12*d* that is continuous with the grounding wall 12*c* and extends toward the rotation center of the wheel 12.

The body handle 14 is bridged between the right and left wheels 12 in an arch. When the body handle 14 is not in use, the body handle 14 is housed in a handle storage recess 11*b* provided on the front edge of the top face of the body housing 11 (FIG. 2). When being used, the body handle 14 is pulled out of the handle storage recess 11*b* and moves to the rear end of the body housing 11. The shape of the body handle 14 matches the shape of the front edge of the arcuate front half of the body housing 11. The body handle 14 reaches the rear end of the cleaner body 7 when being pulled out most. When the cleaner body 7 is placed on a horizontal plane, the body handle 14 can move rearward of the cleaner body 7 substantially passing directly above the cleaner body (FIG. 15).

Each base 151 is rotatably supported with the body housing 11. Each wheel 12 is rotatably supported with the corresponding base 151. That is, each wheel 12 is rotatably supported with the body housing 11 via the corresponding base 151. The rotation range of the bases 133 are restricted. Each base 151 rotates in a range where the body handle 14 reaches from the handle storage recess 11*b* of the body housing 11 to the rear end of the body housing 11.

The rotation centerline of the wheels 12 and the rotation centerline of the bases 151 are positioned substantially on the same line. In detail, the body handle 14 is accommodated in the handle storage recess 11*b* of the body housing 11 and is pulled out of the handle storage recess 11*b* by being moved to rotate around the rotation centerline of the wheels 12.

The wheels 12 and the bases 151 are annular. In order to make the primary dust container 13 insertable into and detachable from the dust container chamber 57 of the body housing 11 in the width direction of the cleaner body 7, the wheels 12 and the bases 151 have an inner diameter such that the primary dust container 13 can pass through each of the wheels 12 and the base 151. The wheel 12 and bases 151 which are irreverent to attachment and detachment of the primary dust container 13, i.e., the left base 133 and the left wheel 12 and the base 151 of the body housing 7 in the present embodiment are not required to be annular.

Figure 18:
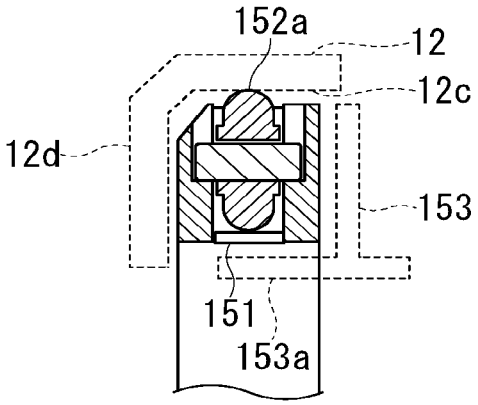
FIG. 18 is a cross-sectional view of the body handle and the wheel of the electric vacuum cleaner according to the embodiment of the present invention.
Figure 19:
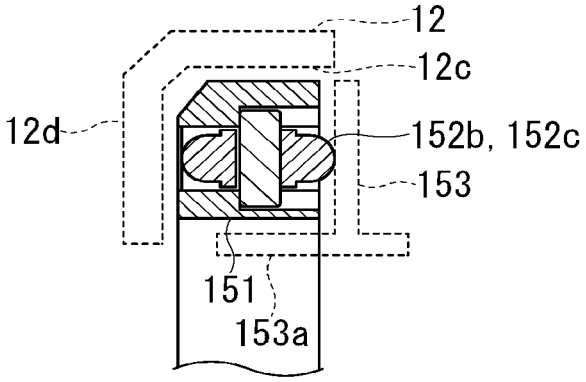
FIG. 19 is another cross-sectional view of the body handle and the wheel of the electric vacuum cleaner according to the embodiment of the present invention.

Each base 151 is provided with a plurality of first rollers 152*a* that rotatably support the corresponding wheel 12. The first rollers 152*a* are provided on the outer periphery of each base 151 (FIG. 18).

The electric vacuum cleaner 3 includes a plurality of second rollers 152*b* that are interposed between the body housing 11 and a pair of base support members 153, and rotatably support each base 133 and the corresponding wheel 12.

Figure 20:
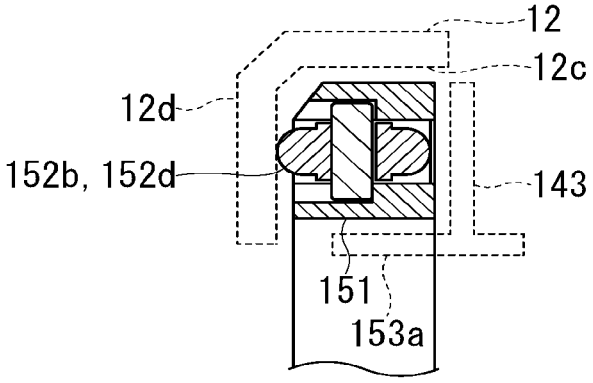
FIG. 20 is still another cross-sectional view of the body handle and the wheel of the electric vacuum cleaner according to the embodiment of the present invention.

The second rollers 152*b* include: third rollers 152*c* that are provided on one side of each base 151 and in contact with the corresponding base support member 153 (FIG. 19); and fourth rollers 152*d* that are provided on the other side of each base 151 and in contact with the side wall 12*d* of the corresponding wheel 12 (FIG. 20). The third rollers 152*c* and the fourth rollers 152*d* constrain the position of the base 151 in the rotation centerline direction. The third rollers 152*c* and the fourth rollers 152*d* are alternately arranged in the circumferential direction of each base 151.

Figure 21:
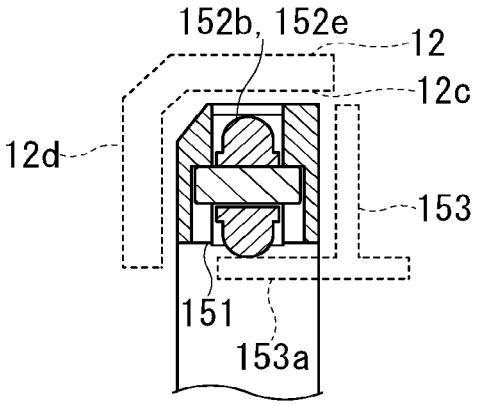
FIG. 21 is still another cross-sectional view of the body handle and the wheel of the electric vacuum cleaner according to the embodiment of the present invention.

The second rollers 152*b* further include a plurality of fifth rollers 152*e* that are provided on the inner periphery of the base 151 and in contact with the corresponding base support member 153 (FIG. 21).

The second rollers 152*b* further include a plurality of sixth rollers 152*f* that are provided on the body housing 11 and in contact with each wheel 12. The sixth rollers 152*f* and the fourth rollers 152*d* of each base 151 sandwich the side wall 12*d* of the corresponding wheel 12. The sixth rollers 152*f* prevent each wheel 12 from detaching from the corresponding base 151 in the rotation centerline direction. In other words, the fourth rollers 152*d* and the sixth rollers 152*f* constrain the position of each wheel 12 in the rotation centerline direction. The third rollers 152*c*, the fourth rollers 152*d*, and the sixth rollers 152*f* constrain the respective positions of the base 151 and the corresponding wheel 12 in the rotation centerline direction.

Each base support member 153 is annular similarly to the corresponding base 151. Each base support member 153 is fixed to the body housing 11. The base support member 153 has a flange 153*a* that enters the inner periphery of the corresponding base 151 and is in contact with the fifth rollers 152*e*.

Each base support member 153 is in contact with the fifth rollers 152*e* (FIG. 21) and the third rollers 152*c* (FIG. 19) of the corresponding base 151, and the sixth rollers 152*f* of the body housing 11 are in contact with each wheel 12. The first rollers 152*a* (FIG. 18) of each base 151 and the fourth rollers 152*d* (FIG. 20) are in contact with the corresponding wheel 12. Each base support member 153 and the body housing 11 support the base 151, the body handle 14, and the corresponding wheel 12 all together.

Although each base support member 153 according to the present embodiment is disposed inside the body housing 11 and fixed to the body housing 11, the base support member 153 may be disposed outside the body housing 11. That is, the structure of each base 151, the body handle 14, and the rollers (first rollers, second rollers) supporting the corresponding wheel 12 may be disposed outside the body housing 11. In this case, each base support member 153 preferably serves as a lid of the roller structure.

The third rollers 152*c*, the fourth rollers 152*d*, and the fifth rollers 152*e* among the second rollers 152*b* and first rollers 152*a* are substantially equally spaced in the circumferential direction of each annular base 151. The third rollers 152*c*, the fourth rollers 152*d*, and the fifth rollers 152*e* among the second rollers 152*b* and first rollers 152*a* are shifted from each other in position (or phase) with respect to the rotation centerline of each wheel 12 and the rotation centerline of the corresponding base 151. This shift contributes to reduction in dimensional difference between the inner diameter and the outer diameter of each base 151 and reduction in thickness dimension of each base 151 in the width direction of the cleaner body 7.

Figure 22:
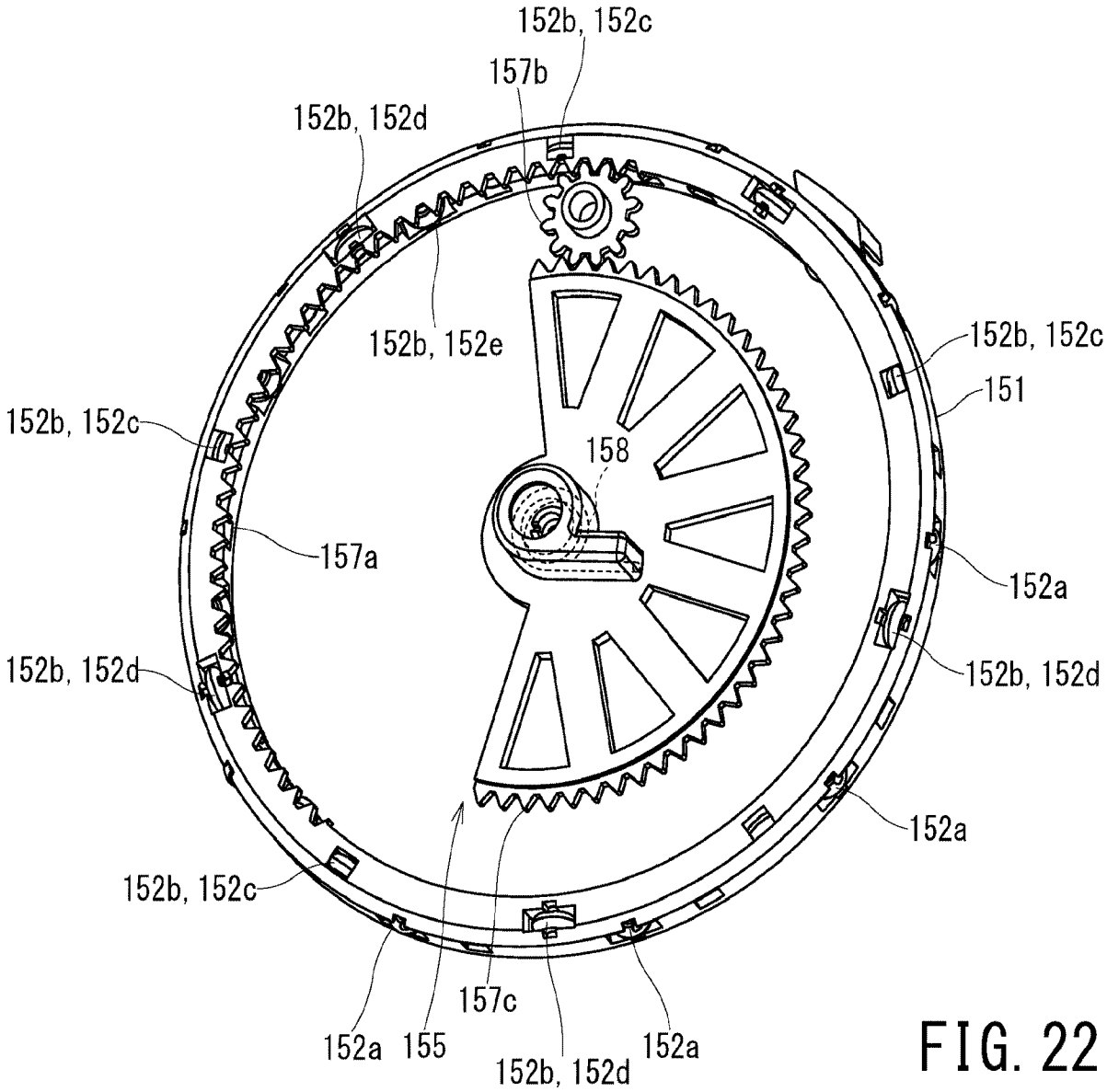
FIG. 22 is a perspective view of a handle return mechanism of the electric vacuum cleaner according to the embodiment of the present invention.

FIG. 22 is a perspective view of a handle return mechanism of the electric vacuum cleaner according to the embodiment of the present invention.

As shown in FIG. 22 in addition to FIG. 16 and FIG. 17, the electric vacuum cleaner 3 according to the present embodiment includes a handle return mechanism 155 that stores energy and consumes the stored energy to generate a force to store the body handle 14 when the body handle 14 is pulled up. The handle return mechanism 155 is disposed on the left side of the cleaner body 7 where the handle return mechanism 155 does not affect the attachment and detachment of the primary dust container 13.

The handle return mechanism 155 includes: a first gear 157*a* provided on the base 151; a second gear 157*b* rotatably supported by the body housing 11 and engaged with the first gear 157*a*; a third gear 157*c* rotatably supported by the body housing 11 and engaged with the second gear 157*b*; and a return spring 158 that to stores energy by the rotation of the third gear 157*c*.

The first gear 157*a* is provided on the inner periphery of the base 151 where the first rollers 152*a* and the second rollers 152*b* are not provided. That is, the first gear 157*a* is a so-called internal gear. The first gear 157*a* is disposed so as to avoid the flange 153*a* that is in contact with the fifth rollers 152*e*. In other words, the first gear 157*a* and the fifth rollers 152*e* are provided side by side with each other on the inner circumference of the base 151.

The second gear 157*b* is smaller in diameter than the first gear 157*a* and the third gear 157*c*.

The third gear 157*c* is disposed inside the annular base 151. The rotation centerline of the third gear 157*c* is positioned substantially on the same line as the rotation centerline of the wheel 12 and the rotation centerline of the bases 151.

The return spring 158 is a so-called torsion spring. The return spring 158 stores energy by the rotation of the third gear 157*c*.

When the body handle 14 is pulled out from the handle storage recess 11*b* of the body housing 11 toward the rear end of the body housing 11, the handle return mechanism 155 rotates the first gear 157*a* that rotates integrally with the base 151, the second gear 157*b* that transmits the rotation of the first gear 157*a* to the third gear 157*c*, and the third gear 157*c* so as to store energy in the return spring 158. When the body handle 14 is not loaded, i.e., when a user does not apply force to the body handle 14, the handle return mechanism 155 consumes the energy stored with the return spring 158 to rotate the third gear 157*c* and thereby stores the body handle 14 into the handle storage recess 11*b* via the second gear 157*b* and the first gear 157*a*.

While the cleaner body 7 is being lifted, the cleaner body 7 is lowered in front by the weight of the dust collecting hose 22 and is in a forward bent position in which its back face is raised. Thus, the body handle 14 and the bases 151 move with respect to the cleaner body 7 while the user holds it and lifts the cleaner body 7. In other words, the cleaner body 7 swings with respect to the body handle 14 held by the user. Since the cleaner body 7 swings in such a manner, a user's stress that is generated by the force acting on the cleaner body 7 from the bending dust collection hose 22 by the operation on the tubular part 8 is alleviated.

Each wheel 12 and the corresponding base 151 may be individually instructed to be rotatable with the body housing 11.

When the primary dust container 13 is integrated with the body housing 11 or when the primary dust container 13 is detachable from the top or bottom of the body housing 11, the wheels 12 and the bases 151 may not be annularly shaped. In this case, the wheels 12 and the bases 151 may have a hub (not shown) at the center of rotation or may have a simple disk shape. The body housing 11 shown in FIG. 16 and FIG. 17 is the left side face of the cleaner body 7, and this left side face is not related to the attachment and detachment of the primary dust container 13. For this reason, as shown in FIG. 16 and FIG. 17, the body housing 11 is provided with an exhaust-port lid 11*a* that has a diffuser for the exhaust of the primary electric blower 15 to flow out.

Next, the station 2 according to the embodiment of the present invention will be described in detail.

Figure 23:
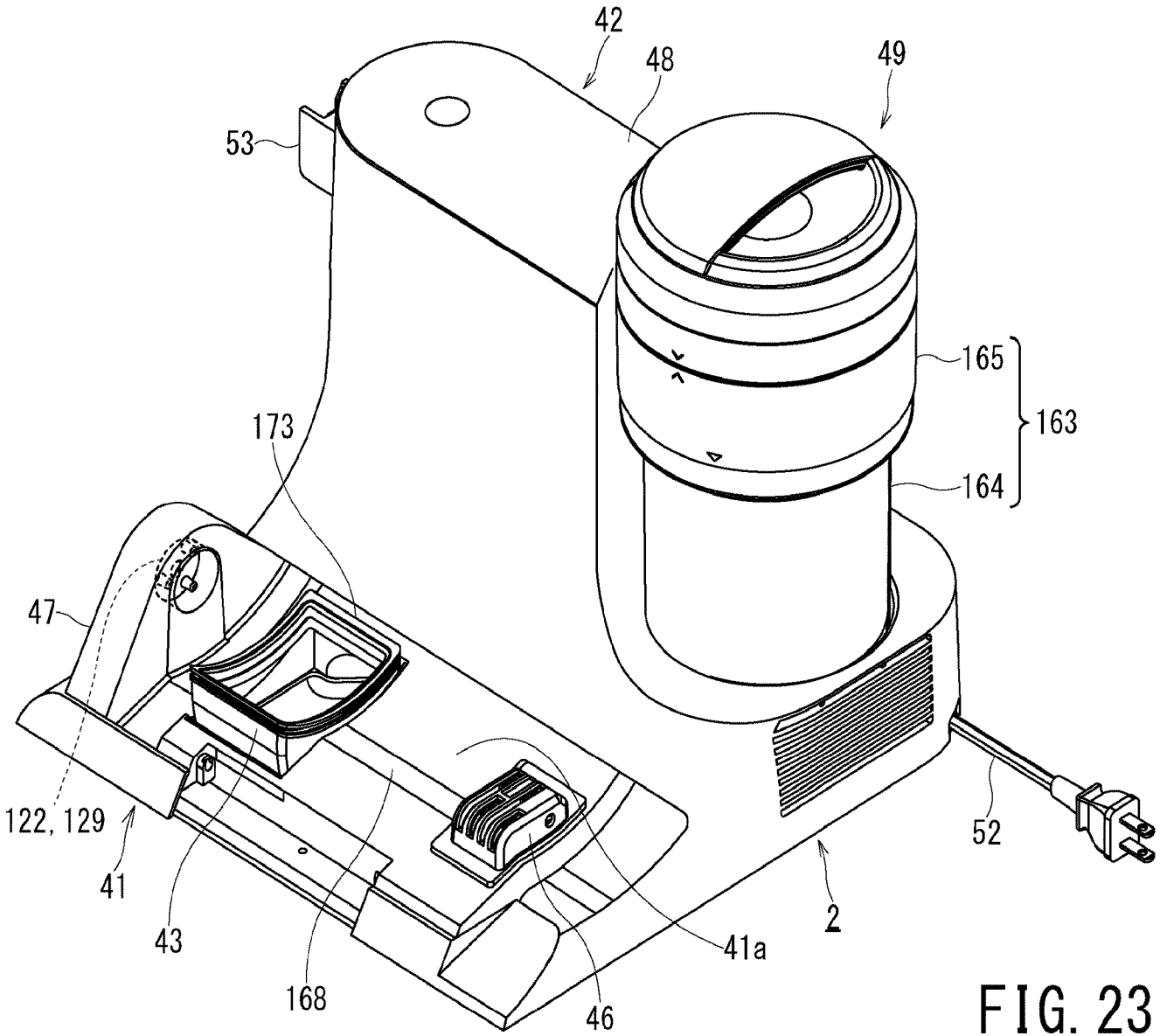
FIG. 23 is a perspective view of a station of the electric vacuum cleaning apparatus according to the embodiment of the present invention.
Figure 24:
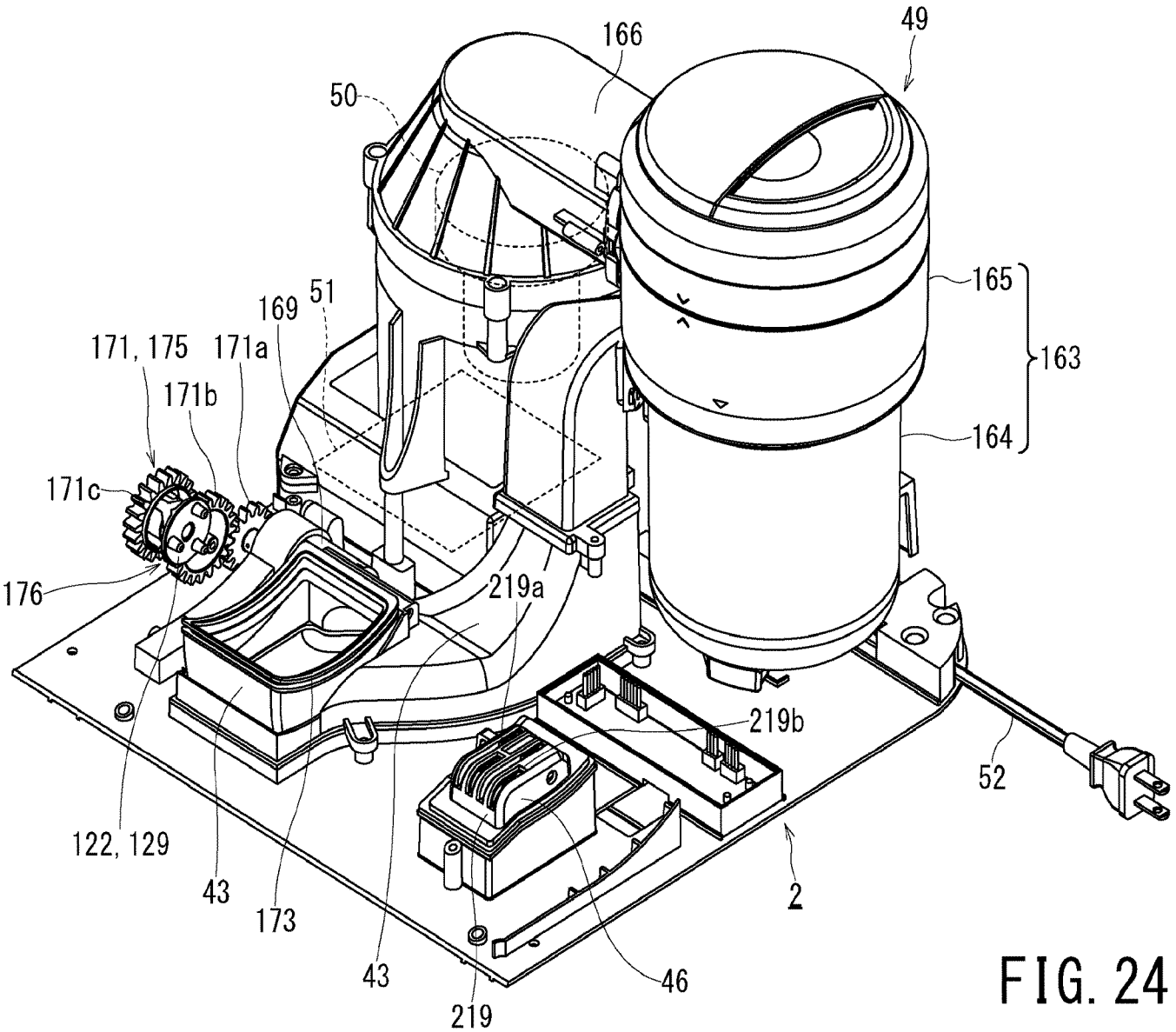
FIG. 24 is another perspective view of the station of the electric vacuum cleaning apparatus according to the embodiment of the present invention.

FIG. 23 and FIG. 24 are perspective views of the station of the electric vacuum cleaning apparatus according to the embodiment of the present invention.

FIG. 24 is the perspective view of the station 2 from which the top plate of the platform 41 and the housing 48 of the dust collection part 42 is detached.

As shown in FIG. 23 and FIG. 24, the secondary dust container 49 of the station 2 according to the present embodiment includes a centrifugal separation device 163 for centrifuging the dust, which flows in from the dust transfer tube 43, from the air. The centrifugal separation device 163 is a multistage type. The centrifugal separation device 163 includes: a first centrifugal separator 164 that centrifuges the dust, which flows in from the dust transfer tube 43, from the air; and a second centrifugal separator 145 that centrifuges the dust passing through the first centrifugal separator 164 from the air.

The first centrifugal separator 164 centrifuges coarse dust contained in the dust flowing into the secondary dust container 49. The second centrifugal separator 165 centrifuges fine dust passing through the first centrifugal separator 164. The coarse dust is dust with a large mass such as sand grain and fibrous dust including lint and cotton dust, and the fine dust is particulate or powdery dust with a small mass.

The secondary electric blower 50 is connected to the secondary dust container 49 via a downstream air duct 166. The secondary electric blower 50 acts the negative pressure to the primary dust container 13 through the downstream air duct 166, the secondary dust container 49, and the dust transfer tube 43 so as to transfer the dust accumulated in the primary dust container 13 to the secondary dust container 49 together with the air.

In addition, the station 2 includes: a coupling guide 168 provided on the platform 41; the drive source 169 for generating opening drive force and closing drive force of the waste-outlet lid 92 of the primary dust container 13 of the electric vacuum cleaner 3; and a power transmission mechanism 171 for transmitting the driving force from the drive source 169 to the electric vacuum cleaner 3.

When the cleaner body 7 is connected to the station 2, the coupling guide 168 leads the cleaner body 7 to the position where the charging terminals 46 of the station 2 is suitably connected (coupled) to the charging electrodes 19 of the cleaner body 7 and the dust transfer tube 43 is suitably connected to the waste outlet 91 of the cleaner body 7.

The storage configuration of the electric vacuum cleaning apparatus 1 is the configuration in which the cleaner body 7 is connected (coupled) to the station 2, the charging terminals 46 of the station 2 is suitably connected to the charging electrodes 19 of the cleaner body 7, and the dust transfer tube 43 is suitably connected to the waste outlet 91 of the cleaner body 7.

The coupling guide 168 is recessed so as to conform to the shape of the rear end of the body housing 11 of the cleaner body 7. That is, the coupling guide 168 fits in the cylindrical rear half of the body housing 11 and is recessed in an arc shape in a side view of the station 2. Since the cleaner body 7 is putted down from above the platform 41 and connected (coupled) to the station 2, the coupling guide 168 conforming to the shape of the rear end of the cleaner body 7 ensures the positioning of the cleaner body 7 in the storage configuration of the electric vacuum cleaning apparatus 1.

The charging terminals 46 and the inlet of the dust transfer tube 43 are disposed in the coupling guide 168. The inlet of the dust transfer tube 43 is provided with a seal member 173 that seals the connection portion between the dust transfer tube 43 and the electric vacuum cleaner 3, i.e., the connection portion between the dust transfer tube 43 and the primary dust container 13.

The drive source 169 is, for example, an electric motor. The drive source 169 is electrically connected to the station controller 51. The drive source 169 is controlled with the station controller 51 in a manner similar to the secondary electric blower 50.

The drive source 169 generates the opening drive force and the closing drive force of the suction-port lid 94 of the electric vacuum cleaner 3. The drive source 169 generates the driving force of the dust-removal mechanism 95 of the electric vacuum cleaner 3. That is, the drive source 169 generates the driving force of the waste-outlet lid 92, the suction-port lid 94, and the dust-removal mechanism 95. In other words, the drive source 169 generates the driving force of the driven mechanism 120. The drive source 19 is provided between the inlet of the dust transfer tube 43 and the dust collection part 142. The drive source 169 generates the driving force of the dust compression mechanism 98 of the electric vacuum cleaner 3.

The power transmission mechanism 171 is an appropriate mechanism for transmitting the power of the drive source 169 from the drive source 169, i.e., from the output shaft of the electric motor to the centerline of the driven part 121 of the cleaner body 7 in the storage configuration of the electric vacuum cleaning apparatus 1. The power transmission mechanism 171 according to the present embodiment includes: a plurality of, for example, three gears 171*a*, 171*b*, and 171*c* that are meshed sequentially; and a gear box (not shown) that rotatably supports and accommodates these gears 171*a*, 171*b*, and 171*c*. The power transmission mechanism 171 may be a mechanism combining pulleys and a belt or be a mechanism combining sprockets and a chain.

Next, a description will be given of a power transmission passage for transmitting the driving force of the drive source 169 from the station 2 to the cleaner body 7.

Figure 25:
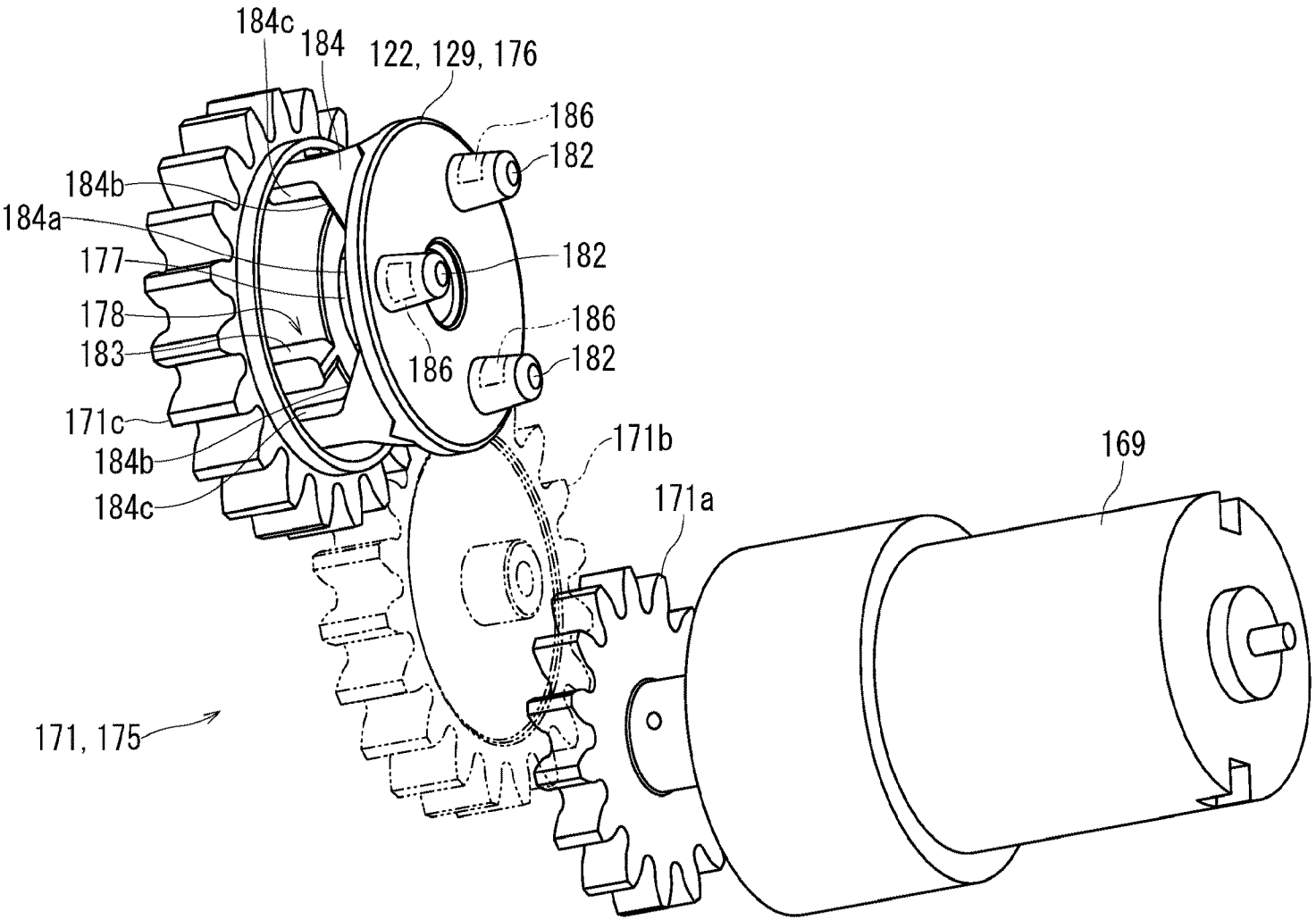
FIG. 25 is a perspective view of a power transmission passage of the electric vacuum cleaning apparatus according to the embodiment of the present invention.

FIG. 25 is a perspective view of the power transmission passage of the electric vacuum cleaning apparatus according to the embodiment of the present invention.

Only the station 2 side of the power transmission passage 175, that is the power transmission mechanism 171, is shown in FIG. 25.

As shown in FIG. 25 in addition to FIG. 10 and FIG. 24, the electric vacuum cleaning apparatus 1 according to the present embodiment includes: the power transmission passage 175 that transmits the driving force from the drive source 169 of the station 2 to the waste-outlet lid 92 of the cleaner body 7; and a coupler 176 that connects (couples) and disconnects (decouples) the power transmission passage 175 between the station 2 and the electric vacuum cleaner 3.

The power transmission passage 175 includes: the power transmission mechanism 96 on the side of the electric vacuum cleaner 3; and the power transmission mechanism 171 on the side of the station 2. The coupler 176 causes the power transmission passage 175 to function by coupling the power transmission mechanism 96 on the side of the electric vacuum cleaner 3 to the power transmission mechanism 171 on the side of the station 2. The power transmission passage 175 transmits the driving force from the drive source 169 on the side of the station 2 to the driven mechanism 120 on the side of the electric vacuum cleaner 3 (i.e., to the dust-removal mechanism 95, the waste-outlet lid 92, and the suction-port lid 94).

The power transmission mechanism 171 and the coupler 176 excluding and the driven part 121 of the cleaner body 7 are covered with the bulge 47 of the platform 41. Until the electric vacuum cleaner 3 is connected to the station 2, the coupler 176 is in a retracted position where contact with the electric vacuum cleaner 3 can be avoided. When the electric vacuum cleaner 3 is connected to the station 2, the coupler 176 moves to the coupling position where the driving force of the drive source 169 can be transmitted to the electric vacuum cleaner 3. The bulge 47 accommodates the driving part 122 such that the driving part 122 can appear and hide.

The coupler 176 includes: the shaft coupling 129; a drive source that generates power for disconnecting (decoupling) the shaft coupling 129 (for example, a disconnecting spring 177); and a cam mechanism 178 that connects (couples) the shaft coupling 129 with the driving force to be generated by the drive source 169. The coupler 176 connects (couples) the shaft coupling 129 by the driving force of the drive source 169, and disconnects (decouples) the shaft coupling 129 by the spring force of the disconnecting spring 177.

The shaft coupling 129 is a so-called dog clutch or a coupling. The shaft coupling 129 includes the driven part 121 provided with the power transmission mechanism 96 of the electric vacuum cleaner 3; and the driving part 122 provided with the power transmission mechanism 171 of the station 2.

The driven part 121 includes a plurality of arc-shaped grooves 181 that are circularly arranged. The driving part 122 includes a plurality of pins 182 that are circularly arranged. Each of the pins 182 has a diameter by which each pin 182 can be inserted into and removed from any arc-shaped groove 181. Each pin 182 is preferably tapered to facilitate insertion into each arc-shaped groove 181.

The driving part 122 continuingly rotates by the driving force transmitted from the power transmission mechanism 171. When the shaft coupling 129 is engaged, the driven part 121 rotates together with the driving part 122. The driving part 122 protrudes from the bulge 47 of the station 2 so as to be coupled to the driven part 121. The driving part 122 protrudes from the bulge 47 disposed on the side of the cleaner body 7 in the width direction of the cleaner body 7 so as to be coupled to the driven part 121. In other words, when the cleaner body 7 is detached from the station 2 and when the cleaner body 7 is returned to the station 2, the coupler 176 couples and decouples the shaft coupling 129 by bringing the driving part 122 into and out of the bulge 47 in the moving direction of the cleaner body 7, i.e., in the direction intersecting with the vertical direction. That is, the moving direction of the electric vacuum cleaner 3 at the time of attaching the electric vacuum cleaner 3 to the station 2 crosses the direction in which the coupler 176 moves between the retracted position and the coupling position. Accordingly, the coupler 176 can prevent, for example, dust from intruding into the station 2 from the gap between the bulge 47 and the driving part 122, so as to ensure satisfactory operation of the power transmission mechanism 171.

The driving part 122 is not limited to the embodiment that protrudes from the bulge 47 in the width direction of the cleaner body 7 and is coupled to the driven part 121. The driving part 122 may be provided on the coupling guide 148, protrude from the coupling guide 168 and be coupled to the driven part 121 at the same time as the cleaner body 7 is connected to the station 2 (as indicated by the two-dot chain with the reference sign 122 in FIG. 23). Further, the driving part 122 may be disposed in the dust collection part 42 and protruded in front of the station 2 so as to be coupled to the driven part 121 (as indicated by the dotted line with the reference sign 122 in FIG. 23).

The disconnecting spring 177 pulls the driving part 122 in the direction by which the shaft coupling 129 is disconnected, i.e., in the direction to be separated away from the driven part 121. In other words, the disconnecting spring 177 pulls in the driving part 122 in the direction to be buried in the bulge 47.

The cam mechanism 178 is provided on the side of the station 2. The cam mechanism 178 is a so-called face cam. The cam mechanism 178 converts the rotational motion of the power transmission mechanism 171 into the linear motion of the driving part 122, i.e., into the motion in which the driving part 122 appears from and hides into the bulge 47. As the linear motion of the driving part 122 progresses appropriately, the cam mechanism 178 causes the driving part 122 to rotate. The cam mechanism 178 includes a driving member 183 to be rotated by the power transmission mechanism 151 and a driven member 184 provided on the driving part 122. The driven member 184 includes a first cam face 184*a*, second cam faces 184*b*, and third cam faces 184*c*. The first cam face 184*a* is the closest to the shaft 182 of the driving part 122 and extends in the circumferential direction of the driving part 122, i.e., in the direction perpendicular to the rotation centerline of the driving part 122. Each second cam face 184*b* is inclined with respect to the rotation centerline of the driving part 122 and extends in the direction opposite to the shaft 182 of the driving part 122. Each third cam face 184*c* is a continuation from the top of one of the second cam faces 184*b* and extends in the direction away from the first cam face 184*a*. Each third cam face 184*c* extends substantially parallel to the rotation centerline of the driving part 122. The driving member 183 is shaped to be in line contact with the first cam face 184*a* and the second cam surfaces 184*b* and to be in surface contact with the third cam surfaces 184*c*.

When the coupler 176 is disconnected (decoupled), the coupler 176 brings the driving member 183 into contact with the first cam face 184*a* of the driven member 184 of the cam mechanism 178 or brings the driving member 183 the closest to the first cam face 184*a*. In this state, the driving part 122 gets into the bulge 47 of the station 2 the most and is hidden. When the drive source 169 starts up, the driving member 183 rotates together with the gear 171*c* of the power transmission mechanism 171. The rotating driving member 183 moves the first cam face 184*a* of the driven member 184, approaches the second cam faces 184*b*, and eventually rides on the second cam faces 184*b*. At this time, the driving part 122 is pushed out of the bulge 47 by the force of the driving member 183 that pushes the second cam faces 184*b*, and is engaged with the driven part 121. As the rotation of the driving part 122 progresses and the driving member 183 comes into surface contact with the third cam faces 184*c*, the entirety of the coupler 176 rotates in synchronization with the driving member 183.

The driving part 122 is pulled into the bulge 47 by the spring force of the disconnecting spring 177. This spring force generates appropriate frictional force between the driving member 183 and the driven member 184, and reliably causes the driving member 183 to ride on the second cam faces 184*b* of the driven member 184.

When the driven part 121 of the cleaner body 7 is viewed from the driving part 122 of the station 2, the cam mechanism 178 has the second cam face 164*b* and the third cam surface 164*c* in each of the clockwise direction (i.e., normal rotation direction of the driving part 122) and the counter-clockwise direction (i.e., reverse rotation direction of the driving part 122). In other words, the cam mechanism 158 has a pair of second cam faces 184*b* sandwiching the first cam face 184*a* between them, and also has a pair of third cam faces 184*c* sandwiching the first cam face 164*a* between them.

For example, it is assumed that the power transmission passage 175 opens the waste-outlet lid 92 and the suction-port lid 94 by rotating the driving part 122 in the normal rotation direction and closes the waste-outlet lid 92 and the suction-port lid 94 by rotating the driving part 122 in the reverse rotation direction. One of the second cam faces 184*b* and one of the third cam faces 184*c* establish the engagement of the coupler 176 along with the normal rotation of the driving part 122 so as to open the waste-outlet lid 92 and the suction-port lid 94. The other of the second cam faces 184*b* and the other of the third cam faces 184*c* establish the engagement of the coupler 176 along with the reverse rotation of the driving part 122 so as to close the waste-outlet lid 92 and the suction-port lid 94.

The coupler 176 may be provided with charging terminals 186 that supply power from the station 2 to the rechargeable battery 17 so as to charge the rechargeable battery 17. Instead of the charging terminals 46 provided on the platform 41, the charging terminals 186 charge the rechargeable battery 17. The charging terminals 186 are provided on both the driven part 121 of the cleaner body 7 and the driving part 122 of the station 2. The charging terminals 186 are electrically connected when the coupler 176 is coupled, i.e., when the driving part 122 of the station 2 is coupled to the driven part 121 of the cleaner body 7.

Figure 26:
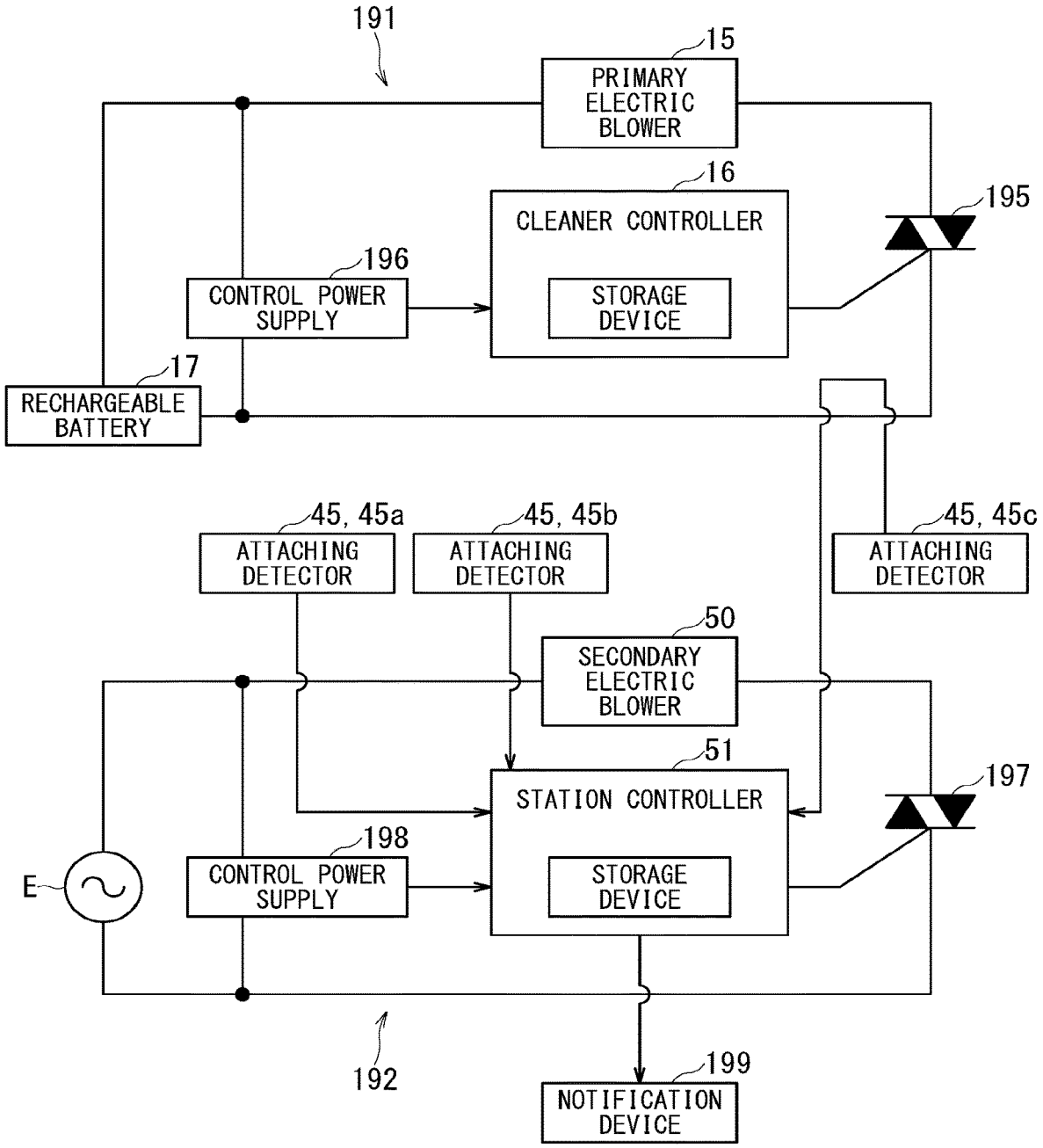
FIG. 26 is a block diagram of the electric vacuum cleaning apparatus according to the embodiment of the present invention.

FIG. 26 is a block diagram of the electric vacuum cleaning apparatus according to the embodiment of the present invention.

As shown in FIG. 26, the electric vacuum cleaning apparatus 1 according to the present embodiment includes: a control circuit 191 on the side of the electric vacuum cleaner 3; and a control circuit 192 on the side of the station 2.

The control circuit 191 on the side of the electric vacuum cleaner 3 controls the operation of the primary electric blower 15 exclusively. The control circuit 191 on side of the electric vacuum cleaner 3 is provided with: the primary electric blower 15 to be connected in series with the rechargeable battery 17; a switching element 195 that opens and closes an electric path connecting the rechargeable battery 17 to the primary electric blower 15; a control power supply 196 that converts the voltage of the rechargeable battery 17 and supplies power to the cleaner controller 16; and the cleaner controller 16 configured to control the operation of the primary electric blower 15.

The switching element 195 includes a gate that is connected to the cleaner controller 16. The switching element 195 controls the input of the primary electric blower 15 depending on change in the gate current.

The control power supply 196 is a power supply circuit that generates control power of the cleaner controller 16.

The control circuit 192 on the side of the station 2 controls the operation of the secondary electric blower 50 exclusively. The control circuit 192 on the side of the station 2 is provided with: the secondary electric blower 50 to be connected in series with a commercial AC power supply E; a switching element 197 that opens and closes an electric path connecting the secondary electric blower 50 to the commercial AC power supply E; a control power supply 198 that converts the power from the commercial AC power supply E and supplies the converted power to the station controller 51; the attaching detectors 45 configured to detect that the electric vacuum cleaner 3 is attached to the station 2; the station controller 51 configured to control the operation of the secondary electric blower 50; and a notification device 199 to be connected to the station controller 51. The control circuit 192 on the side of the station 2 further includes a charging circuit (not shown) for charging the rechargeable battery 17 of the electric vacuum cleaner 3.

The switching element 197 is an element such as a bidirectional thyristor or a reverse blocking three-terminal thyristor. The switching element 197 includes a gate that is connected to the station controller 51. The switching element 197 controls the input of the secondary electric blower 50 depending on change in the gate current.

The control power supply 198 is a power supply circuit that generates control power of the station controller 51.

The attaching detectors 45 are desirably connected to the control circuit 192 in such a manner that the attaching detectors 45 open an electric path when a detection target is in the storage state and close the electric path when the detection target is not in the storage state (i.e., when the detection target is in use).

That is, when the electric vacuum cleaner 3 is connected to the station 2 (i.e., when the electric vacuum cleaner 3 is attached to the station 2) or when the electric vacuum cleaner 3 is placed on the platform 41, the first attaching detector 45*a* opens the electric path. When the electric vacuum cleaner 3 is disconnected from the station 2 (i.e., when the electric vacuum cleaner 3 is separated from the station 2) or when the electric vacuum cleaner 3 is separated from the platform 41, the first attaching detector 45*a* closes the electrical path. The second attaching detector 45*b* opens the electric path when the tubular part 8 of the electric vacuum cleaner 3 is attached to the station 2. The second attaching detector 45*b* closes the electric path when the tubular part 8 of the electric vacuum cleaner 3 is separated from the station 2. The same applies to the case where the hose attachment 53 is provided on the cleaner body 7. In this case, the electric path to be opened or closed by the second attaching detector 45*b* is included in the control circuit 191 on the side of the electric vacuum cleaner 3.

When at least two attaching detectors 45 among the plurality of attaching detectors 45 detect that the electric vacuum cleaner 3 is attached to the station 2, the station controller 51 permits transfer of dust from the primary dust container 13 to the secondary dust container 49. After a predetermined delay time elapses from the permission of the transfer of dust (i.e., after a predetermined delay time elapses since at least two attaching detectors 45 among the plurality of attaching detectors 45 have detected a attaching of the electric vacuum cleaner 3 to the station 2), the station controller 51 starts up the secondary electric blower 50 to start the transfer of dust.

The attaching detectors 45 may include a third attaching detector 45*c* configured to detect whether the body handle 14 of the electric vacuum cleaner 3 is in the storage position. The attaching detectors 45 may include the third attaching detector 45*c* in addition to the first attaching detector 45*a* and the second attaching detector 45*b*. The attaching detectors 45 may include the third attaching detector 45*c* instead of the second attaching detector 45*b*. In the case where the attaching detectors 45 include the first to third attaching detectors 45*a*, 45*b*, and 45*c*, the station controller 51 may be configured to permit the transfer of dust from the primary dust container 13 to the secondary dust container 49 when all the three attaching detectors 45 have detected the attaching of the electric vacuum cleaner 3 to the station 2. The station controller 51 may be configured to permit the transfer of dust from the primary dust container 13 to the secondary dust container 49 when two out of the three attaching detectors 45

(i.e., the pair of the first attaching detector 45*a* and the second attaching detector 45*b*, the pair of the first attaching detector 45*a* and the third attaching detector 45*c*, or the pair of the second attaching detector 45*b* and the third attaching detector 45*c*) have detected the attaching of the electric vacuum cleaner 3 to the station 2. The station controller 51 may be configured to permit the transfer of dust from the primary dust container 13 to the secondary dust container 49 when the first attaching detector 45*a* and one of the second attaching detector 45*b* and the third attaching detector 45*c* have detected the attaching of the electric vacuum cleaner 3 to the station 2.

The body handle 14 is movable between the use position and the storage position. The storage position of the body handle 14 is the position when the body handle 14 is accommodated in the handle storage recess 11*b* of the body housing 11. The use position of the body handle 14 is the position when the body handle 14 is pulled out of the handle storage recess 11*b* of the body housing 11.

Within a predetermined time after at least one of the attaching detectors 45 detects that the electric vacuum cleaner 3 is attached to the station 2, when at least one of the other attaching detectors 45 does not detect the attaching of the electric vacuum cleaner 3 to station 2, the notification device 199 performs notification. In other words, when at least one attaching detector 45 does not detect the attaching of the electric vacuum cleaner 3 to the station 2 within the predetermined time after at least one of the other attaching detectors 45 detects the attaching of the electric vacuum cleaner 3 to the station 2, the notification device 199 notifies a user that the mounting state of the electric vacuum cleaner 3 mounted on the station 2 is incomplete. In some embodiments, the notification device 199 may be a component appealing to the vision of the user of the electric vacuum cleaning apparatus 1, such as a display configured to display information by using characters, a lighting or blinking lamp, and an LED (Light Emitting Diodes), a component appealing to the hearing of the user of the electric vacuum cleaning apparatus 1, such as a sound generator configured to emit electrically synthesized voice or buzzer sound, and a component appealing the haptic sense of the user of the electric vacuum cleaning apparatus 1, such as a vibrator.

The cleaner body 7 is connected to the station 2 and thereby the electric vacuum cleaning apparatus 1 shifts to the storage configuration. Then, the charging electrodes 19 of the cleaner body 7 are brought into contact with the charging terminals 46 of the station 2 and are electrically connected to the charging terminals 46. The inlet of the dust transfer tube 43 adheres to the outer surface of the container body 78 of the primary dust container 13 through the body-housing waste-outlet 100 of the cleaner body 7.

Figure 27:
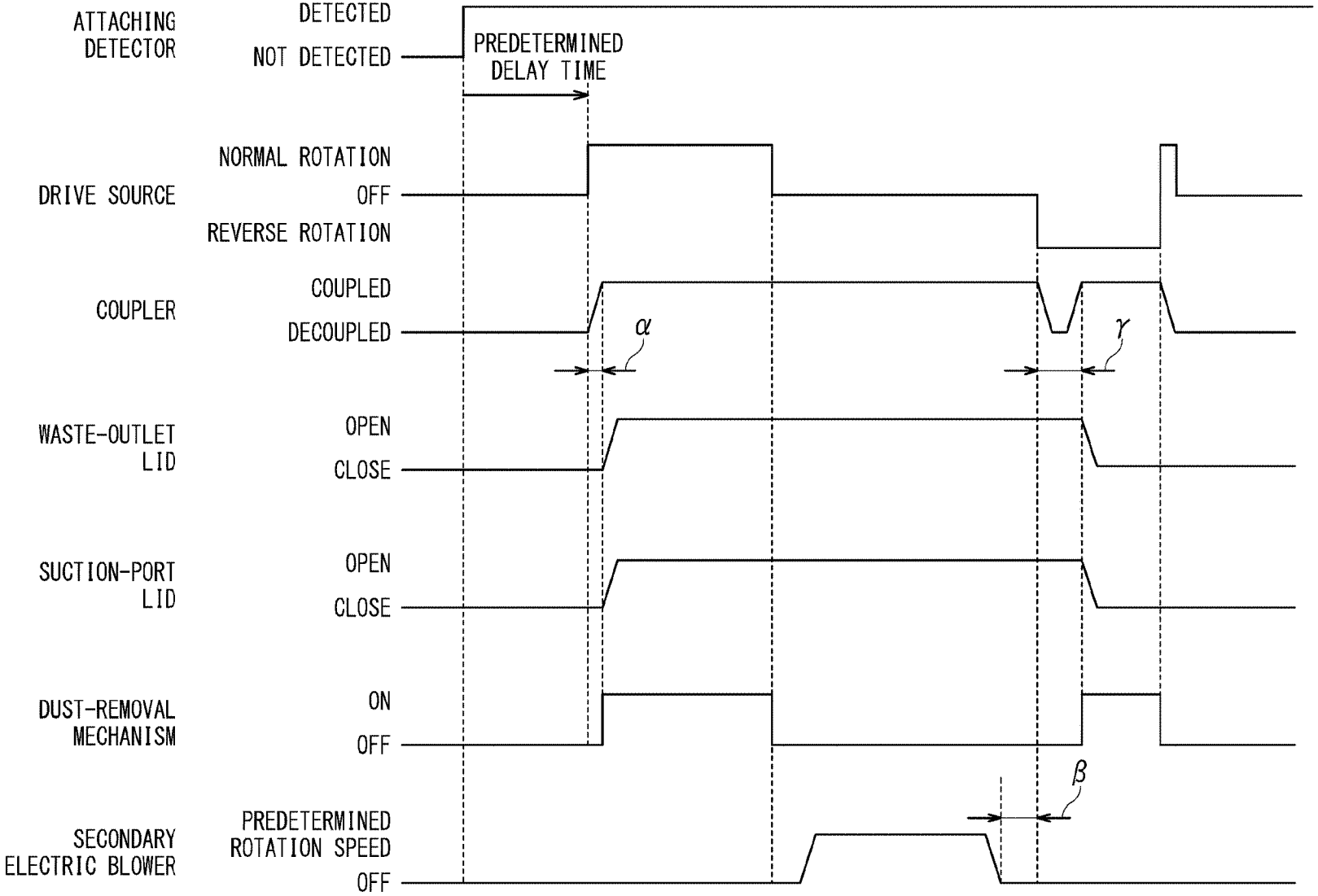
FIG. 27 is a sequence chart illustrating transfer of dust from the electric vacuum cleaner to the station to be performed by the electric vacuum cleaning apparatus according to the embodiment of the present invention.

FIG. 27 is a sequence chart illustrating the transfer of dust from the electric vacuum cleaner to the station to be performed by the electric vacuum cleaning apparatus according to the embodiment of the present invention.

After the electric vacuum cleaner 3 is stored in the station 2, until the transfer of dust from the primary dust container 13 to the secondary dust container 49 is started, the drive source 169 of the electric vacuum cleaning apparatus 1 maintains the stopped state and closes the waste-outlet lid 92 and the suction-port lid 94.

The station controller 51 detects that the cleaner body 7 is connected to the station 2, on the basis of the detection results of the attaching detectors 45. When at least two attaching detectors 45 among the plurality of attaching detectors 45 have detected a connecting of the cleaner body 7 to the station 2, the station controller 51 starts the drive source 169 after the elapse of the predetermined delay time. When the drive source 169 starts, the driving part 122 of the station 2 protrudes from the bulge 47 and is coupled to the driven part 121 of the cleaner body 7. That is, the coupler 176 is coupled (time lag $\alpha$ in FIG. 27). The station controller 51 continues driving the drive source 169 even after the coupler 176 is coupled. The power transmission passage 175, in which the coupler 176 is coupled, distributes and transmits the driving force of the drive source 169 to the waste-outlet lid 92, the suction-port lid 94, and the dust-removal mechanism 95.

The driving force transmitted from the power transmission passage 175 fully opens the waste-outlet lid 92 and the suction-port lid 94. That is, when the electric vacuum cleaner 3 is stored in the station 2, the secondary dust container 49 is fluidly connected to the primary dust container 13 through the waste outlet 91 and the dust transfer tube 43.

The dust-removal mechanism 95 removes fine dust attached to the filters 86 and 87 by the driving force transmitted through the power transmission passage 175. The station controller 51 temporarily stops the drive source 169 after continuously operating the drive source 169 for an appropriate period of time for causing the dust-removal mechanism 95 to remove the dust attached to the filters 86 and 87, for example, for 10 seconds.

Next, the secondary electric blower 50 generates negative pressure after the drive source 169 fully opens the waste-outlet lid 92 and the suction-port lid 94. The station controller 51 starts up the secondary electric blower 50. The started secondary electric blower 50 sucks in air from the secondary dust container 49 so as to generate the negative pressure. That is, the secondary electric blower 50 acts the negative pressure to the secondary dust container 49 after the drive source 169 opens the waste-outlet lid 92. The secondary electric blower 50 acts the negative pressure to the secondary dust container 49 after the drive source 169 opens the suction-port lid 94. The secondary electric blower 50 acts the negative pressure to the secondary dust container 49 after the drive source 169 drives the dust-removal mechanism 95.

In the case shown in FIG. 27, the drive source 169 stops the dust-removal mechanism 95 and then activates the secondary electric blower 50. However, after the drive source 169 opens the waste-outlet lid 92 and the suction-port lid 94, the secondary electric blower 50 may be activated while the dust-removal mechanism 95 is being driven.

The negative pressure acting on the secondary dust container 49 acts on the primary dust container 13 through the dust transfer tube 43 and the waste outlet 91. Then, the primary dust container 13 sucks in air from the suction port 93. And then, air is also drawn from the connection port 18. The air sucked into the primary dust container 13 causes the coarse dust in the coarse-dust collecting chamber 71 to flow out of the coarse-dust waste-outlet 101 to the dust transfer tube 43, and causes the fine dust in the filter chamber 72 to flow out of the fine-dust waste-outlet 102 to the dust transfer tube 43. The dust (in which the coarse dust and the fine dust are mixed) flowing into the dust transfer tube 43 is sucked into the secondary dust container 49 through the dust transfer tube 43.

The first centrifugal separator 164 of the secondary dust container 49 separates and accumulates the coarse dust from the dust that has flowed in from the dust transfer tube 43. The second centrifugal separator 165 separates and accumulates the fine dust passing through the first centrifugal separator 164.

The station controller 51 operates the secondary electric blower 50 for an appropriate duration (for example, 10 seconds) so as to transfer substantially all the dust accumulated in the primary dust container 13 to the secondary dust container 49, and then stops the secondary electric blower 50. The station controller 51 reverses the temporarily stopped drive source 169 when the secondary electric blower 50 stops and the inside of the secondary dust container 49 returns to a positive pressure (i.e., atmospheric pressure, time lag β in FIG. 27). When the drive source 169 starts to reverse, the driving part 122 of the station 2 is separated from the driven part 121 of the cleaner body 7 and is once pulled into the bulge 47. That is, the coupling of the coupler 176 is temporarily decoupled. The station controller 51 continues the reversal of the drive source 169. When the reversal of the drive source 169 continues, the driving part 122 of the station 2 protrudes again from the bulge 47 and is coupled to the driven part 121 of the cleaner body 7 (time lag γ in FIG. 27). That is, the coupler 176 is coupled. The station controller 51 continues the operation of the drive source 169. The power transmission passage 175, in which the coupler 176 is coupled, distributes and transmits the driving force of the drive source 169 to the waste-outlet lid 92, the suction-port lid 94, and the dust-removal mechanism 95.

The drive source 169 generates the closing driving force of the waste-outlet lid 92 so as to close the waste outlet 91 after the secondary electric blower 50 stops the operation of generating the negative pressure for transferring the dust. In addition, the drive source 169 generates the closing driving force of the suction-port lid 94 so as to close the suction port 93 after the secondary electric blower 50 stops the operation of generating the negative pressure for transferring the dust. The driving force transmitted from the power transmission passage 175 fully closes the waste-outlet lid 92 and the suction-port lid 94. The station controller 51 continuously reverses the drive source 169 for an appropriate period (for example, 3 seconds) in which the waste-outlet lid 92 and the suction-port lid 94 are fully closed.

Then, the station controller 51 temporarily stops the drive source 169 after the waste-outlet lid 92 and the suction-port lid 94 are fully closed. Afterward, the station controller 51 rotates the drive source 169 in the normal direction again. When the drive source 169 starts to rotate in the normal direction, the driving part 122 of the station 2 is separated from the driven part 121 of the cleaner body 7 and is once pulled into the bulge 47. That is, the coupler 176 is decoupled again. The station controller 51 stops the drive source 169 after the driving part 122 of the station 2 is pulled into the bulge 47. In other words, the coupler 176 moves to the retracted position when the driven mechanism 120 (i.e., the dust-removal mechanism 95, the waste-outlet lid 92, and the suction-port lid 94) is operated.

Next, a description will be given of the handle 55 of the electric vacuum cleaner 3, the platform 41 of the station 2, and the speed reducer 44 according to the present embodiment.

Figure 28:
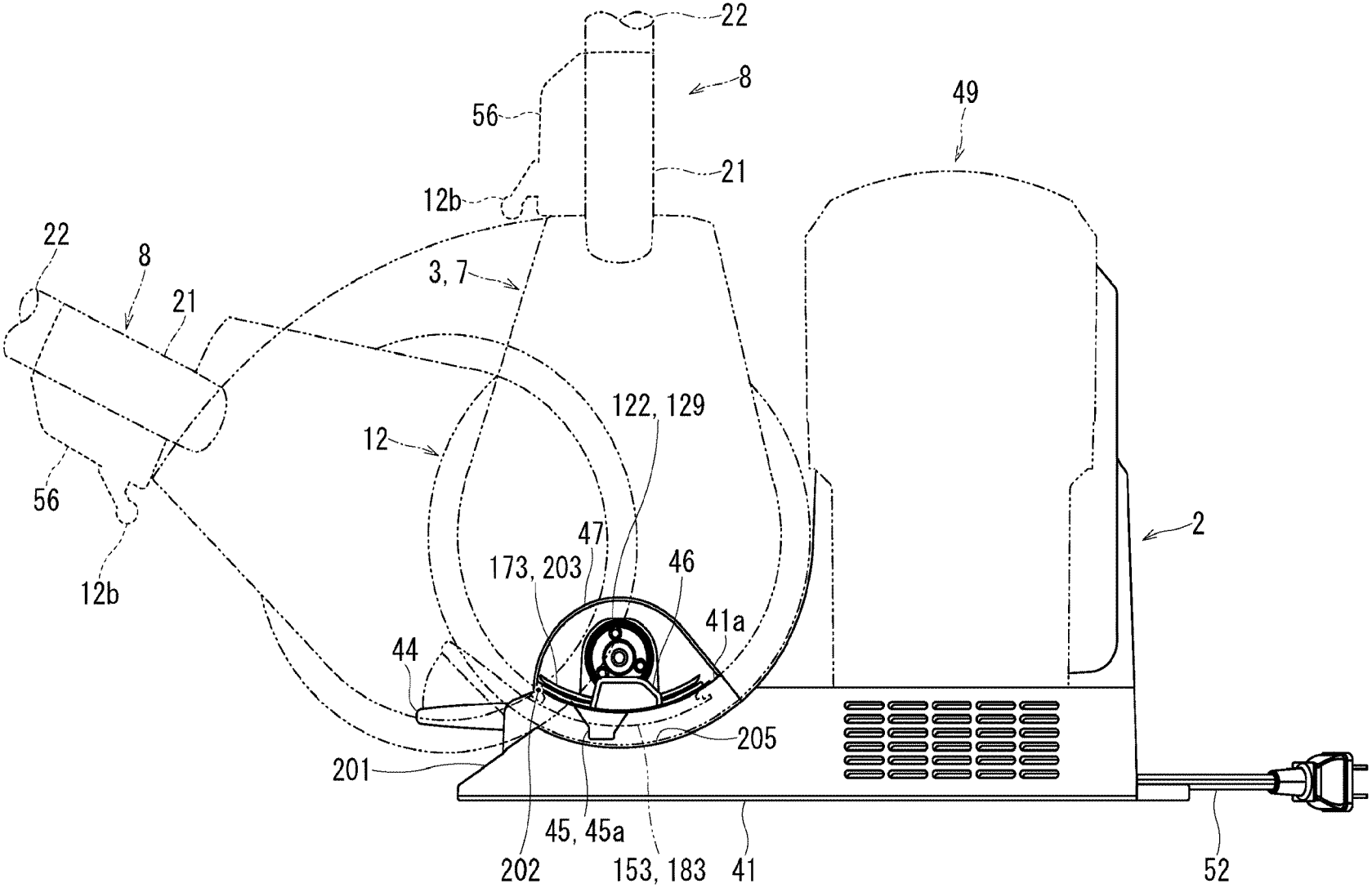
FIG. 28 is a side view of the electric vacuum cleaning apparatus according to the embodiment of the present invention.

FIG. 28 is a side view of the electric vacuum cleaning apparatus according to the embodiment of the present invention.

Figure 29:
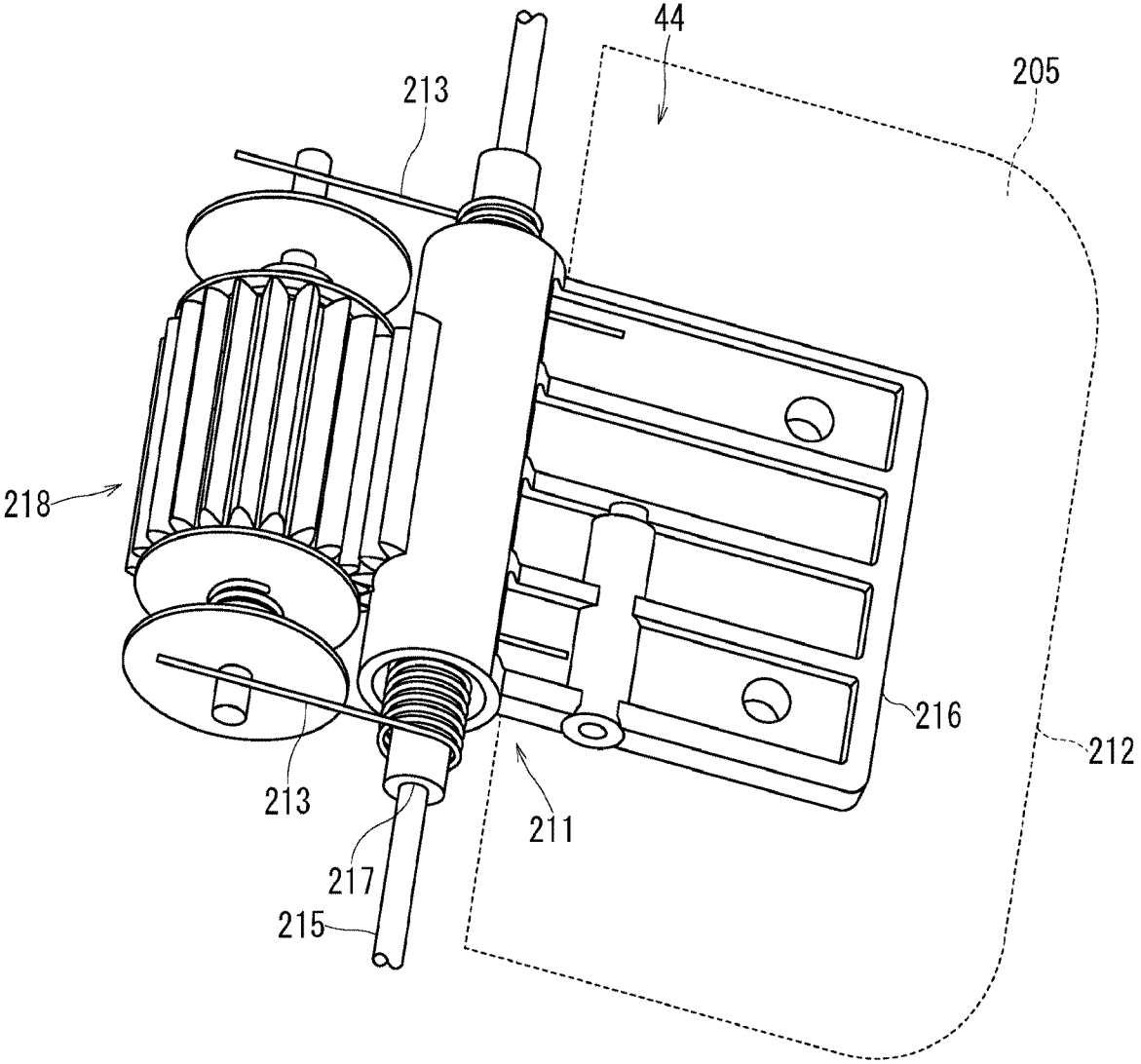
FIG. 29 is a perspective view of a speed reducer of the electric vacuum cleaning apparatus according to the embodiment of the present invention.

FIG. 29 is a perspective view of the speed reducer of the electric vacuum cleaning apparatus according to the embodiment of the present invention.

Figure 30:
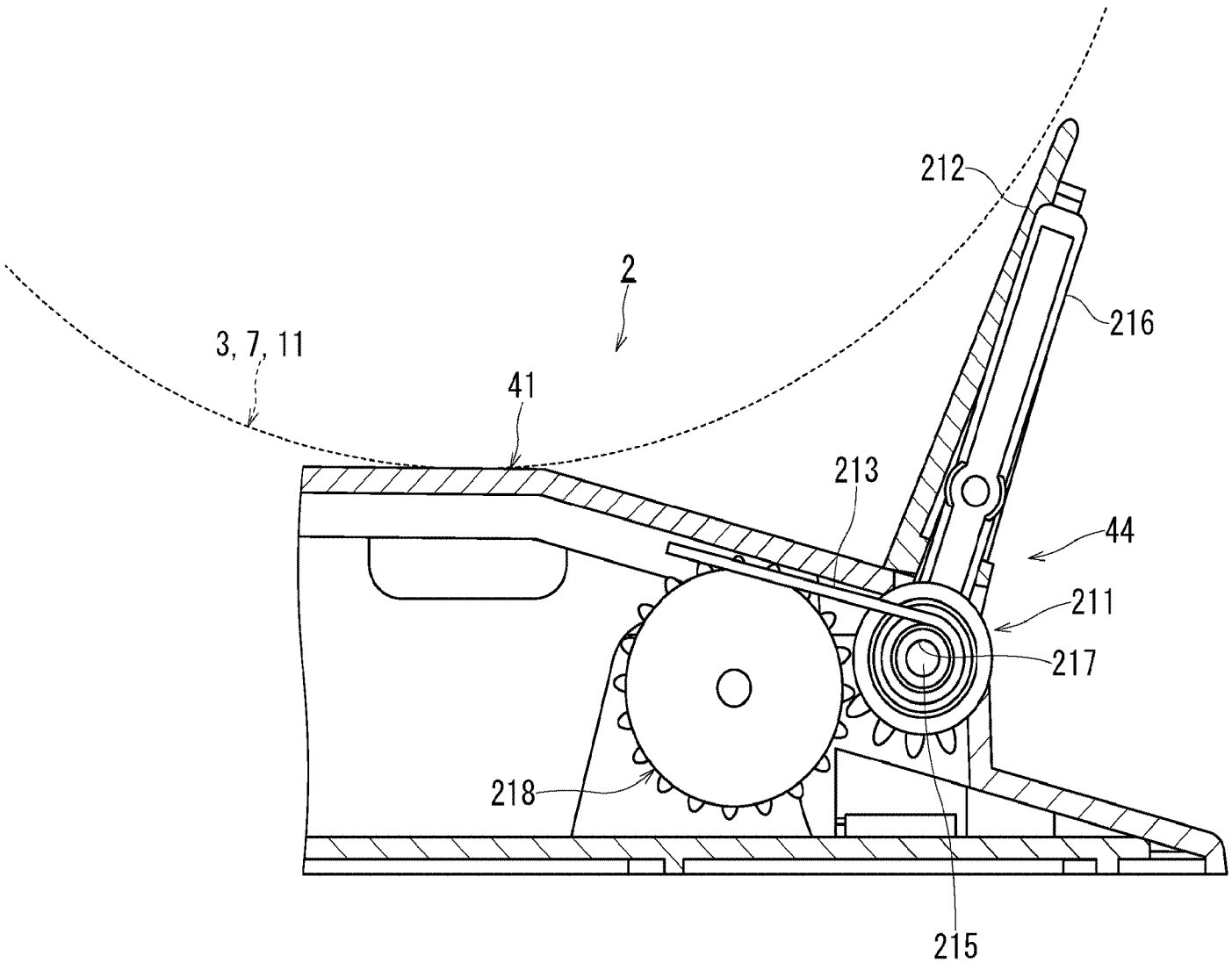
FIG. 30 is a cross-sectional view of the speed reducer of the electric vacuum cleaning apparatus according to the embodiment of the present invention.
Figure 31:
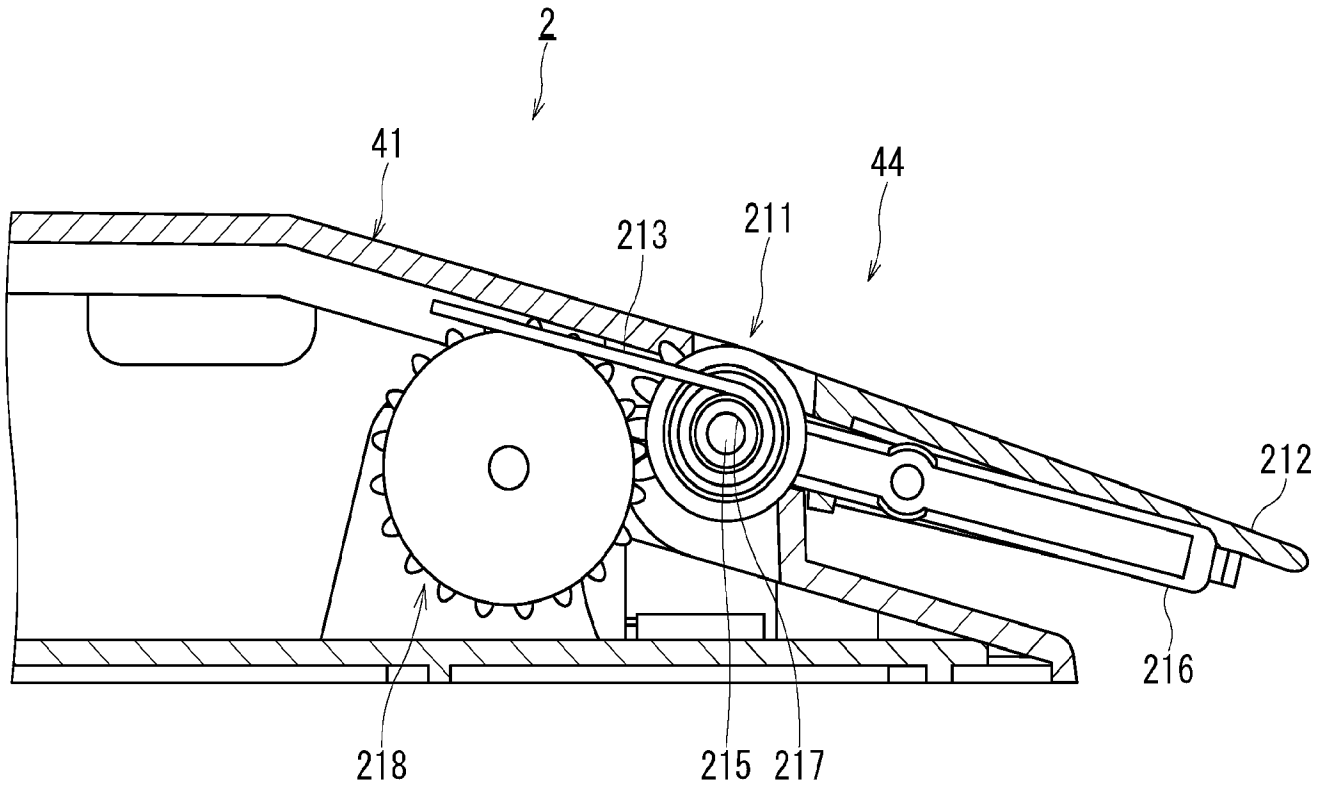
FIG. 31 is another cross-sectional view of the speed reducer of the electric vacuum cleaning apparatus according to the embodiment of the present invention.

FIG. 30 and FIG. 31 are cross-sectional views of the speed reducer of the electric vacuum cleaning apparatus according to the embodiment of the present invention.

FIG. 30 shows the speed reducer 44 that has swung upward to approach the cleaner body 7 and is in the state of waiting. FIG. 31 shows the speed reducer 44 that has moved so as to allow the cleaner body 7 to travel when the cleaner body 7 is separated from the station 2.

As shown in FIG. 28 to FIG. 31 in addition to FIG. 1 and FIG. 2, the handle 55 of the electric vacuum cleaning apparatus 1 according to the present embodiment extends vertically in the storage position in which the electric vacuum cleaner 3 is placed on the station 2. In the storage state in which the electric vacuum cleaner 3 is placed on the station 2, the handle 55 is provided on the opposite side of the dust collection part 42. In other words, the handle 55 is disposed on the front side of the station 2 in the storage state in which the electric vacuum cleaner 3 is placed on the station 2.

The cleaner body 7 of the electric vacuum cleaning apparatus 1 in the use position is lifted to shift the cleaner body 7 to the storage position, then the cleaner body 7 in the storage position is putted down from above the station 2 onto the platform 41, so as to shift to the storage configuration. In this case, when the cleaner body 7 is lifted by holding the handle 55, the position of the electric vacuum cleaner 3 readily shifts (is raised) to the storage position, in which the front of the cleaner body 7 faces upward and the back of the cleaner body 7 faces downward, by the geometry between the handle 55, the center of gravity of the cleaner body 7, and the wheels 12. That is, when the handle 55 is pulled up, the cleaner body 7 rises around the rotation centerline of the wheels 12 while keeping the wheels 12 grounded. A user can lift the cleaner body 7 with the simple action of holding the hand on the handle 55 and pulling it up, and can lift the cleaner body 7 by holding the handle 55 as it is. Thus, in the case of placing the cleaner body 7 on the platform 41 of the station 2, the burden on the user can be reduced and thus it is user-friendly.

The platform 41 includes a placing face 41*a* and a pair of grounding guide faces 201 that contact the wheels 12 in the process of the cleaner body 7 falling from the storage position to the use position. The platform 41 further includes an overturning fulcrum 202 that supports the cleaner body 7 when the cleaner body 7 falls from the storage position to the use position.

The electric vacuum cleaning apparatus 1 includes a slip resistance 203 that is provided on the overturning fulcrum 202 or the cleaner body 7 so as to prevent the slip between the cleaner body 7 and the overturning fulcrum 202 when the cleaner body 7 falls from the storage position to the use position.

The placing face 41*a* has a shape of the back face of the cleaner body 7, i.e., an arc shape that follows the arc shape of the cleaner body 7. The placing face 41*a* is recessed in an arc shape with respect to the horizontal plane.

Each grounding guide face 201 is a slope that is inclined downward to the front of the station 2 such that the cleaner body 7 falling from the storage position to the use position can readily advance to the front of the station 2. Each grounding guide face 201 is continuation from an arc-shaped wheel disposition recess 205 for accommodating the corresponding wheels 12 of the cleaner body 7 to be stored in the station 2. Thus, each wheel 12 smoothly contacts the grounding guide face 201 in the process in which the cleaner body 7 falls from the storage position to the use position, and supports the cleaner body 7.

The overturning fulcrum 202 is provided above the bottommost of the placing face 41*a*. Thus, when the cleaner body 7 in the storage position is laid down, the cleaner body 7 falls like a lever around the overturning fulcrum 202 and smoothly shifts to the use position.

When the cleaner body 7 falls from the storage position to the use position, the contact point between the overturning fulcrum 202 and the cleaner body 7 preferably does not slip. When the contact point between the overturning fulcrum 202 and the cleaner body 7 slips, it becomes difficult to determine the behavior, the falling track, or the falling trajectory when the cleaner body 7 falls. Thus, it is preferred that the contact point between the overturning fulcrum 202 and the cleaner body 7 does not slip greatly while a slight slip can be acceptable. Hence, the seal member 173 provided at the inlet of the dust transfer tube 43 also functions as the overturning fulcrum 202. A portion of the seal member 173 that seals the side portion 43*b*, which is on the front of the dust transfer tube 43, functions as the overturning fulcrum 202. The seal member 173 is preferably a synthetic rubber such as natural rubber and silicone rubber in order to seal the connection portion between the dust transfer tube 43 and the primary dust container 13. Since the seal member 173 is not slippery with respect to the cleaner body 7 and is in contact with the cleaner body 7 in the storage state, the seal member 173 is suitable as the overturning fulcrum 202 and also functions as the slip resistance 203.

In addition, the overturning fulcrum 202 may be a member other than the seal member 173. In detail, the overturning fulcrum 202 may be a rib-shaped protrusion provided on the platform 41. Additionally, the slip resistance 203 may be a member other than the seal member 173. It is sufficient that the slip resistance is sandwiched between the cleaner body 7 and the overturning fulcrum 202, and the slip resistance may be provided on the side of the cleaner body 7 or on the side of the station 2.

The speed reducer 44 is provided at the tip of the platform 41 of the station 2. The speed reducer 44 reduces the moving speed of the cleaner body 7 in the process in which the cleaner body 7 falls (i.e., changes the position) from the storage position to the use position. The speed reducer 44 includes: a hinge 211; a support plate 212 swingably supported by the hinge 211; and an elastic member 213 that stores energy when the cleaner body 7 moves so as to be able to advance, and consumes the stored energy for returning the speed reducer 44 to a standby position.

The hinge 211 includes: a shaft 215 supported by the platform 41 of the station 2; and a plate 216 to which the support plate 212 is fixed. The plate 216 has a hole 217 in which the shaft 215 is disposed. The plate 216 swings around the shaft 215. That is, the speed reducer 44 moves so as to fall with the hinge 191 between the standby position where it approaches the cleaner body 7 and a ready-to-move position where the cleaner body 7 can advance. The shaft 215 extends in the width direction of the cleaner body 7 in the storage state. In other words, the shaft 215 is disposed substantially in parallel with the rotation centerline of the wheels 12 of the cleaner body 7 mounted on the platform 41. Thus, when the speed reducer 44 falls, the cleaner body 7 shifts to the use position.

The support plate 212 supports the cleaner body 7 by being in contact with the body housing 11 that moves (falls) from the storage state to the use state. The support plate 212 extends in the width direction of the body housing 11 so as to stably support the moving cleaner body 7. The support plate 212 preferably has a protective material such as piloerection on its surface to be in contact with the cleaner body 7.

When the cleaner body 7 moves so as to be able to advance (i.e., when the cleaner body 7 falls from the storage position to the use position), the support plate 212 forms a downward slope from the coupling guide 168 to the surface to be cleaned such that the cleaner body 7 can be readily detached from the platform 41.

The speed reducer 44 may reduce the moving speed with a so-called brake mechanism 218. The speed reducer 44 may be provided with an oil damper (not shown) for containing the hydraulic oil.

When a user pulls any part of tubular part 8 of the electric vacuum cleaner 3 (preferably the hand operation tube 23 or the grip 25), the elastic member 213 succumbs to the user's operation force and the overturning moment of the cleaner body 7 so as to move (or lay down) the speed reducer 44. This movement causes the elastic member 213 to store energy for returning the speed reducer 44.

The elastic member 213 is, for example, a torsion spring. The elastic member 213 does not interfere with the cleaner body 7 mounted on the platform 41 in the storage position to fall down due to application of external force, and enables the speed reducer 44 to return to the standby position after the cleaner body 7 is separated from the station 2.

The charging terminals 46 of the station 2 can be connected to the cleaner body 7 in the storage state, and the connection between the charging terminals 46 and the cleaner body 7 is released when the cleaner body 7 is laid down to the use position. For this reason, as shown in FIG. 24, the terminal cover 219 of the charging terminals 46 include slits 219*a* directed upward of the station 2 and a slit 219*b* directed in the direction of detaching the electric vacuum cleaner 3 from the station 2 (i.e., the front direction of the station 2). The charge terminals 46 are connected to the corresponding charging electrodes 19 of the cleaner body 7 to be inserted into the slits 219*a* and 219*b*.

The electric vacuum cleaner 3 can be used by lifting the cleaner body 7 in the storage position from the platform 41 above the station 2 and putting it to the use position on the surface to be cleaned (floor surface). However, it is less convenient to lift and move the cleaner body 7 at the time of using the electric vacuum cleaner 3.

For this reason, the electric vacuum cleaning apparatus 1 according to the present embodiment can start using the electric vacuum cleaner 3 by tilting down the cleaner body 7 in the storage position. For example, when a user pulls the dust collection hose 22 toward the front of the station 2 by holding any part of the tubular part 8 of the electric vacuum cleaner 3 (preferably the hand operation tube 23 or the grip 25), the cleaner body 7 falls from the storage position to the use position. The overturning fulcrum 202 functions as a fulcrum when the cleaner body 7 shifts from the storage position to the use position. In other words, when a sufficiently large force to overcome the overturning fulcrum 202 is applied to the cleaner body 7 by a user's operation, the cleaner body 7 shifts from the storage position to the use position while turning around the overturning fulcrum 202 as a fulcrum. At this time, the speed reducer 44 reduces a shock to the cleaner body 7 by reducing a falling speed of the cleaner body 7. In addition, when the auxiliary wheel 12*b* of the electric vacuum cleaner 3 is grounded, the suspension mechanism 56 (FIG. 4) provided between the auxiliary wheel 12*b* and the handle 55 cushions the shock of grounding to be added to the cleaner body 7.

When the user further pulls the tubular part 8, the cleaner body 7 is separated from the station 2. That is, the user can quickly and smoothly start cleaning with the electric vacuum cleaner 3 only by pulling the tubular part 8.

The electric vacuum cleaner 3 of the electric vacuum cleaning apparatus 1 falls toward the front of the station 2 when the tubular part 8 is pulled toward the front of the station 2, and the electric vacuum cleaner 3 detaches from the station 2 when the tubular part 8 is further pulled toward the front of the station 2. Thus, in the electric vacuum cleaning apparatus 1, the position shift of the cleaner body 7 (from the storage position to the use position) and start of cleaning can be performed together only by pulling the tubular part 8 toward the front of the station 2.

The speed reducer 44 can be applied not only to the station 2 having the charging function and the dust collecting function but also to a simple storage stand that does not have the charging function or the dust collecting function.

The electric vacuum cleaning apparatus 1 according to the present embodiment includes: the coarse-dust waste-outlet 101 that discharges coarse dust from the coarse-dust collecting chamber 71 of the electric vacuum cleaner 3; the fine-dust waste-outlet 102 that is provided adjacent to the coarse-dust waste-outlet 101 and discharges fine dust to flow out from the filter chamber 72; and the waste-outlet lid 92 that opens and closes both of the coarse-dust waste-outlet 101 and the fine-dust waste-outlet 102 together. Consequently, the electric vacuum cleaning apparatus 1 can transfer both of the coarse dust and the fine dust together to the secondary dust container through a single air passage, i.e., through the dust transfer tube 43. In addition, the electric vacuum cleaning apparatus 1 can transfer both of the coarse dust and the fine dust together to the secondary dust container 49 by applying negative pressure to the dust transfer tube 43.

Further, the electric vacuum cleaning apparatus 1 according to the present embodiment includes the filter chamber 72 that is adjacent to the coarse-dust collecting chamber 71. Consequently, the electric vacuum cleaning apparatus 1 does not require an extra air passage for having the coarse-dust waste-outlet 101 adjacent to the fine-dust waste-outlet 102, and thus its structure can be simplified.

Moreover, the electric vacuum cleaning apparatus 1 according to the present embodiment includes the fine-dust waste-outlet 102 and the coarse-dust waste-outlet 101, each of which opens downward when the electric vacuum cleaner 3 is connected to the station 2. Consequently, the electric vacuum cleaning apparatus 1 can use the falling of dust due to its own weight in addition to the negative pressure to be generated by the secondary electric blower 50 for discharging the dust in the primary dust container 13, and thus can discharge the dust more smoothly.

Furthermore, the electric vacuum cleaning apparatus 1 according to the present embodiment includes the suction port 93 that introduces air directly from the outside of the air passage including the primary dust container 13 by the negative pressure to be generated by the secondary electric blower 50, and blows the air to the filters 86 and 87. Consequently, the electric vacuum cleaning apparatus 1 can reliably remove dust from the fine-mesh filters 86 and 87 to which dust easily adheres, and can discharge the removed dust from the fine-dust waste-outlet 102.

Additionally, the electric vacuum cleaning apparatus 1 according to the present embodiment includes the fine-dust waste-outlet 102 that has an opening area smaller than that of the coarse-dust waste-outlet 101. Consequently, the electric vacuum cleaning apparatus 1 can reliably discharge fine dust with faster air flow.

Further, the electric vacuum cleaning apparatus 1 according to the present embodiment includes: the coarse-dust waste-outlet 101 that is disposed below the upstream of the air passage of the second mesh filter 84 for filtering out coarse dust when the electric vacuum cleaner 3 is connected to the station 2; and the fine-dust waste-outlet 102 disposed below the upstream of the air passage of the pair of filters and 87 for filtering out fine dust. Consequently, the electric vacuum cleaning apparatus 1 can readily apply the negative pressure that is to be generated by the secondary electric blower 50 of the station 2 to the dust adhered the second mesh filter 84 and the pair of filters 86 and 87, and can discharge the dust more smoothly.

According to the electric vacuum cleaning apparatus 1 of the present embodiment as described above, dust from plural separation stages (i.e., first separator 68 and the filter 69) can be discharged all together.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

REFERENCE SIGNS LIST

1 electric vacuum cleaning apparatus
2 station
3 electric vacuum cleaner
7 cleaner body
8 hose
11 body housing
11*a* exhaust-port lid
11*b* handle storage recess
12 wheel
12*a* auxiliary wheel
12*b* auxiliary wheel
12*c* grounding wall
12*d* side wall
13 primary dust container
13*a* first half
13*b* second half
14 body handle
15 primary electric blower
16 cleaner controller
17 rechargeable battery
17*a* unit cell
18 connection port
19 charging electrode
21 connecting tube
22 dust collecting hose
23 hand operation tube
25 grip
26 input unit
26*a* stop switch
26*b* start switch
26*c* brush switch
27 extension tube
27*a* holding projection
28 cleaning head
31 suction port
32 rotatable brush
33 electric motor
41 platform
41*a* placing face
42 dust collection part
43 dust transfer tube

43*b* side portion
44 speed reducer
45 attaching detector
45*a* first attaching detector
45*b* second attaching detector
45*c* third attaching detector
46 charging terminal
47 bulge
48 housing
49 secondary dust container
50 secondary electric blower
51 station controller
52 power cord
53 hose attachment
55 handle
55*a* inclined portion
56 suspension mechanism
57 dust container chamber
57*a* dust-container insertion and extraction port
58 electric blower chamber
59 extrusion force generator
59*a* rod
59*b* coil spring
60 auxiliary roller
61 container lock mechanism
62 claw
63 claw receiver
64 separation part
65 dust collection part
66 communication passage
66*a*, 66*b* air passage
66*c* collective air passage
67 leg
68 first separator
69 filter
71 coarse-dust collecting chamber
72 filter chamber
73 dust collecting chamber
75 nozzle
76 first filter frame
77 first mesh filter
78 container body
78*a* suction port
79 coarse-dust discharge port
81 relay air-passage
82 coarse-dust collecting chamber outlet
82*a* lower-side coarse-dust collecting chamber outlet
82*b* upper-side coarse-dust collecting chamber outlet
82*c* opening
82*d* opening
83 partition wall
83*a* both side portions
84 second mesh filter
84*a* lower-side second mesh filter
84*b* upper-side second mesh filter
85 expanded portion
86 filter
87 filter
86*a*, 87*b* ridge line of the filter
88 secondary filter frame
89 secondary filter outlet
91 waste outlet
92 waste-outlet lid
93 suction port
94 suction-port lid
95 dust-removal mechanism
96 power transmission mechanism
97 recess part
97*a* first portion
97*b* second portion
98 dust compression mechanism
99 machine chamber
100 body-housing waste-outlet
101 coarse-dust waste-outlet
102 fine-dust waste-outlet
103 packing
105 operation part
107 lock mechanism
108 dust guiding face
111 rack
111*a* hole
111*b* teeth
112 driven mechanism
113 gear
113*a* teeth
115 frame
116 slider
117 dust remover
118 rail
120 driven mechanism
121 driven part
122 driving part
126 first transmission mechanism
127 second transmission mechanism
128 third Transmission mechanism
129 shaft coupling
131 first gear
132 second gear
133 shaft
134 lever
134*a* teeth
135 guide
136 stopper
137 groove
138 guide plate
139 slider
140 waste-lid closing spring
141 unhooking-force transmission mechanism
142 elastic member
143 pair
145 slider
146 slider
147 link
147*a* first joint
147*b* second joint
147*c* pin hole
147*d* pin
148 container handle
149 link mechanism
151 base
152*a* first roller
152*b* second roller
152*c* third roller
152*d* fourth roller
152*e* fifth roller
152*f* sixth roller
153 base support member
153*a* flange
154 return spring
155 handle return mechanism
157*a* first gear
157*b* second gear
157*c* third gear
158 return spring

163 centrifugal separation device
164 first centrifugal separator
165 second centrifugal separator
166 downstream air duct
168 coupling guide
169 drive source
171 power transmission mechanism
171*a*, 171*b*, 171*c* gears
173 seal member
175 power transmission passage
176 coupler
177 disconnecting spring
178 cam mechanism
181 arc-shaped groove
182 pin
183 driving member
184 driven member
184*a* first cam face
184*b* second cam face
184*c* third cam face
186 charging terminal
191 control circuit
192 control circuit
195 switching element
196 control power supply
197 switching element
198 control power supply
199 notification device
201 grounding guide face
202 overturning fulcrum
203 slip resistance
205 wheel disposition recess
211 hinge
212 support plate
213 elastic member
215 shaft
216 plate
217 hole
218 brake mechanism
219 terminal cover
219*a*, 219*b* slit

The invention claimed is:

1. An electric vacuum cleaning apparatus comprising: a station; and an electric vacuum cleaner that is connectable to and disconnectable from the station, wherein the electric vacuum cleaner comprises:

a first separator that separates coarse dust from dust-containing air to be sucked into the electric vacuum cleaner, wherein the coarse dust is unevenly distributed in a region near the center of the air flow and separated from primary separation gas flowing outside the region;

a second separator that accepts the primary separation gas having passed through the first separator and separates fine dust from the primary separation gas;

a primary dust container forming therein a coarse-dust collecting chamber that accumulates the coarse dust separated with the first separator and a fine-dust collecting chamber that accumulates the fine dust separated with the second separator;

a coarse-dust waste-outlet that discharges the coarse dust to flow out from the coarse-dust collecting chamber;

a fine-dust waste-outlet that is disposed adjacent to the coarse-dust waste-outlet, and discharges the fine dust to flow out from the fine-dust collecting chamber; and a waste-outlet lid that opens and closes both of the coarse-dust waste-outlet and the fine-dust waste-outlet together, wherein the station comprises:

a secondary dust container that accumulates the coarse dust to be discharged from coarse-dust collecting chamber through the coarse-dust waste-outlet and the fine dust to be discharged from the fine-dust collecting chamber through the fine-dust waste-outlet; and an electric blower that applies negative pressure to the primary dust container through the secondary dust container, and transfers the coarse dust and the fine dust from the primary dust container to the secondary dust container, and at the time of transferring the coarse dust and the fine dust, a first air flow path that runs from the first separator to the coarse-dust waste-outlet via the coarse-dust collecting chamber, and a second air flow path that branches from the first separator and reaches the fine-dust waste-outlet via the fine-dust collecting chamber are formed in the electric vacuum cleaner in parallel with each other.

2. The electric vacuum cleaning apparatus according to claim 1, wherein the fine-dust collecting chamber is adjacent to the coarse-dust collecting chamber.

3. The electric vacuum cleaning apparatus according to claim 2, wherein the coarse-dust waste-outlet and the fine-dust waste-outlet are opened downward under when the electric vacuum cleaner is connected to the station.

4. The electric vacuum cleaning apparatus according to claim 3, wherein:

the second separator includes a filter that filters and separates the fine dust; and the electric vacuum cleaner includes a suction port that directly introduces air from outside of an air passage including the primary dust container by negative pressure to be generated with the electric blower, and blows the air onto the filter.

5. The electric vacuum cleaning apparatus according to claim 4, wherein an opening area of the fine-dust waste-outlet is smaller than an opening area of the coarse-dust waste-outlet.

6. The electric vacuum cleaning apparatus according to claim 3, wherein an opening area of the fine-dust waste-outlet is smaller than an opening area of the coarse-dust waste-outlet.

7. The electric vacuum cleaning apparatus according to claim 2, wherein:

the second separator includes a filter that filters and separates the fine dust; and the electric vacuum cleaner includes a suction port that directly introduces air from outside of an air passage including the primary dust container by negative pressure to be generated with the electric blower, and blows the air onto the filter.

8. The electric vacuum cleaning apparatus according to claim 7, wherein an opening area of the fine-dust waste-outlet is smaller than an opening area of the coarse-dust waste-outlet.

9. The electric vacuum cleaning apparatus according to claim 2, wherein an opening area of the fine-dust waste-outlet is smaller than an opening area of the coarse-dust waste-outlet.

10. The electric vacuum cleaning apparatus according to claim 1, wherein the coarse-dust waste-outlet and the fine-dust waste-outlet are opened downward under when the electric vacuum cleaner is connected to the station.

11. The electric vacuum cleaning apparatus according to claim 3, wherein:

the second separator includes a filter that filters and separates the fine dust; and the electric vacuum cleaner includes a suction port that directly introduces air from outside of an air passage including the primary dust container by negative pressure to be generated with the electric blower, and blows the air onto the filter.

12. The electric vacuum cleaning apparatus according to claim 11, wherein an opening area of the fine-dust waste-outlet is smaller than an opening area of the coarse-dust waste-outlet.

13. The electric vacuum cleaning apparatus according to claim 10, wherein an opening area of the fine-dust waste-outlet is smaller than an opening area of the coarse-dust waste-outlet.

14. The electric vacuum cleaning apparatus according to claim 1, wherein:

the second separator includes a filter that filters and separates the fine dust; and the electric vacuum cleaner includes a suction port that directly introduces air from outside of an air passage including the primary dust container by negative pressure to be generated with the electric Mower, and blows the air onto the filter.

15. The electric vacuum cleaning apparatus according to claim 14, wherein an opening area of the fine-dust waste-outlet is smaller than an opening area of the coarse-dust waste-outlet.

16. The electric vacuum cleaning apparatus according to claim 1, wherein an opening area of the fine-dust waste-outlet is smaller than an opening area of the coarse-dust waste-outlet.

17. The electric vacuum cleaning apparatus according to claim 10, wherein an opening area of the fine-dust waste-outlet is smaller than an opening area of the coarse-dust waste-outlet.

* * * * *